US006929356B2

(12) United States Patent
Hirano et al.

(10) Patent No.: US 6,929,356 B2
(45) Date of Patent: Aug. 16, 2005

(54) CONTAINER OF CONSUMABLE SUPPLIES FOR A PRINTER AND PRINTER UTILIZING THE CONTAINER

(75) Inventors: Hirofumi Hirano, Kanagawa (JP); Yoshitaka Okamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 10/100,143

(22) Filed: Mar. 19, 2002

(65) Prior Publication Data

US 2002/0145649 A1 Oct. 10, 2002

(30) Foreign Application Priority Data

Mar. 21, 2001 (JP) ..... 2001-081641
Mar. 21, 2001 (JP) ..... 2001-081642

(51) Int. Cl.[7] ..... B41J 2/17; B41J 2/175
(52) U.S. Cl. ..... 347/85; 347/84; 347/86
(58) Field of Search ..... 347/85, 84, 86, 347/109, 108; B41J 2/17, 2/175

(56) References Cited

U.S. PATENT DOCUMENTS 4,760,409 A 7/1988 Kiyohara et al.
5,541,631 A * 7/1996 Hashimoto ..... 347/86
5,581,287 A * 12/1996 Baezner et al. ..... 347/85
5,633,667 A * 5/1997 Miyazawa ..... 347/86
5,929,883 A * 7/1999 Gunther et al. ..... 347/85
5,949,443 A 9/1999 Yamamoto et al.
6,076,920 A * 6/2000 Zapata et al. ..... 347/85
6,145,967 A * 11/2000 Langford et al. ..... 347/85
6,149,256 A * 11/2000 McIntyre et al. ..... 347/2
6,264,318 B1 * 7/2001 Oda et al. ..... 347/86
6,312,124 B1 * 11/2001 Desormeaux ..... 347/109
6,378,997 B1 4/2002 Nitta
6,390,616 B2 * 5/2002 Shinada et al. ..... 347/86
6,612,683 B2 * 9/2003 Takahashi et al. ..... 347/30
6,629,758 B2 * 10/2003 Okamoto et al. ..... 347/85
6,648,459 B2 * 11/2003 Usui et al. ..... 347/86
6,705,712 B2 * 3/2004 Usui et al. ..... 347/86
6,712,458 B2 * 3/2004 Hatasa et al. ..... 347/86

FOREIGN PATENT DOCUMENTS

| | | |
|---|---|---|
| EP | 1 057 644 | 12/2000 |
| JP | 59-167425 | 9/1984 |
| JP | 60-125671 | 7/1985 |
| JP | 7-315590 | 12/1995 |
| JP | 11-227957 | 8/1999 |
| JP | 11-254700 | 9/1999 |

* cited by examiner

*Primary Examiner*—Stephen D. Meier
*Assistant Examiner*—Leonard Liang
(74) *Attorney, Agent, or Firm*—Fitzpatrick, Cella, Harper & Scinto

(57) ABSTRACT

A container for containing consumable supplies for the use of an ink jet printer includes an ink containing portion for containing an ink, and an ink communication member for causing ink communication by piercing the ink containing portion when the container is attached to the printer. Before the container is attached to the printer, the ink containing portion can contain the ink sealingly and independently of the outside. As a result, ink leakage during distribution of the container can be prevented and the ink containing portion having, e.g., a bag-like shape, can be produced by a simple process, for sealingly containing the ink.

5 Claims, 50 Drawing Sheets

CONTAINER OF CONSUMABLE SUPPLIES FOR A PRINTER AND PRINTER UTILIZING THE CONTAINER

This application is based on Japanese Patent Application Nos. 2001-081641 and 2001-081642 both filed Mar. 21, 2001, the contents of which are incorporated hereinto by reference.

BACKGROUND OF THE INVENTION

1. Field of the Invention

The present invention relates to a container for consumable supplies of a printer, and a printer utilizing the container.

2. Description of the Related Art

The recent spread of digital cameras has resulted in increasing needs for printing photographed images without the intervention of a personal computer. Known apparatus formed by integrating a camera and a printer include Polaroid® cameras.

SUMMARY OF THE INVENTION

One possible approach to achieve functions similar to those of such Polaroid cameras with a digital camera is to configure a printer-built-in camera by integrating a digital camera for photographing an image with a printer for printing the photographed image. With such a printer-built-in camera, a photographed image can be printed any time without using any other apparatus.

In the case of a printer which must be compact and light-weight, e.g., a printer integrated with a digital camera, a printer consumable container for containing printing media, ink and so on as printer consumable supplies is used. The size of the printer may be increased when the printer consumable container is always attached, and it is therefore desirable to attach the container to the printer as occasions demand. When such a container is used, the container may be removed except during a printing operation to improve the operability of the printer or the camera.

It is a purpose of the invention to provide a container for consumable supplies of a printer suitable for use with a printer utilizing inks, and a printer.

In a first aspect of the present invention, there is provided a container of consumable supplies for a printer, the container being attachable to a printer for printing on a printing medium by using an inkjet head for ejecting ink, the container having an ink containing portion for hermetically containing ink to be supplied to the inkjet head and the container comprising:

a ink supply connecting portion connected to an ink receiving portion of the printer as a result of the attaching operation, for allowing the ink contained in the ink containing portion to be supplied to the ink receiving portion of the printer; and an ink communication member entering the ink containing portion as a result of the attaching operation for communicating ink from the ink containing portion to the ink supply connecting portion.

Here, the ink communication member may have a hollow needle stuck into the ink containing portion, and the container may further comprise a member which integrally holds the hollow needle and the ink supply connecting portion and which is displaced in the sticking direction at least in over a distance sufficient to cause the hollow needle to be stuck into the ink containing portion as a result of the attaching operation, thereby establishing the ink communication, and a member for holding the displacing member in the position to which the displacing member is displaced.

The ink containing portion may be in the form of a bag formed by folding a sheet body and by sealing three sides thereof and wherein the hollow needle is stuck into the folded portion that is not sealed, and the container may further comprise a member for supporting the folded portion that is not sealed, for preventing the folded portion from being flattened to make it possible to keep it in a curved state.

At least one of a printing medium to be printed by the inkjet head and a waste ink absorption body for collecting waste ink discharged from the inkjet head may be further contained.

The ink supply connecting portion and the ink communication member may be provided on an integral coupling member for coupling with the ink receiving portion, the coupling member being movable as a result of the attaching operation, and the ink communication member being stuck into the ink containing portion as a result of the movement.

The container may further comprise a support body for supporting the ink containing portion, and wherein each of the support body and the coupling member may have a member for preventing them from being coupled before the container is attached to the printer and a member for preventing them from being decoupled and disengaged from each other after the attachment.

In a second aspect of the present invention, there is provided a container of consumable supplies for a printer, the container being attachable to a printer for printing on a printing medium by using an inkjet head for ejecting ink, the container containing a printing medium to be supplied to the printer, and the container comprising:

a printing medium supply port at least a part of which has a gap dimension smaller than the thickness of one sheet of the contained printing medium to be supplied; and means for engaging with a member provided on the printer at the time of the attachment to expand the gap at the printing medium supply port, thereby allowing the printing medium to be supplied.

Here, the expansion may take place as a result of the engagement such that at least a part of the printing medium supply port has a gap dimension smaller than the thickness of two sheets of the printing medium.

The means may have members which are provided on both sides of the gap at the printing medium supply port and which are displaceable in the direction of expanding the gap when engaged with corresponding members on the printer.

The container may further comprise at least one of an ink supply connecting section for containing ink to be supplied to the inkjet head and for allowing the contained ink to be supplied to the printer at the time of the attachment and a waste ink absorption body for collecting waste ink discharged from the inkjet head.

In a third aspect of the present invention, there is provided a container of consumable supplies for a printer, the container being attachable to a printer for printing on a printing medium by using an inkjet head for ejecting ink, the container containing a printing medium to be supplied to the printer, an ink container containing ink supplied to the inkjet head and a waste ink absorption body for collecting waste ink discharged from the inkjet head, and the container comprising:

a first member for forming an outer housing of the container; and a second member for forming the outer housing of the container, wherein the waste ink absorption body, a first sheet-like member, the printing medium, a second sheet-like member and an elastic member capable of exerting a pressing force from the second sheet-like member toward the first sheet-like member are stacked in the same order and contained in a containing space formed by the combination of the first member and the second member, and wherein the ink container is disposed on the waste ink absorption body.

Here, the container may further comprise an introducing portion for introducing ink discharged from the printer at the time of the attachment and a receiving portion to which a printing medium feeding unit provided on the printer is coupled at the time of the attachment, and wherein the receiving portion and the introducing portion may be provided away from each other, and wherein an ink supply connecting portion for containing ink to be supplied to the inkjet head and for allowing the contained ink to be supplied to the printer at the time of the attachment may be provided between the receiving portion and the introducing portion.

The first sheet-like member on which the printing medium is provided in an overlapping relationship may have an open portion for allowing a printing medium feeding unit provided at the printer to contact the printing medium at the time of the attachment, and wherein the first sheet-like member smoothly supplies the printing medium to the printer according to an operation of the printing medium feeding unit, the first sheet-like member being formed of a material having a small friction coefficient or a material processed to achieve a low friction coefficient.

The second sheet-like member provided such that it sandwiches the printing medium in combination with the sheet-like member may exert the pressing force of the elastic member toward the printing medium feeding unit.

The container may further comprise an introducing portion for introducing ink discharged from the printer at the time of the attachment, and wherein the printing medium containing portion may be spaced from the introducing portion and the waste ink absorption body by the first sheet-like member.

The first member may have an opening -for allowing the printing medium feeding unit to enter in association with the open portion of the first sheet-like member and the first and second members may be joined by coupling an engaging portion provided on one of the members with an engaged portion provided on the other.

The first and second members may be joined by applying an adhesive seal between parts of them in addition to the coupling of the engaging portion and the engaged portion.

The container may be assembled by:

containing the introducing portion, the holding portion, the ink containing portion and the ink supply connecting portion in the first member;

providing the sheet-like member;

placing a printing medium on top of the sheet-like member; and joining the second member to the first member.

Here, the container may be reproduced by replacing or replenishing at least one of the elements between the first member and the second member.

The container may be reproduced by separating the first member and the second member to perform the replacement or replenishment and joining the first member and the second member after the replacement or replenishment.

The first member may have an opening for allowing coupling of a printing medium feeding unit provided at the printer at the time of the attachment, and the second member may have an opening which is provided in a part thereof in a face-to-face relationship with the opening of the first member with the contained printing medium interposed therebetween and which is for allowing coupling of a printing medium urging unit for exerting an urging force to the printing medium toward the printing medium feeding unit through the elastic member at the time of the attachment.

The container may further comprise an opening/closing member for allowing coupling of the printing medium feeding unit by opening the opening of the first accepting portion according to the attachment.

In a fourth aspect of the present invention, there is provided a printer to which a container of consumable supplies for containing a printing medium is attachable and for printing by using an inkjet head for ejecting ink to the printing medium fed from the container, the printer comprising:

a printing medium feeding unit coupled with the contained printing medium through an opening on the container at the time of the attachment to perform the feeding; and an outlet portion for discharging ink to the container of consumable supplies at the time of the attachment, wherein the printing medium feeding unit and the outlet portion are provided away from each other, and wherein the container contains ink to be supplied to the inkjet head, and further comprising an ink supply receiving portion coupled with an ink supply connecting portion of the container for allowing the contained ink to be supplied at the time of the attachment, the ink supply receiving portion being provided between the printing medium feeding unit and the outlet portion.

Here, the container may have an ink containing section for containing inks with a plurality of colors to be supplied to the inkjet head and a plurality of ink supply connecting portions for allowing the inks with a plurality of colors contained in the ink containing section to be supplied at the time of the attachment; a plurality of the ink supply receiving portions associated with the plurality of ink supply connecting portions may be provided between the printing medium feeding unit and the outlet portion; and the outlet portion and the ink supply receiving portions may be integrally held.

In a fifth aspect of the present invention, there is provided a printer to which a container of consumable supplies for containing a printing medium is attachable and for printing by using an inkjet head for ejecting ink to the printing medium supplied from the container, comprising a member for engaging with means provided on the container at the time of the attachment to expand a gap at a printing medium supply port of the container, thereby allowing the printing medium to be supplied, and wherein at least a part of the printing medium supply port has a gap dimension smaller than the thickness of one sheet of the contained printing medium to be supplied and wherein the member performs the expansion as a result of the engagement with the means such that at least a part of the printing medium supply port has a gap dimension smaller than the thickness of two sheets of the printing medium.

The above and other objects, effects, features and advantages of the present invention will become more apparent from the following description of embodiments thereof taken in conjunction with the accompanying drawings.

BRIEF DESCRIPTION OF THE DRAWINGS

FIG. 9A is a plan view of major parts for explaining an uncoupled state of a holder and a joint of the medium pack in FIG. 5, while

FIG. 10A is a sectional view of major parts for explaining an unconnected state of the holder and an ink pack of the medium pack in FIG. 5, while

FIG. 16A being a front view for explaining an example of a configuration of an opening for transporting a printing medium in the medium pack in FIG. 5, while FIG. 16B being a sectional view taken along the line XVIB—XVIB in FIG. 16A;

FIG. 17A being a front view for explaining an example of another configuration of the opening for transporting a printing medium of the medium pack in FIG. 5, while FIG. 17B being a sectional view taken along the line XVIIB—XVIIB in FIG. 17A;

DETAILED DESCRIPTION OF PREFERRED EMBODIMENTS

Embodiments of the printing apparatus according to the present invention will be described by referring to the accompanying drawings.

In the present specification, "printing" (also referred to as "recording" in some occasions) means not only a condition of forming significant information such as characters and drawings, but also a condition of forming images, designs, patterns and the like on printing media widely or a condition of processing the printing media, regardless of significance or lack thereof or of forming an image in such manner as to be visually perceived by a human.

Further, the "printing medium" means not only a paper used in a conventional printing apparatus but also everything capable of accepting inks, such as fabrics, plastic films, metal plates, glasses, ceramics, wood and leathers, and in the following, will be also represented by a "sheet" or simply by "paper".

Further, in the present specification, a "camera" indicates an apparatus or device that optically photographs an image and converts the photographed image into electrical signals, and in the following explanation, is also referred to as a "photographing section".

Still further, an "ink" (also referred to as "liquid" in some occasions) should be interpreted in a broad sense like the definition of "printing" above and thus the ink, by being applied on the printing media, shall mean a liquid to be used for forming images, designs, patterns and the like, processing the printing medium or processing inks (for example, coagulation or encapsulation of coloring materials in the inks to be applied to the printing media).

One embodiment of a head to which the present invention is advantageously employed is the embodiment in which thermal energy generated by an electrothermal transducer is utilized to cause film boiling in the liquid resulting in a formation of bubbles.

[Basic Structure]

Firstly, a basic structure of a device according to the present invention will be explained in view of FIGS. 1 to 4. The device explained in the present embodiment is constituted as information processing equipment comprising a photographing section for optically photographing an image and then converting the photographed image into electric signals (hereinafter, also referred to as a "camera section") and an image recording section for recording an image on the basis of the thus obtained electric signals (hereinafter, also referred to as a "printer section"). Hereinafter, the information processing equipment in the present embodiment will be explained using the term "printer-built-in camera".

Figure 4:
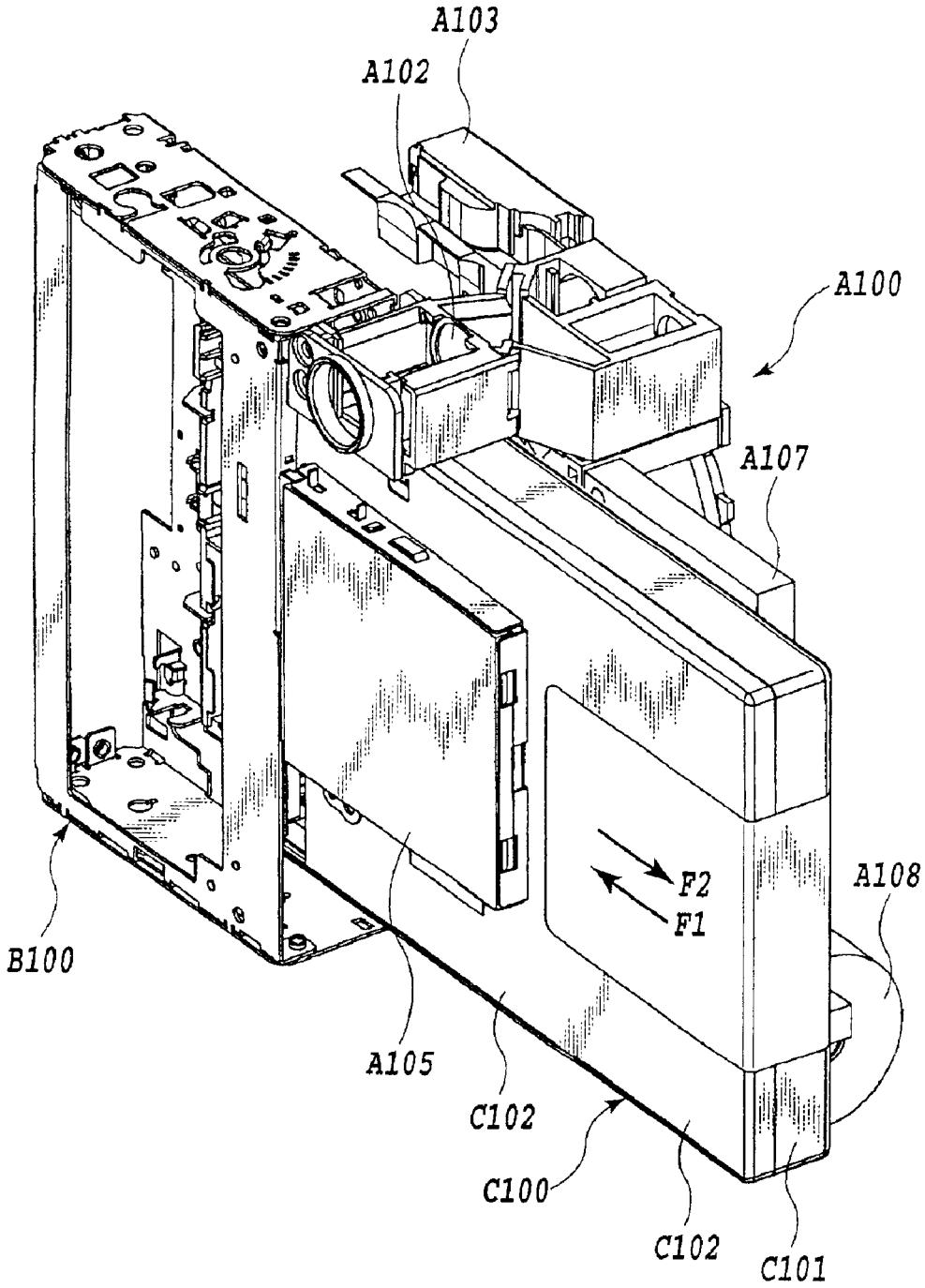
FIG. 4 is a perspective view showing a positional relationship between major parts in the camera in FIG. 1.

In a main body A001, there is incorporated a printer section (recording apparatus section) B100 at the backside of a camera section A100 in an integral manner. The printer section B100 records an image by using inks and printing media which are supplied from a medium pack (a container of consumable supplies for a printer) C100. In the present structure, as apparent from FIG. 4 illustrating the main body A001 viewed from the backside with an outer package removed, the medium pack C100 is inserted at the right-hand side of the main body A001 in FIG. 4 and the printer section B100 is arranged at the left-hand side of the main body A001 in FIG. 4. In the case of performing a recording by the printer section B100, the main body A001 can be placed facing a liquid crystal display section A105 up and a lens A101 down. In this recording position, a recording head B305 of the printer section B100, which will be described below, is made to be positioned to eject inks in the downward direction. The recording position can be made to be the same position as that of the photographing condition by the camera section A100 and thus is not limited to the recording position as mentioned above. However, in view of a stability of the recording operation, the recording position capable of ejecting the inks in the downward direction is preferred.

In the following will be explanations of the basic mechanical structure according to the present embodiment under the headings 1 "Camera Section", 2 "Medium Pack" and 3 "Printer Section", and of the basic structure of the signal processing under the heading 4 "Control System".

1: Camera Section

Figure 1:
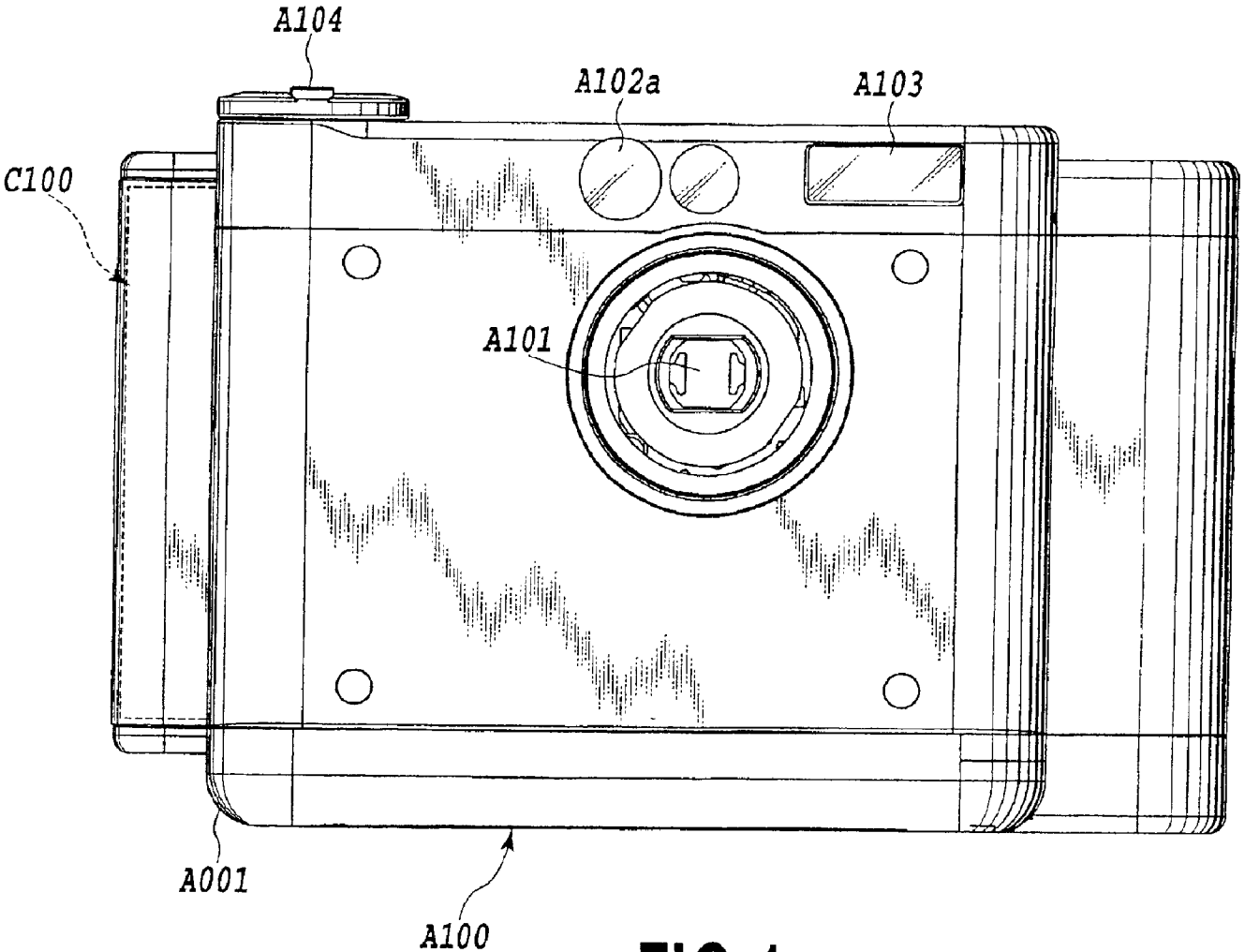
FIG. 1 is a front view of a printer-built-in camera to which the invention can be applied.
Figure 2:
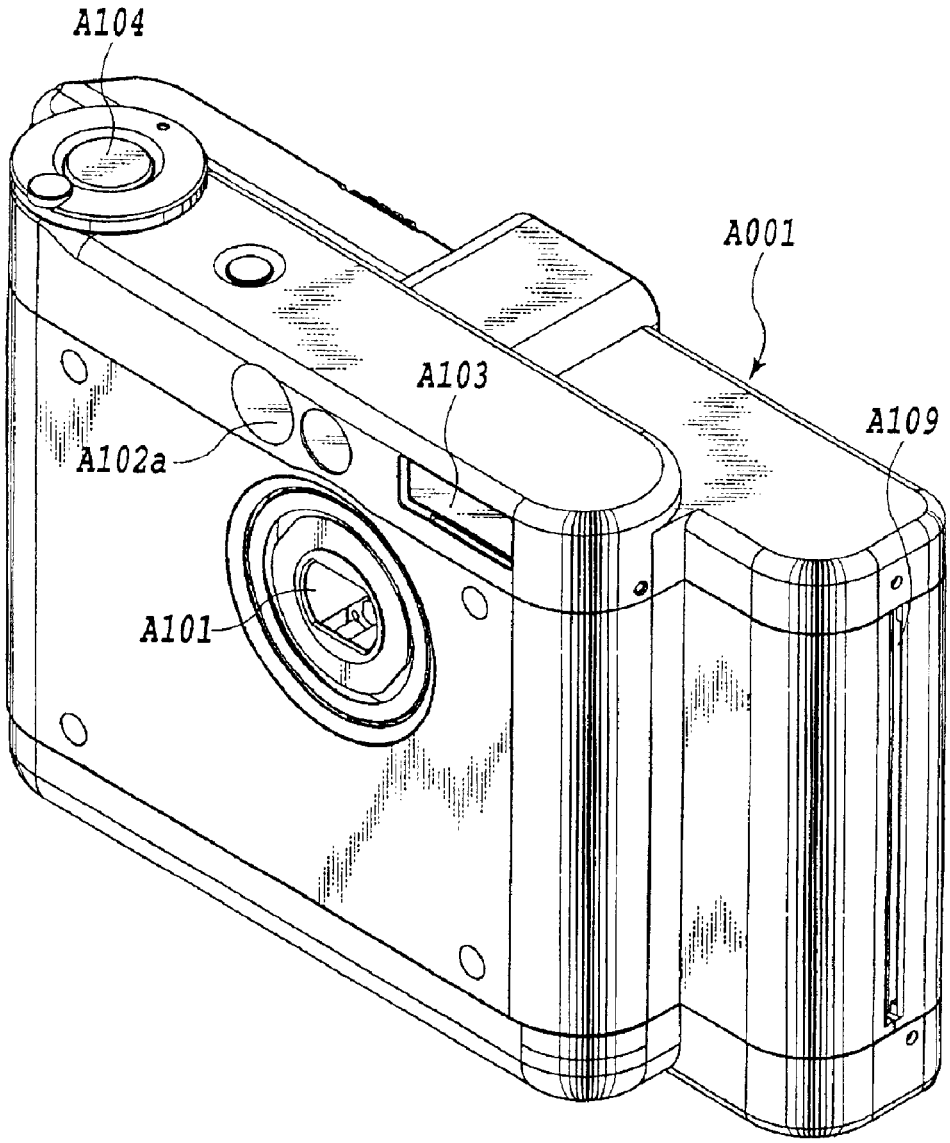
FIG. 2 is a perspective view of the camera in FIG. 1 taken diagonally in front of the same.
Figure 3:
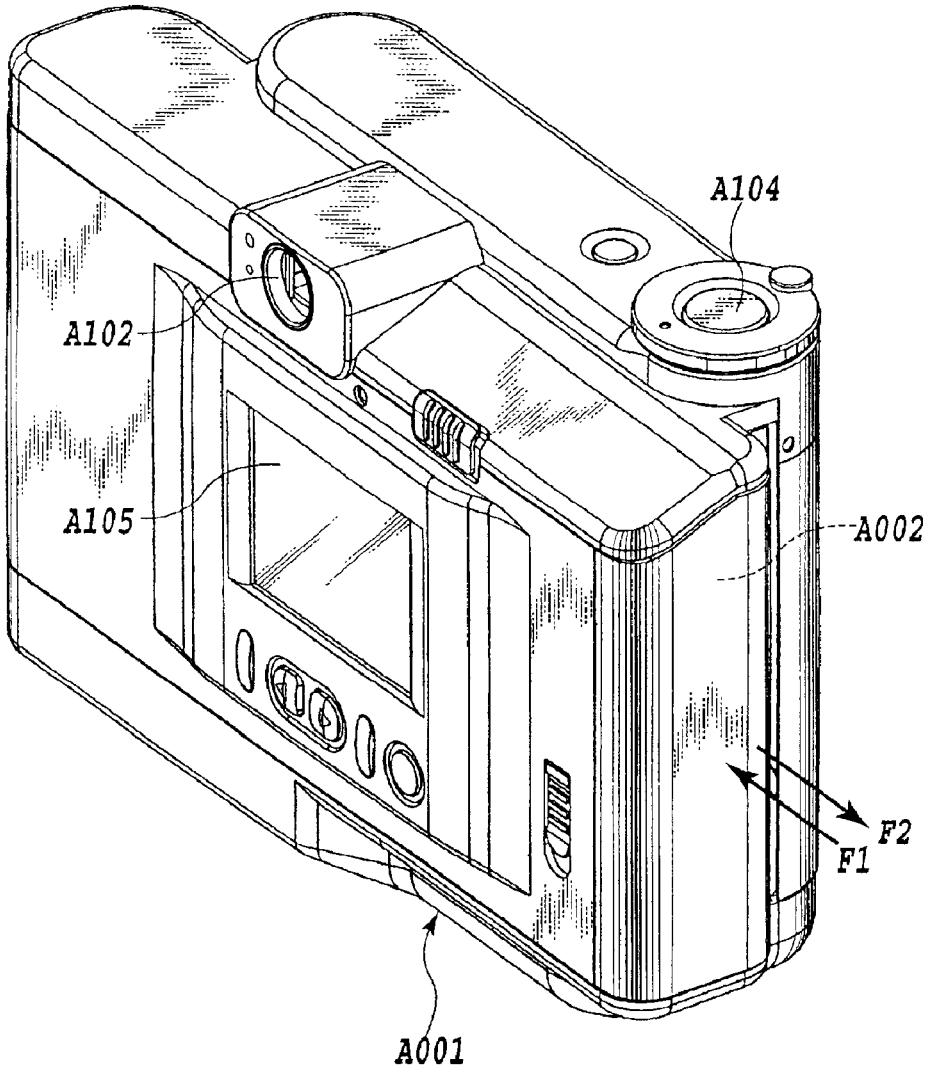
FIG. 3 is a perspective view of the camera in FIG. 1 taken diagonally from behind.
Figure 5:
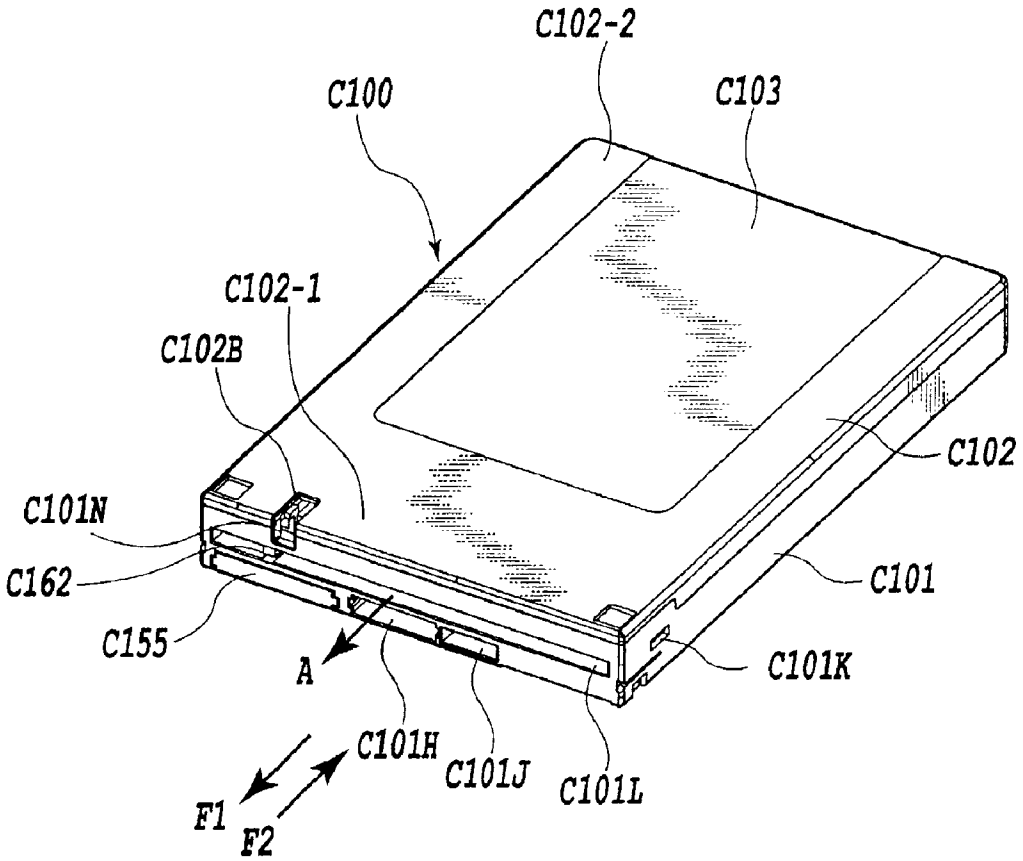
FIG. 5 is a perspective view of a medium pack in FIG. 1 taken on a front side thereof.

The camera section A100, which basically constitutes a conventional digital camera, constitutes the printer-built-in digital camera having an appearance in FIGS. 1 to 3 by being integrally incorporated into the main body A001 together with a printer section B100 described below. In FIGS. 1 to 3, A101 denotes a lens; A102 denotes a viewfinder; A102*a* denotes a window of the viewfinder; A103 denotes a flash; A104 denotes a shutter release button; and A105 denotes a liquid crystal display section (outer display section). The camera section A100, as described below, performs a processing of data photographed by a CCD, a recording of the images to a compact flash memory card (CF card) A107, a display of the images and a transmission of various kinds of data with the printer section B100. A109 denotes a discharge part for discharging a printing medium C104 on which the photographed image is recorded. A108, as shown in FIG. 5, is a battery as a power source for the camera section A100 and the printer section B100.

2: Medium Pack

Figure 6:
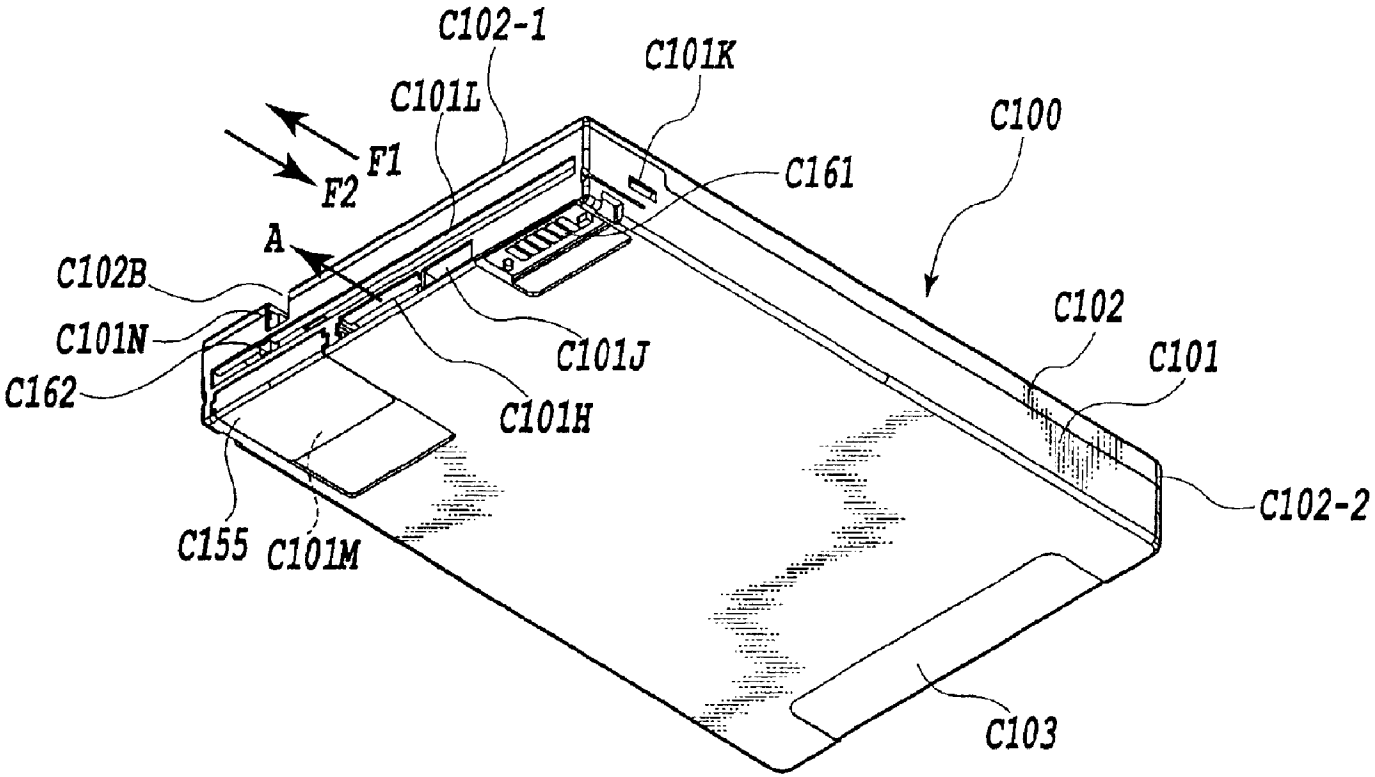
FIG. 6 is a perspective view of the medium pack in FIG. 5 taken on a backside thereof.
Figure 7:
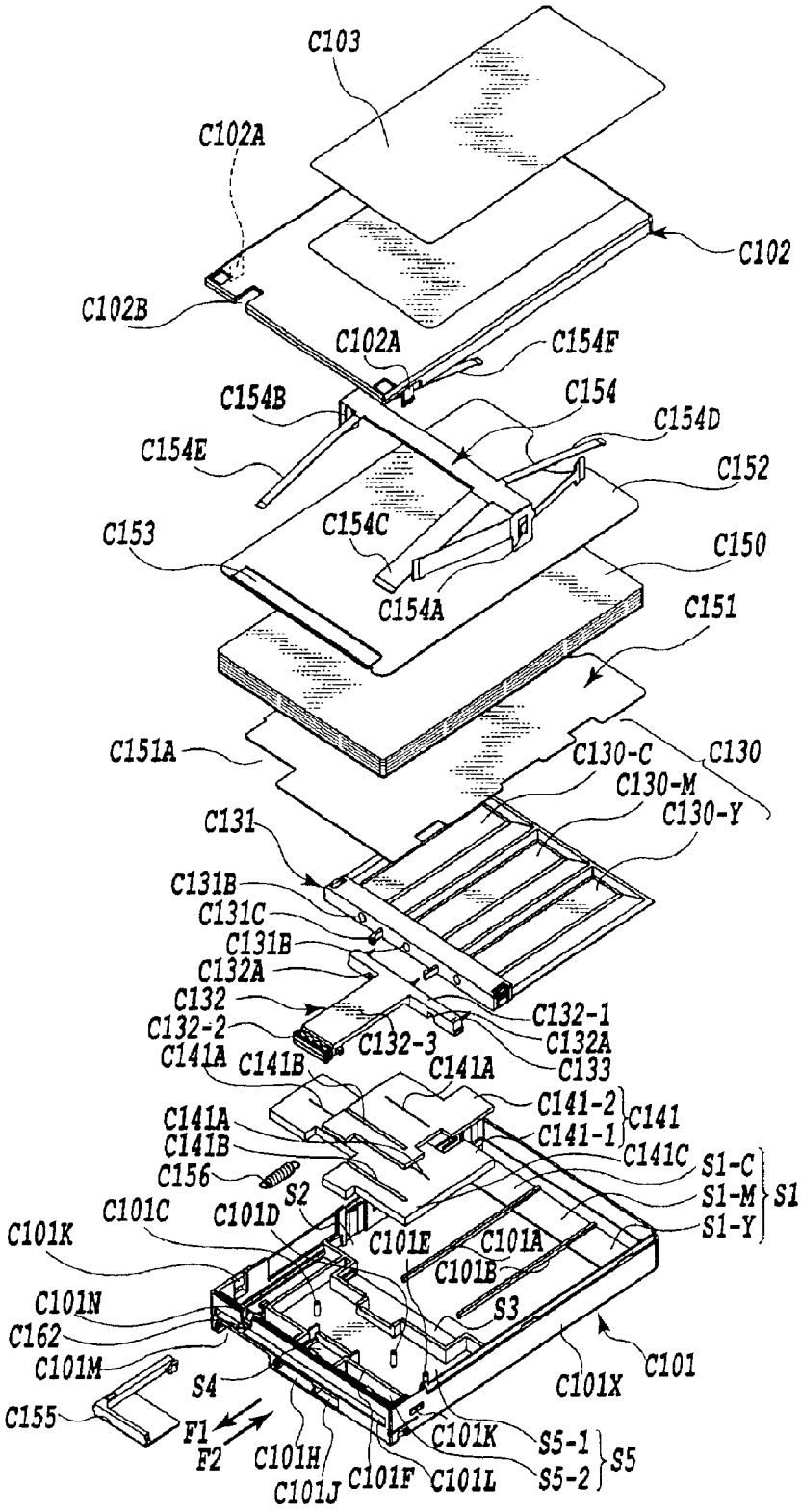
FIG. 7 is an exploded perspective view of the medium pack in FIG. 5.
Figure 8:
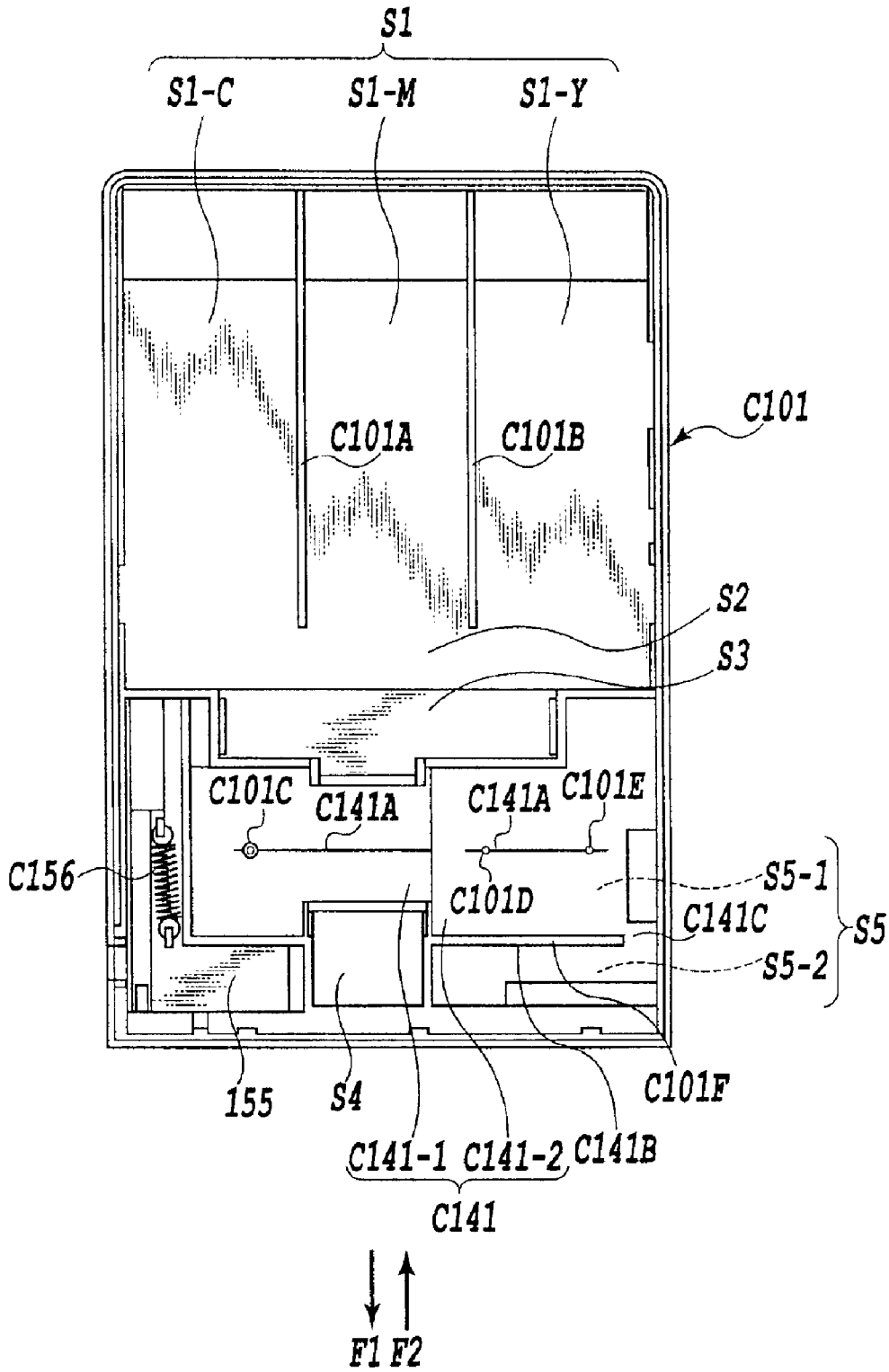
FIG. 8 is a plan view of a pack main body of the medium pack in FIG. 5.

The medium pack C100 can be attached to and detached from the main body A001 of the apparatus. In the present embodiment, the medium pack C100 is attached to the main body A001 as shown in FIG. 1 by being inserted into an inserting portion A002 (see FIG. 3) of the main body A001 in the direction indicated by the arrow F1. The inserting portion A002 is opened when the medium pack C100 is attached and is closed as shown in FIG. 3 when it is pulled out in the direction indicated by the arrow F2. The medium pack C100 is constituted by an ink containing portion, a printing medium containing portion, a waste ink containing portion, and so on provided between a pack main body C101 and a cover C102. FIG. 5 is a perspective view of the medium pack C100 taken from the side of the cover C102 (front side); FIG. 6 is a perspective view of the medium pack C100 taken from the side of the pack main body C101 (back side); FIG. 7 is an exploded perspective view of the medium pack C100; and FIG. 8 is a plan view of the pack main body C101.

The medium pack C100 will now be described under headings 2-1 "Ink Containing Section", 2-2 "Waste ink Containing section", 2-3 "Printing Medium Containing Portion", 2-4 "Positions and Configurations of Openings", 2-5 "Other Configurations", 2-6 "Method of Assembly", 2-7 "Ease of Recycling" and 2-8 "Others".

2-1: Ink Containing Section

Ink pack containing section S1 for containing ink packs C130 are formed in the pack main body C101. In the present embodiment, the ink pack containing section S1 is formed with three ink pack containing portions S1-Y, S1-M, and S1-C by partitioning it with ribs C101A and C101B for containing three ink packs C130-Y, C130-M and C130-C in which inks in yellow (Y), magenta (M) and cyan (C) are separately reserved. The ink packs C130-Y, C130-M and C130-C may be integrally formed, and partitions to be described later are not required in this case. When the ink packs C130-Y, C130-M and C130-C are formed as separate bodies, they are positioned in the ink pack containing portions S1-Y, S1-M and S1-C by the ribs C101A and C101B such that they are not misaligned with each other.

Figure 9A:
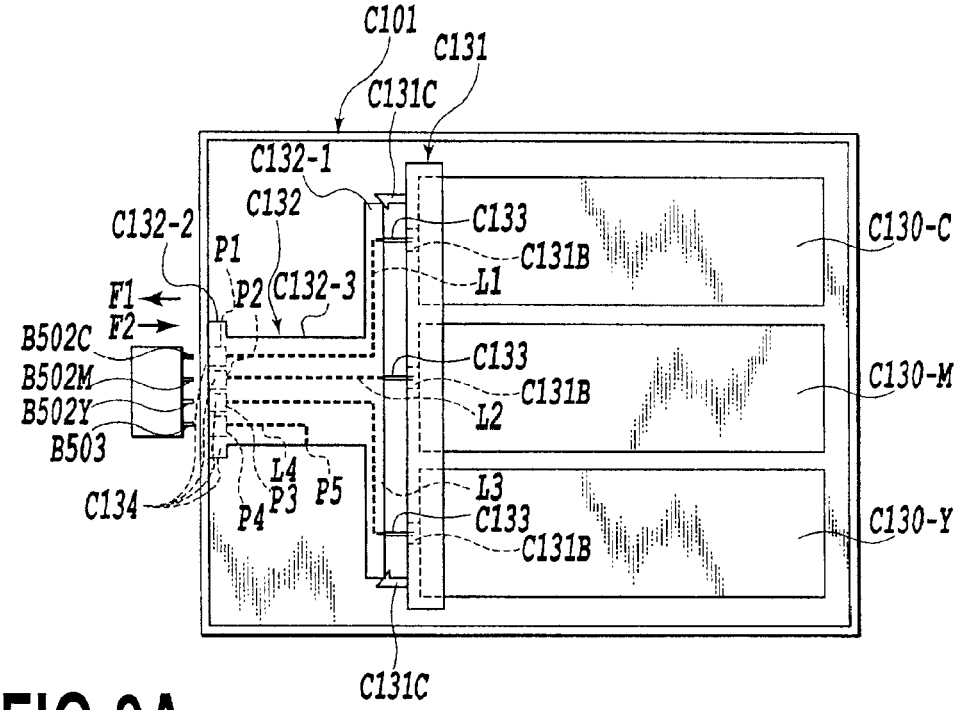
Figure 9B:
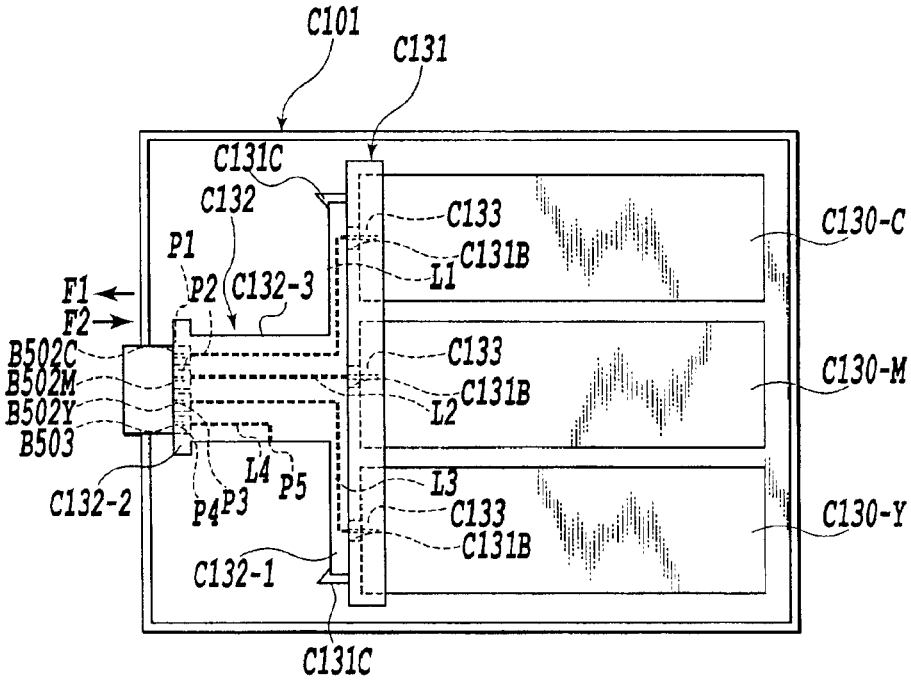
FIG. 9B is a plan view of the major parts for explaining a coupled state of the holder and the joint.
Figure 10A:
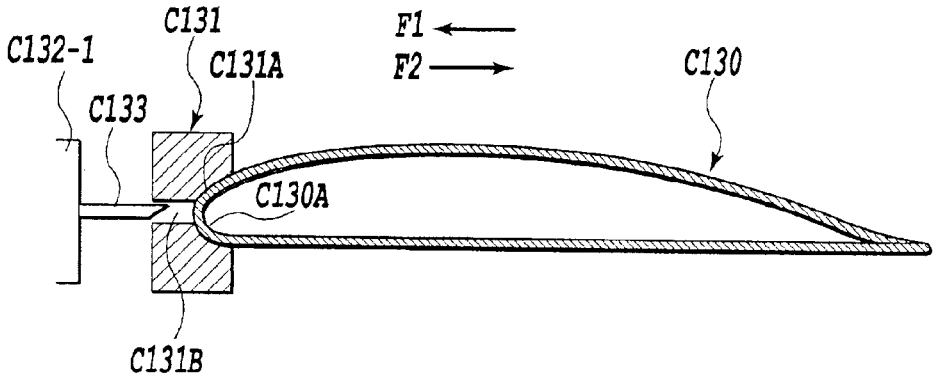
Figure 10B:
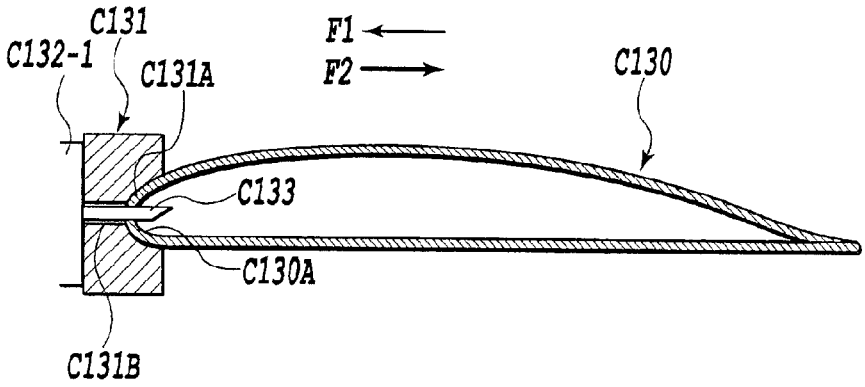
FIG. 10B is a sectional view of the major parts for explaining a connected state of the same.

The ink packs C130 (ink packs C130-Y, C130-M and C130-C) are held by an ink pack holder C131. In the present embodiment, the ink packs C130 are formed like bags using films having a capability of recovering from pin holes in order to seal inks therein, as shown in FIGS. 10A and 10B. As shown in these figures, an outer surface of a folded portion C130A of the same is bonded or welded to a curved surface C131A of the holder 131. The curved surface C131A guides the folded portions C130A of the ink packs C130 such that they are not flattened to maintain them in a curved form. Each of the ink packs C130 is formed like a bag by folding a sheet material at the portion 130A and then by sealing it at three sides thereof through bonding or welding, excepting the folded portions 130A. The holder C131 is formed with openings C131B where the folded portions C130A of the ink packs C130 are exposed on the left side of the holder as shown in FIGS. 10A and 10B. Further, the holder C131 is formed with coupling latches C131C, C131C to allow it to be coupled with an ink pack joint C132 to be described later. Regarding the positions where the coupling latches C131C, C131C are formed, they may be formed in positions in the right and left sides the holder C131 close to the center of the same as shown in FIGS. 7, 10A and 10B, and they may alternatively be formed in positions in the right and left sides of the holder C131 close to the ends of the same as shown in FIGS. 9A and 9B. Thus, the holder C131 holding the ink pack C130 is positioned in a containing section S2 of the pack main body C101 (see FIG. 7).

Denoted C132 is an ink pack joint having a substantially T-shaped planar configuration which is contained in the pack main body C101 such that it can slide in the direction indicated by the arrow F2. Specifically, one end C132-1 of the joint C132 and another end C132-2 of the same are contained in containing sections S3 and S4 of the pack main body C101 such that they can slide in the directions indicated by the arrows F1 and F2, respectively. A containing section S5 for containing a waste ink absorption body to be described later is formed under a central portion C132-3 of the joint C132. Three hollow needles C133 are provided at the end C132-1 in an opposing relationship with the three openings C131B of the holder C131. The needles C133 communicate with ink supply ports P1, P2 and P3 at the end C132-2 through ink passages L1, L2 and L3. A waste ink introduction port P4 formed at the end C132-2 communicates with a waste ink discharge port P5 formed on a side of the central portion C132-3 through an ink passage L4. A rubber plug C134 is fitted in each of the ports P1, P2, P3 and P4 to allow insertion and removal of needles B502C, B502M, B502Y and B503 of the apparatus main body A001 to be described later. When the medium pack C100 is attached to the apparatus main body A001, the needles B502C, B502M, B502Y and B503 enter the pack main body C101 through an opening C101H formed on the pack main body C101. When the needles B502C, B502M, B502Y, and B503 are removed, elastic restoring properties of the rubber plugs C134 automatically close the holes formed by the needles B502C, B502M, B502Y and B503. In the case that the joint C132 is provided with a structure in which a plurality of members located in upper and lower positions in FIG. 7 are assembled with each other, grooves extending along the ink passages L1, L2, L3 and L4 may be formed on the lower member and the upper member may be assembled on the lower member to form the ink passages L1, L2, L3 and L4 inside the joint C132.

Figure 11:
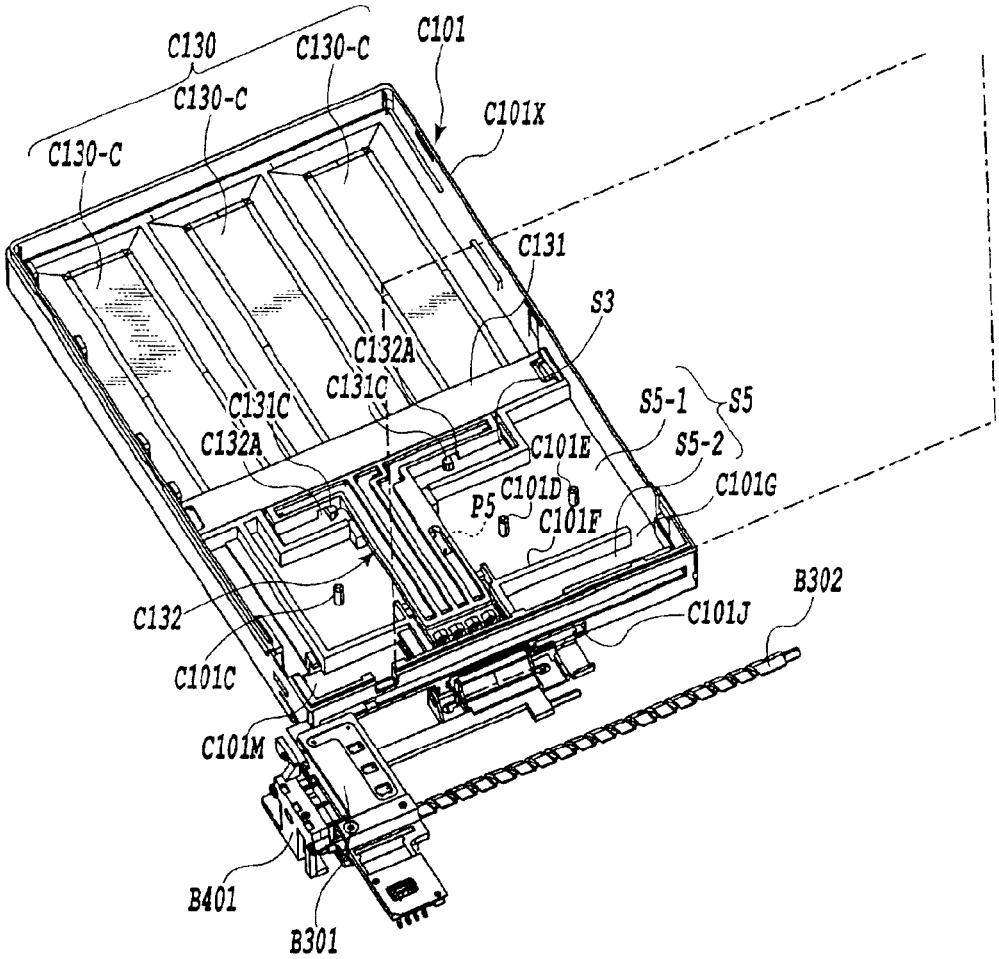
FIG. 11 is a perspective view of major parts for explaining an attached state of the medium pack in FIG. 5.
Figure 12:
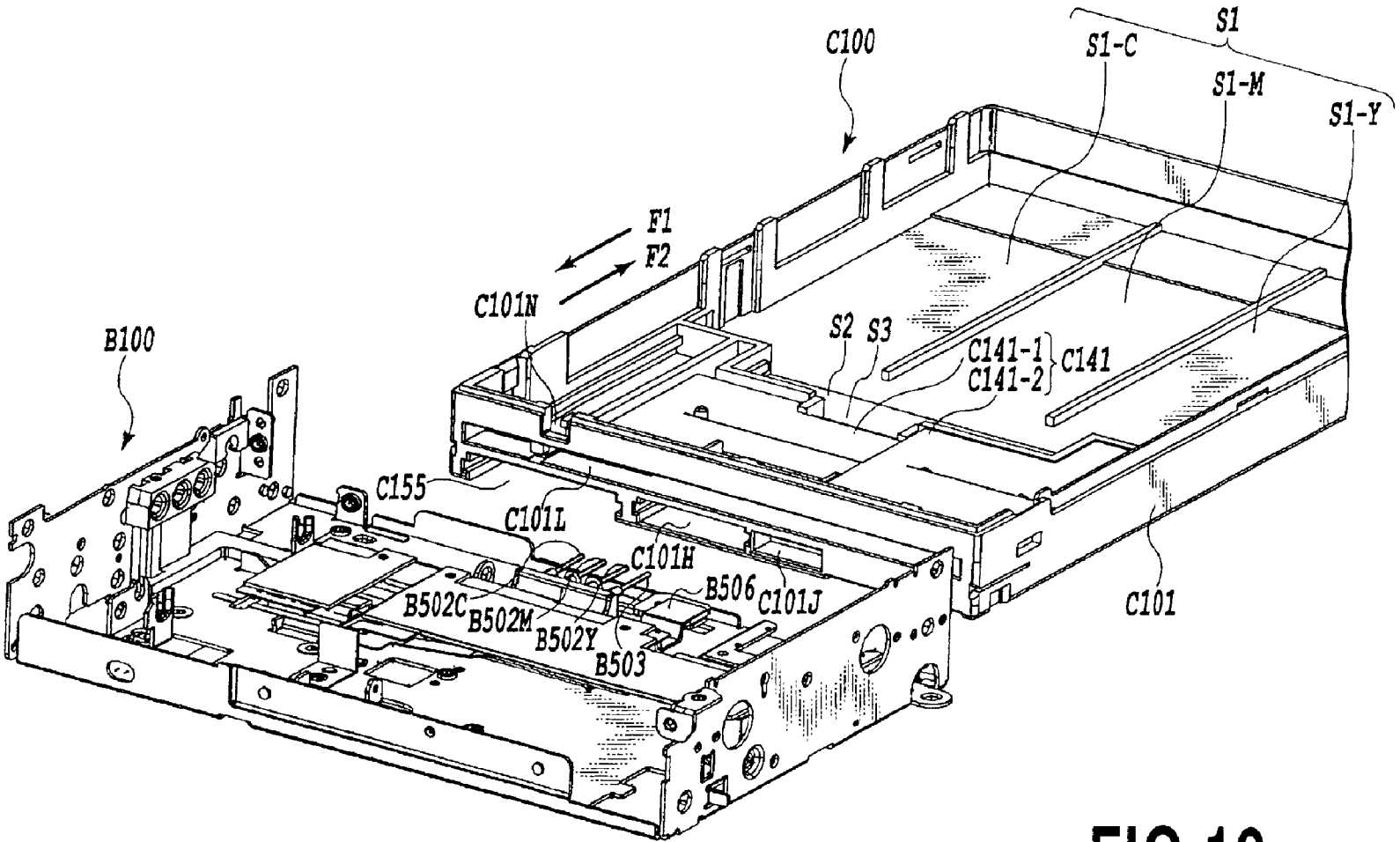
FIG. 12 is a perspective view of major parts for explaining states before and after the medium pack in FIG. 5 is attached.
Figure 13:
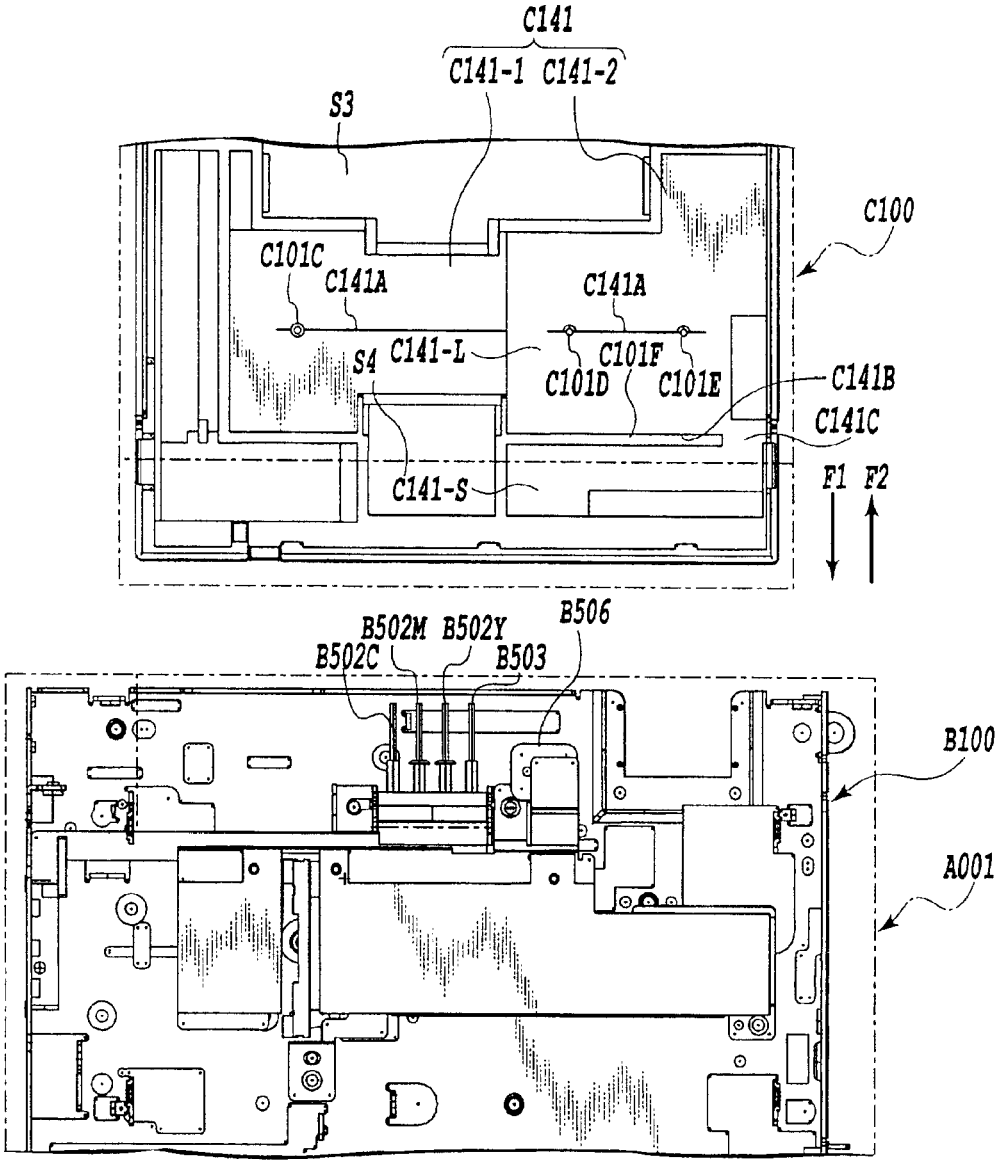
FIG. 13 is a plan view of major parts for explaining states before and after the medium pack in FIG. 5 is attached.
Figure 14:
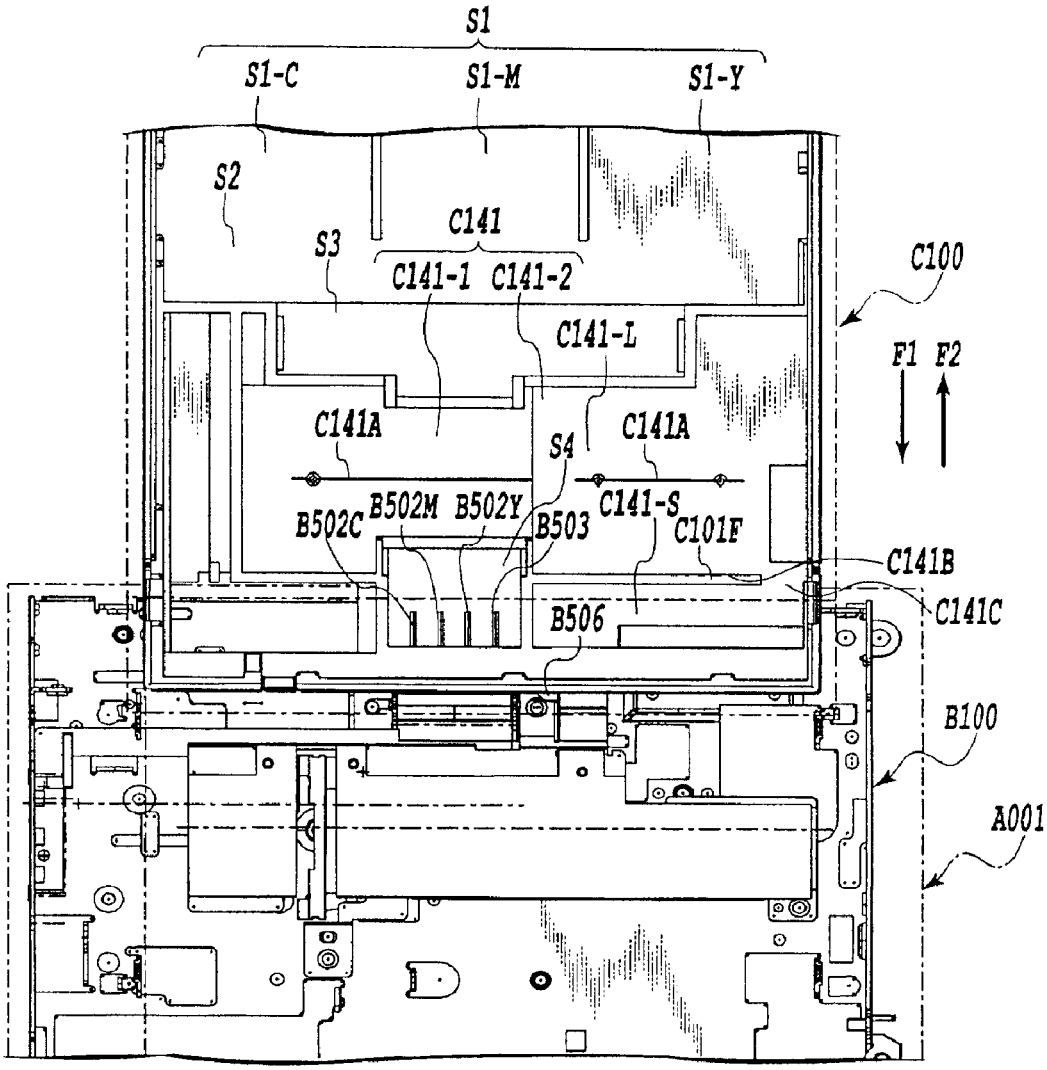
FIG. 14 is a plan view of major parts for explaining a state in which the medium pack in FIG. 5 is attached.

As will be described later, the coupling latches C131C, C131C of the holder C131 engage with the joint C132 when the joint C132 moves in the direction indicated by the arrow F2 to approach the holder C131. When the coupling latches C131C, C131C are formed in positions close to the center of the holder C131 as shown in FIGS. 7 and 11, the latches engage with edges of openings C132A and, when the coupling latches C131C, C131C are formed in positions close to the ends of the holder C131 as shown in FIGS. 9A and 9B, the latches engage with both ends of the joint C132.

When the medium pack C100 with the ink containing section having such a construction described above has not been used or when it has never been attached to the apparatus main body A001, the joint C132 is in an uncoupled state in which it is separated from the holder C131 as shown in FIG. 9A, and the needles C133 on the joint C132 are off the ink packs C130 as shown in FIG. 10A. When the medium pack C100 has not been attached yet as thus described, the ends of the coupling latches C131C, C131C are in contact with the joint C132 to prevent the joint C132 and the holder C131 from being coupled. Therefore, the coupling latches C131C, C131C function as members for interrupting linkage between the joint C132 and ink packs C130 before the medium pack C100 is attached.

When such an unused medium pack C100 is attached to the apparatus main body A001 in the direction indicated by the arrow F1, the needles B502C, B502M, B502Y and B503 on the apparatus main body A001 cause a relative movement of the joint C132 in the direction indicated by the arrow F2 while being stuck into the rubber plugs C134 in the ports P1, P2, P3 and P4, which causes the needles C133 on the joint C132 to be stuck into the folded portions C130A of the ink packs C130. When the medium pack C100 is completely attached as shown in FIG. 9B, the joint C132 is coupled with the holder C131 by the coupling latches C131C; the needles B502C, B502M, B502Y and B503 on the apparatus main body A001 penetrate through the rubber plugs C134 in the ports P1, P2, P3 and P4 to be in communication with the ink passages L1, L2, L3 and L4; and the needles C133 on the joint C132 are put in communication with the interior of the ink packs C130 as shown in FIG. 10B. After the medium pack C100 is thus attached, the coupling latches C131C, C131C function as engaging members for engaging the joint C132 and ink packs C130 to prevent them from being decoupled.

As a result, the ink packs C130-Y, C130M and C130-C are connected to ink supply passages to be described later in the apparatus main body A001 through the ink passages L1, L2 and L3, which allows inks to be supplied. Since the ink packs are constituted by films having a capability of recovering from pin holes, no ink leaks from the regions pierced by the needles. The waste ink discharge port P5 is connected to a waste ink discharge passage to be described later in the apparatus main body A001 through the ink passage L4 to discharge waste ink discharged through the waste ink discharge passage on to waste ink absorption bodies C141 to be described later. The waste ink discharged through the waste ink discharge passage is a relatively large amount of waste ink that is discharged into a cap as a result of a suction recovery operation or a preliminary ejecting operation of a recording head as will be described later, the waste ink being discharged using a pump.

When the medium pack C100 thus attached is removed from the apparatus main body A001 in the direction indicated by the arrow F2, the needles B502C, B502M, B502Y and B503 on the apparatus main body A001 come out the rubber plugs C134 in the ports P1, P2, P3 and P4. At this time, the rubber plugs C134 automatically close the ports P1, P2, P3 and P4 because of their elastic restoring properties. The coupling latches C131C keep the holder C131 and joint C132 in the coupled state, and the needles C133 on the joint C132 remain inserted in the ink packs C130. That is, the coupling latches C131C keep the holder C131 and joint C132 in the coupled state after they are once coupled.

Thus, the needles C133 on the joint C132 are inserted into the ink packs C130 only when the medium pack C100 is first attached to the apparatus main body A001 and are thereafter kept in the inserted state. In the case of an unused medium pack C100 which has never been attached to the apparatus main body A001, the needles C133 on the joint C132 are not inserted in the ink pack C130, and the ink packs C130 completely seal inks only by themselves. This is advantageous in view of the distribution of the medium pack C100 and the manufacture of the ink packs C130.

Specifically, when an unused medium pack C100 is distributed, since the needles C133 are not inserted in the ink packs C130, inks can be reliably sealed by the ink packs C130 alone without being adversely affected by the ambient temperature such as the temperature during distribution. Further, since no ink enters the ink passages L1, L2 and L3 when the medium pack C100 is thus distributed, it is possible to thoroughly eliminate a problem that can occur when the ink passages L1, L2 and L3 are formed of a synthetic resin material, i.e., the problem of evaporation of ink components through the synthetic resin material. Further, since inks can be sealed by the ink packs C130 alone, the ink packs C130 can be manufactured easily at a low cost by charging inks in the material of the ink packs C130 while forming it into bags. Since the needles C133 are stuck in the longitudinal direction of the ink packs C130 at the folded portions C130A of the ink packs C130 secured to the holder C131, the needles C133 can be sufficiently inserted into the ink packs C130. In this connection, when the needles C133 are stuck into the ink packs C130 at the top surface or bottom surface thereof in FIGS. 10A and 10B from above and below in the same figures, it is difficult to maintain a sufficient amount of insertion of the needles C133 because the thickness of the ink packs C130 is small in the vertical direction.

Referring to the material to form the ink packs C130, a material having a multi-layer structure is employed such that it tightly contacts the circumferential surfaces of the needles C133 when the needles C133 are inserted as shown in FIG. 10B to achieve a sufficient sealing effect. A specific example of such a material is a structure having four layers constituted by specialty nylon of 27 $\mu$m, PVDC (polyvinylidene chloride) of 3 $\mu$m, specialty polyethylene of 50 $\mu$m and normal polyethylene of 20 $\mu$m. Another specific example is a structure having four layers constituted by specialty nylon of 27 $\mu$m, aluminum foil of 7 $\mu$m, specialty polyethylene of 50 $\mu$m and normal polyethylene of 20 $\mu$m. Still another example is a material having the same quality as that of a product named "Cartridge Pack" (trade name) sold by Daiwa Gravure K. K. into which a dispenser can be directly inserted. While the aluminum foil layer is used to prevent evaporation of ink that is contained, the invention is not limited to aluminum foil layers, and various types of layers having the effect of preventing ink evaporation including a layer having aluminum deposited thereon and a silica-coated layer may be used as layers having such characteristics.

2-2: Waste Ink Containing Section

Waste ink absorption bodies C141 are contained in the containing section S5. In the present embodiment, two upper and lower waste ink absorption bodies C141-1 and C141-2 are contained in an overlapping relationship. The waste ink absorption bodies C141 (absorption bodies C141-1 and C141-2) are formed with slits C141A in which positioning projections C101C, C101D and C101E formed on the pack main body C101 are fitted. The absorption bodies C141 are also formed with grooves C141B in which a wall C101F formed on the pack main body C101 is fitted. A gap C101G is formed as shown in FIG. 11 between a circumferential wall C101X of the pack main body C101 and the wall C101F, and the containing section S5 is divided into a large containing section S5-1 and a small containing section S5-2 with the gap C101G interposed therebetween. Therefore, the absorption bodies C141 are divided into a first absorbing region C141-L which is located on the side of the large containing section S5-1 and which absorbs a relatively great amount of waste ink and a second absorbing region C141-S which is located on the side of the small containing section S5-2 and which absorbs a relatively small amount of waste ink, a narrow portion C141C associated with the gap C101G being interposed between them.

The waste ink discharge port P5 faces the large containing section S5-1 as shown in FIG. 11. Therefore, a relatively great amount of waste ink discharged from the waste ink discharge port P5 is reliably absorbed and held by the first absorbing regions C141-L of the absorption bodies C141. When the holder C131 and joint C132 are coupled by the coupling latches C131C, the waste ink discharge port P5 is positioned substantially in the middle of the large containing section S5-1 or substantially in the middle of the first absorbing regions C141-L of the absorption bodies C141, as shown in FIG. 11. As a result, the first absorbing regions C141-L efficiently and reliably absorb and hold a relatively great amount of waste ink.

Figure 15:
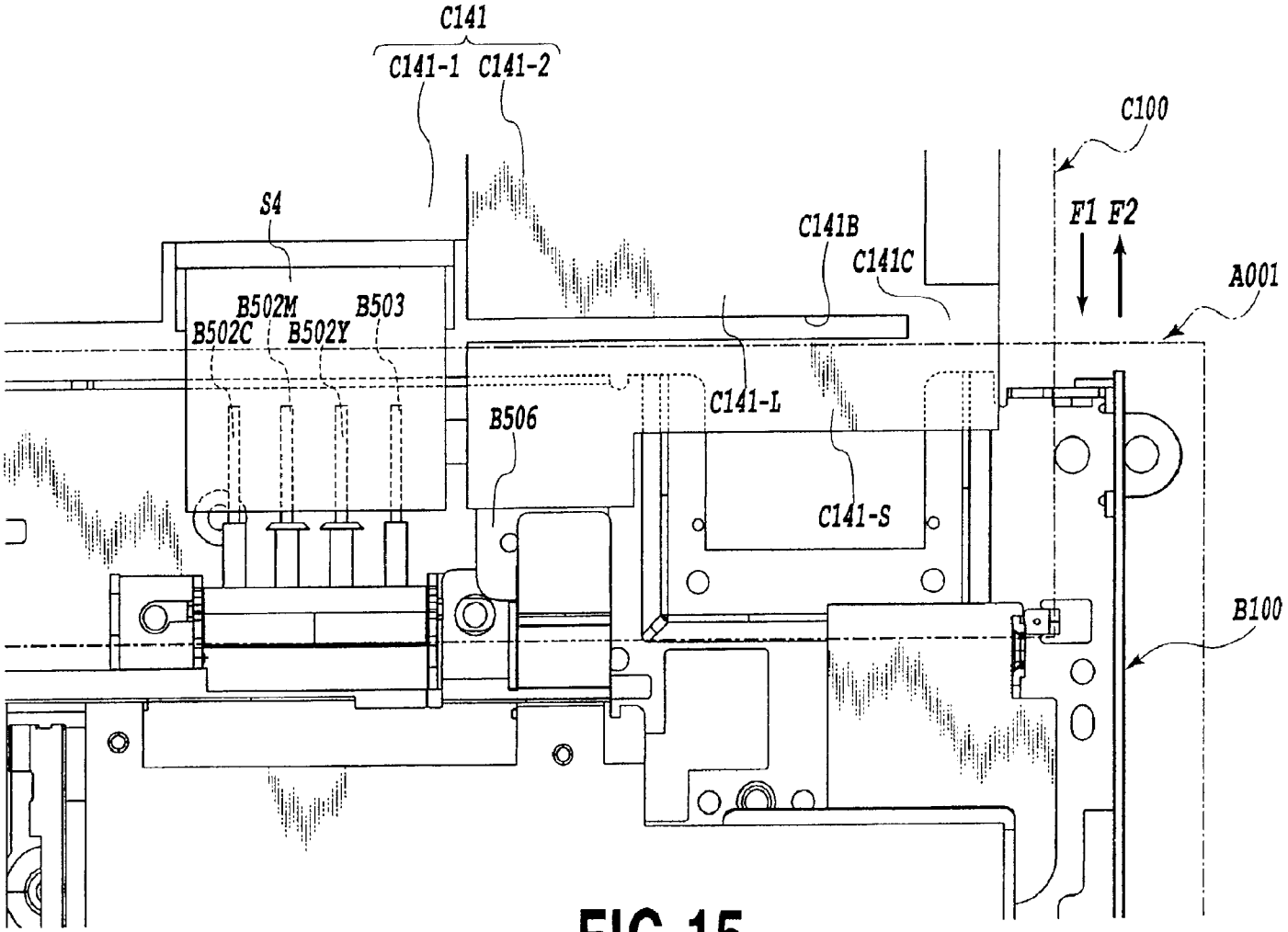
FIG. 15 is a plan view of major parts for explaining a discharge passage for waste ink formed when the medium pack in FIG. 5 is attached.

The small containing section S5-2 communicates with the opening C101H formed on the pack main body C101. When the medium pack C100 is inserted in the apparatus main body A001 in the direction indicated by the arrow F1, an ink absorption body B506 at the apparatus main body A001 to be described later enters the small containing section S5-2 through the opening C101H to be inserted into the second absorbing regions C141-S of the absorption bodies C141. FIGS. 12 to 15 are illustrations for primarily explaining the positional relationship between the ink absorption body B506 and the absorption bodies C141. The joint C132 in the pack main body C101 is omitted in those figures, and FIG. 15 further omits the pack main body C101. When the medium pack C100 is inserted in the apparatus main body A001, the ink absorption body B506 is inserted in the second absorbing regions C141-S of the absorption bodies C141 as shown in FIG. 15.

As will be detailed later, ink ejected from the recording head to positions out of a printing medium C150 are introduced to the ink absorption body B506 of the apparatus main body A001 due to capillarity. The amount of the ink ejected to positions out of the printing medium C150 is relatively small, and the relatively small amount of ink is introduced to the ink absorption body B506 as waste ink. The waste ink introduced to the ink absorption body B506 is absorbed and held by the second absorbing regions C141-S due to capillarity when the ink absorption body B506 is inserted in the second absorbing regions C141-S of the absorption bodies C141 at the medium pack C100. Thus, the relatively small amount of waste ink introduced to the ink absorption body B506 is absorbed and held by the second absorbing regions C141-S of the absorption bodies C141.

The ink absorption body B506 is formed of a relatively hard porous material, and the absorption bodies C141 are formed of a relatively soft porous material. Therefore, when they are put in contact, only the contacting parts of the absorption bodies C141 at the medium pack C100 as a consumable supply are greatly deformed, and there is small deterioration of the ink absorption body B506 at the apparatus main body A001. As a result, when the medium pack C100 as a consumable supply is repeatedly attached to the apparatus main body A001 many times, a good state of connection can be always maintained between the ink absorption body B506 and the absorption bodies C141. Further, such compression and deformation of the contacting parts of the absorption bodies C141 results in a proper capillary force which allows ink to come out the ink absorption body B506 in a favorable manner.

It is advantageous to divide the absorption bodies C141 into the first absorbing region C141-L and the second absorbing region C141-S with the wall C141B in preventing waste ink from leaking out from an opening C101J. Specifically, when waste ink in the entire absorption bodies C141 starts concentrating and moving toward the opening C101J, the waste ink is hindered by the wall C101F from moving and is forced to detour the wall C101F. By causing the waste ink to thus detour the wall C101F, it is possible to avoid a concentrative movement of the waste ink in the entire absorption bodies C141 toward the opening C101J, thereby preventing the waste ink from leaking out from the opening C101J. In the present embodiment, since a relatively great amount of waste ink is absorbed and held by the first absorbing region C141-L, it is possible to effectively prevent the concentrative movement of the relatively great amount of waste ink toward the opening C101J. Further, since the second absorbing region C141-S absorbs and holds only a small amount of waste ink introduced from the ink absorption body B506 at the apparatus main body A001 by a capillary force, the waste ink can be prevented from leaking out in the vicinity of the opening C101J to reliably hold the same.

2-3: Printing Medium Containing Portion

As shown in FIG. 7, a medium slide sheet C151 for covering the containing sections S1, S2, S3, S4 and S5 from above is fitted and positioned in the pack main body C101. Printing media C150 are stored on the slide sheet C151. Specifically, a plurality of (e.g., 20) printing media C150 in the form of sheets are placed on the slide sheet C151, and a medium press sheet C152 is further placed on the same. A relatively hard medium press plate C153 is attached to the press sheet C152. A medium positioning spring C154 is elastically interposed between the press sheet C152 and the cover C102. The spring C154 is attached to the pack main body C101 by elastically engaging both ends C154A and C154B thereof with the circumferential wall C101X of the pack main body C101 in predetermined positions in the plane of the wall. Legs C154C, C154D, C154E and C154F of the spring C154 urge the press sheet C152 downward as viewed in FIG. 7. A claw C102A which can be elastically engaged with a hole C101K on the circumferential wall C101X of the pack main body C101 is formed at one end C102-1 of the cover C102. Another end C102-2 of the cover C102 is attached to the pack main body C101 with a seal C103 as shown in FIGS. 5 and 6.

On the circumferential wall C101X of the pack main body C101, there is formed an opening C101L for transporting the printing media C150 stored on the slide sheet C151 one by one in the direction indicated by the arrow A (see FIG. 5). The printing medium C150 is ejected by a pick-up roller B201 and a press plate 202 at the apparatus main body A001 as will be described later. When the medium pack C100 is attached to the apparatus main body A001, the pick-up roller B201 can enter the pack main body C101 through an opening C101M formed on the pack main body C101 to be pressed against the lowermost one of the printing media C150 piled up on the slide sheet C151 through a cut-out C151A on the slide sheet C151. As shown in FIGS. 5, 6 and 7, a shutter C155 is mounted at the opening C101M such that it can be opened and closed in the directions indicated by the arrows F1 and F2, and the shutter C155 is always urged by a spring C156 in the closing direction indicated by the arrow F1. The shutter C155 normally closes the opening C101M as shown in FIG. 6 and, when the medium pack C100 is attached to the apparatus main body A001, it is opened in the direction indicated by the arrow F2 to allow the pick-up roller B201 to enter. When the medium pack C100 is attached to the apparatus main body A001, the press plate B202 can enter the pack main body C101 through cut-outs C101N and C102B formed on the pack main body C101 and the cover C102 to be pressed against the press plate C153 of the press sheet C152.

Thus, by attaching the medium pack C100 to the apparatus main body A001, the printing media C150 in the medium pack C100 are set in a standby position in which they can be sandwiched between the pick-up roller B201 and the press plate 202. When an ASF trigger to be described later is released in this state, the printing media are sandwiched by those members, and the pick-up roller B201 rotates in a predetermined transport direction to transport the lowermost one of the printing media C150 on the slide sheet C151 in the direction indicated by the arrow A through the opening C101L. At this time, since the lowermost printing medium C150 slides on the slide sheet C151 to be transported, the printing medium C150 can be smoothly transported by making the top surface of the slide sheet C151 smoother for the printing medium C150. The slide sheet C151 preferably has properties that allow the printing medium C150 to be transported favorably as described above. Specifically, this may be achieved by forming the sheet using a material having a low friction coefficient or by processing the sheet such that it has a low friction coefficient on a surface thereof in contact with the printing medium C150. Referring to examples of such processing, measures such as a fluorinating process or an embossing process on the sheet may be taken. In order to improve transportability, it is advantageous to take a measure against static electricity that can occur between the slide sheet C151 and the printing medium C150.

Since the opening constituted by the cut-outs C101N and C102B and the opening C101M are formed in positions in an opposing relationship with each other, the printing media C150 can be sandwiched between the pick-up roller B201 and the press plate B202. By sandwiching the printing media C150 between the pick-up roller B201 and the press plate 202, an optimum transporting force can be imparted from the pick-up roller B201 to the printing media C150 to transport the printing media C150 with reliability. In the present embodiment, since the press plate B202 is smaller than the pick-up roller B201 as will be described later, the opening constituted by the cut-outs C101N and C102B is formed smaller than the opening C101M. By forming the opening constituted by the cut-outs C101N and C102B with such a small size, the rigidity of the medium pack C100 is improved accordingly. In the present embodiment, since the shutter C155 is provided at the relatively large opening C101M to always close the opening C101M when the medium pack C100 is not attached to the apparatus main body A001, it is possible to prevent foreign substances from entering through the relatively large opening C101M.

Since the spring C154 urges the printing media C150 through the press sheet C152, all parts of the lowermost one of the printing media C150 are properly pressed against the slide sheet C151. Since the press plate B202 is pressed against the relatively hard press plate C153, the forward ends of the printing media C150 located close to the opening C101L are pressed relatively stronger to improve the reliability of the operation of transporting the printing medium C150. The leg C154C of the spring C154 that is formed in a relatively large size gives a relatively stronger press on a part of the press sheet C152 opposite to the part pressed by the press plate 202 with its relatively great urging force. As a result, the forward ends of the printing media C150 located close to the opening C101L are more uniformly pressed to perform the operation of transporting the printing media C150 with higher reliability. Thus, the printing media C150 are sandwiched between the slide sheet C151 and the press sheet C152 and are transported one by one starting with the lowermost one.

Since the slide sheet C151 covers the containing sections S1, S2, S3, S4 and S5 from above in the medium pack C100, the risk of contact between ink and the printing media C150 is avoided. In particular, by covering the containing section S5, contact between any waste ink in the same and the printing media C150 is avoided. Since waste ink which has leaked out from the containing section S5 must flow by way of the outer periphery of the slide sheet C151 to contact the printing media C150, any contact between the waste ink and the printing media C150 is consequently avoided. Volatile components of waste ink generated at the containing section S5 exhaust from the outer periphery of the slide sheet C151 through the mating surface between the pack main body C101 and the cover C102, for example. Thus, the slide sheet C151 not only serves the function of maintaining slidability of the printing media C150 but also functions as a cover for the waste ink containing section S5.

2-4: Positions and Configurations of Openings

Since the medium pack C100 is formed with the two openings C101H and C101J, waste ink from two waste ink passages in the apparatus main body A001 can be efficiently collected into the medium pack C100 as described above. Specifically, a relatively large amount of waste ink discharged as a result of a suction recovery process and a preliminary ejecting process of the recording head is discharged by a pump in the apparatus main body A001 to the first absorbing regions C141-L of the absorption bodies C141 having a relatively large capacity through the needles B502C, B502M, B502Y and B503 and the joint C132 extending into the opening C101H, the waste ink being reliably absorbed and held by the first absorbing regions C141-L. A relatively small amount of waste ink ejected to positions out of the printing medium C150 is absorbed and held by the second absorbing regions C141-S of the absorption bodies C141 having a relatively small capacity through the absorption body B506 extending into the opening C101J due to capillarity.

Since the openings C101H and C101J are formed on the forward end of the medium pack C100, the two waste ink passages in the apparatus main body A001 are connected to the medium pack C100 only by inserting the medium pack C100 into the apparatus main body A001 in the direction indicated by the arrow F1.

The opening C101M into which the pick-up roller B201 enters and the opening C101J for collecting waste ink are formed in positions away from each other with the opening C101H interposed between them. This makes it possible to prevent waste ink from flowing from the opening C101J to the opening C101M, thereby preventing the waste ink from smearing the printing media C150 located in the vicinity of the opening C101M.

Since the joint C132 located inside the opening C101H is formed with the ink supply ports P1, P2 and P3 and the waste ink introduction port P4 and, in addition, the ink passages L1, L2, L3 and L4 in communication with them, each of the four ink passages L1, L2, L3 and L4 are reliably connected to the apparatus main body A001 with the single joint C132. Inside the opening C101H, the ports P1, P2, P3 and P4 are arranged in this order in the direction of departing from the opening C101M. That is, the waste ink introduction port P4 is further from the opening C101M than the ink supply ports P1, P2 and P3 are. Therefore, in the event that waste ink should be deposited in the waste ink introduction port P4, it is possible to prevent the waste ink from flowing up to the opening C101M, thereby preventing the waste ink from smearing the printing media C150 located in the vicinity of the opening C101M.

2-5: Other Configurations

The medium pack C100 is equipped with an EEPROM to be described later, for storing identification data such as the types and remaining quantities of the ink contained in the medium pack C100 and the printing media C150. In the present embodiment, the EEPROM is provided in the pack main body C101 that is located at the bottom of the containing section S5-2. A connector C161 for the EEPROM is provided on the bottom of the pack main body C101 in the vicinity of the opening C101J for collecting waste ink, as shown in FIG. 6. When the medium pack C101 is attached to the apparatus main body A001, the connector C161 is connected to a connector on the apparatus main body A001 which is not shown.

The connector C161 can be used to detect leakage of waste ink because it is located in the vicinity of the opening C101J for collecting waste ink. Specifically, in the event that waste ink which has leaked out from the opening C101J should flow up to the position of the connector C161 to cause a connection failure between the connector C161 and the connector at the apparatus main body A001, the leakage of waste ink is detected by detecting the connection failure. For example, it is possible to detect a connection failure because of the presence of waste ink between contacts of the connector C161 and the connector at the apparatus main body A001, an electrical short-circuit caused by waste ink deposited between a plurality of contacts of the connector C161 or an electrical short-circuit caused by waste ink deposited between a plurality of contacts of the connector at the apparatus main body A001, and the leakage of waste ink can be detected based on the result of the detection.

At the opening C101L for transporting the printing medium, there may be provided a gate portion C162 which disallows two or more printing media C150 to pass simultaneously and allows them to pass one by one. The gate portion C162 limits the width of the opening C101 to a size corresponding to the thickness of one printing medium C150. Such a gate portion C162 may be provided such that it covers the entire opening C101L in the longitudinal direction thereof or such that it covers part(s) of the opening, e.g., a central part in the longitudinal direction thereof or parts on both sides thereof. In the present embodiment, since the pack main body C101 having the opening C101L is obtained by injection-molding a resin material, it is strongly desired to limit the width of the opening C101L accurately while taking into account a strain of the resin material, etc.

Figure 16A:
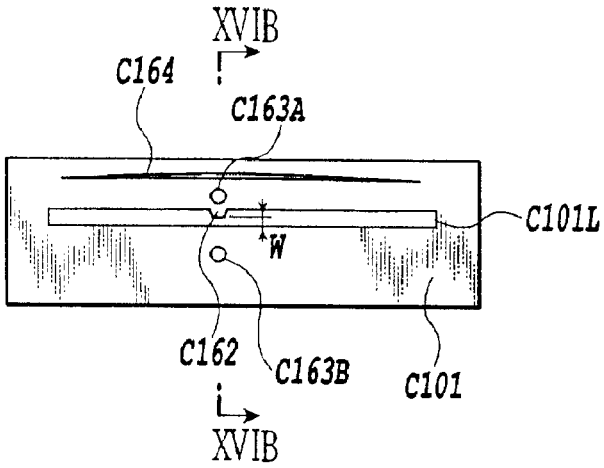
FIGS. 16A and 16B illustrate a forward end section of the medium pack when the medium pack is attached to a printer main body.
Figure 16B:
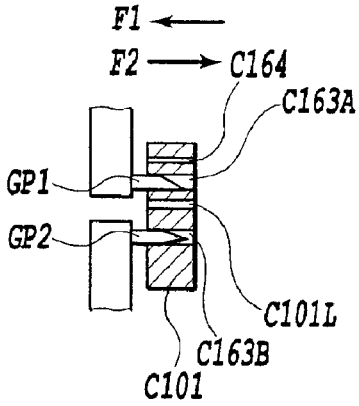
Figure 17A:
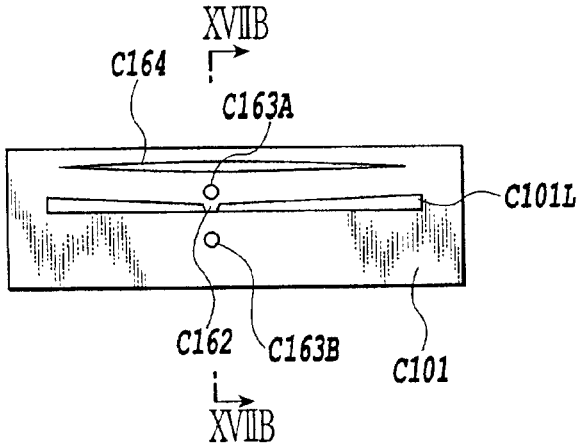
FIGS. 17A and 17B illustrate the forward end section of the medium pack when the medium pack is not attached to the printer main body.
Figure 17B:
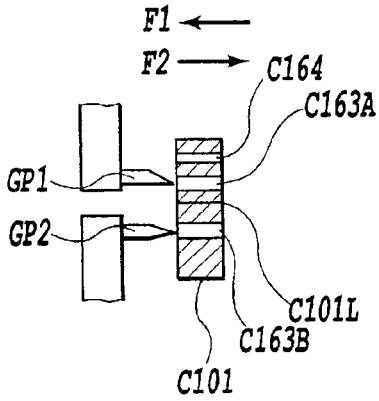

FIGS. 16A and 16B and FIGS. 17A and 17B illustrate an example of a configuration for accurately limiting the width of the opening C101L of the pack main body C101 that is obtained by injection-molding a resin material as thus described. Those figures schematically show only the forward end section of the pack main body C101. FIGS. 16A and 16B illustrate the forward end section when the medium pack C100 is attached to the apparatus main body A001, while FIGS. 17A and 17B illustrate the forward end section when the medium pack C100 is not attached to the apparatus main body A001.

In those figures, denoted C162 is a gate portion which is formed integrally with an upper edge part of the opening C101L in the middle thereof and which limits the width W of the opening C101L to a size to allow only one printing medium C150 to pass. In the present embodiment, the gate portion C162 is formed with a slight leftward shift from the center of the opening C101L such that it is located close to a transporting datum of the printing medium which is formed on the left-hand side of FIG. 16A, taking into account of the use of various sizes of printing media. Guide holes C163A and C163B and a slit C164 are formed on the pack main body C101. When the medium pack C100 is attached to the apparatus main body A001 in the direction indicated by the arrow F1, guide pins GP1 and GP2 located at the apparatus main body A001 enter the guide holes C163A and C163B in a relative manner, as shown in FIG. 16B. Therefore, the interval between the guide holes C163A and C163B is forcibly equalized to the interval between the guide pins GP1 and GP2 with the pack main body C100 deformed elastically. Consequently, the gate portion C162 accurately limits the width W of the opening C101L to a size to allow one printing-medium C150 to pass. The slit C164 facilitates deformation of the pack main body C100 and absorbs the amount of deformation. At least the part of the pack main body C100 where the opening C101L is formed may be a panel obtained by injection-molding a resin material.

In this example, the gate portion C162 closes the opening C101L as shown in FIGS. 17A and 17B to disallow a printing medium C150 to pass when the medium pack C100 is not attached to the apparatus main body A001.

Thus, the gate portion C162 in this example not only has a gate function to limit the width of the opening C101L to a size to allow one printing medium C150 to pass but also functions as a stopper for preventing the printing media C150 from coming out the medium pack C100 accidentally. The latter stopper function may be provided by a gate portion which is separate from the gate portion C162. In this case, the gate portion may close the opening C101L when the medium pack C100 is not attached to the apparatus main body A001 and may expand the width of the opening C101L to at least a size to allow one printing medium C150 to pass by being displaced by guide pins at the apparatus main body A001 when the medium pack C100 is attached to the apparatus main body A001.

While projections as guide pins are provided on the apparatus main body and guide holes as recesses are provided on the medium pack in the examples in FIGS. 16A, 16B, 17A and 17B, such engaging members may have any configuration as long as they can expand the gap at the opening C101L when engaged. For example, a recess may be provided on the apparatus main body, and a projection that is displaced under the guidance of the recess may be provided on the medium pack.

2-6: Method of Assembly

To assemble the medium pack C100, the absorption bodies C141 and the joint C132 are sequentially put in the pack main body C101 from above. The joint C132 is placed in a position where it is not coupled with the holder C131 as shown in FIG. 9A. Almost simultaneously, the combination of the ink packs C130 and the holder C131 (see FIG. 7) is put in the pack main body C101 from above. Thereafter, the slide sheet C151, a predetermined quantity of printing media C150, the press sheet C152 and the positioning spring C154 are sequentially put in the pack main body C101 from above. Then, the cover C102 is fitted to the opening at the top of the pack main body C101, and the claw C102A is engaged with the hole C101K. The claw C102A is temporarily elastically deformed by pressing the cover C102 downward and is elastically restored in a position where it faces the hole C101K to be engaged with the hole C101K. Thereafter, the seal C103 is applied between the cover C102 and the pack main body C101. Thus, elements to be contained in the pack main body C101 can be sequentially put in the pack main body C101 from above with favorable operability and, similarly, the cover C102 can be easily attached from above.

Components such as the shutter C155, the spring C156, the connector C161 and the EEPROM are attached to the pack main body C101 before at least the cover C102 is attached.

2-7: Ease of Recycling

When a medium pack C100 is used until the printing media C150 or ink as consumable supplies therein run out, the used medium pack C100 can be collected and recycled.

First, the cover C102 is removed from the used medium pack C100 thus collected. Since the cover C102 is not directly welded or bonded to the pack main body C101, it can be easily removed upward from the pack main body C101 by peeling off the seal C103 and disengaging the claw C102A and the hole C101K. Thereafter, the elements in the pack main body C101 can be sequentially removed upward in an order that is the reverse of the order of assembly of the medium pack C100 described above. In doing so, the holder C131 and the joint C132 may be disengaged after taking them out upward in the coupled state as shown in FIG. 9B.

Then, the medium pack C100 is assembled in the order described above after replacing the absorption bodies C141 and the ink pack C130 with new ones, replenishing the printing media C150 or replacing components such as the holder C131 and joint C132 with new ones, as occasions demand. At this time, sufficient mounting strength of the cover C102 can be maintained by replacing the seal C103 with a new one.

The elements in the pack main body C101 are not welded to the pack main body C101, and this is advantageous in improving the operability of assembly of the medium pack and the ease of recycling of the same and in facilitating the evaporation of ink absorbed by the absorption bodies C141 to maintain the waste ink absorbing function of the absorption bodies C141. Since volatile components in waste ink are guided by the slide sheet C151 to the circumferential wall C101X of the pack main body C101 to be exhausted, it is possible to prevent the printing media C150 from being adversely affected by the same.

2-8: Others

When a medium pack C100 is used until the ink therein as a consumable supply runs out or nearly runs out, the ink can be replenished without disassembling the medium pack C100. Specifically, there is prepared an ink replenisher in the form of an injector capable of injecting ink reserved therein from the tip of an injection needle. The tip of the injection needle is stuck into the rubber plugs 134 in the ink supply ports P1, P2 or P3 through the opening C101K of the medium pack C100 to inject the ink into the ink pack C130-C, C130-M or C130-Y through the ink passage L1, L2 or L3 from the ink replenisher. By preparing ink replenishers containing inks in cyan (C), yellow (Y) and magenta (M) separately, the inks in the ink packs C130-C, C130-M and C130-Y can be selectively replenished.

The ink packs C130-C, C130-M and C130-Y can be directly replenished with inks by sticking the tips of the injection needles of the ink replenishers described above into the ink packs C130-C, C130-M and C130-Y after disassembling the medium pack C100. In this case, the holes formed in the ink packs C130-C, C130-M and C130-Y when they are stuck with the injection needles must be closed after the injection needles are pulled out. For example, possible approaches to this problem are to use a material having a property of automatically closing such holes to mold the ink pack C130-C, C130-M and C130-Y and to close such holes using seals, valves and the like.

3: Printer Section

In the present embodiment, a so-called serial type printer section (or printer main body) B100 is employed in which inkjet type recording heads are used and in which a photographed image or the like is printed on a printing medium by repeatedly scanning the recording heads on the printing medium and then transporting the printing medium in a direction substantially orthogonal to the scanning direction a predetermined distance.

In the printer main body of the present embodiment, ink supply from the ink packs in a medium pack C100 attached thereto to the recording heads mounted on the carriage is performed using a method in which the ink supply passages and the recording heads are in an unconnected state at least during recording and in which an ink supply enabled state is established to supply inks by connecting the ink supply passages and the recording heads at appropriate timing (hereinafter referred to as a "pit-in method" for convenience). That is, a sub-tank for reserving or storing a very small amount of ink is mounted on the carriage. When the carriage moves to reach an ink supplying position, a supply passage is formed between the sub-tank and an ink pack in the medium pack C100 through a joint portion provided in the ink supplying position, whereby ink is supplied into the sub-tank. A pump is also provided to introduce the ink from the ink pack by generating a negative pressure in the sub-tank when the ink is supplied to the sub-tank.

Figure 18:
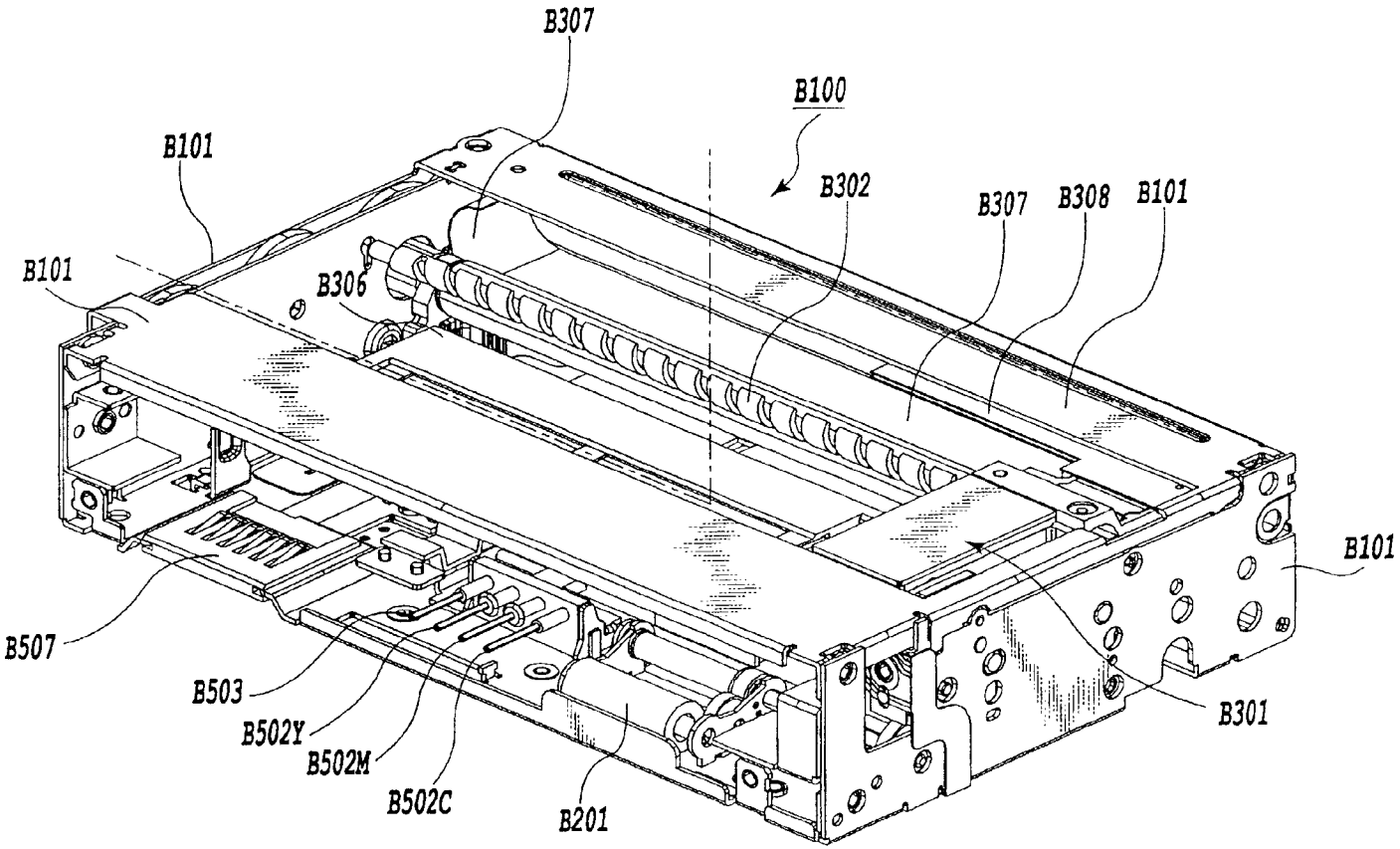
FIG. 18 is a perspective view of the printer main body according to an embodiment of the invention.
Figure 19:
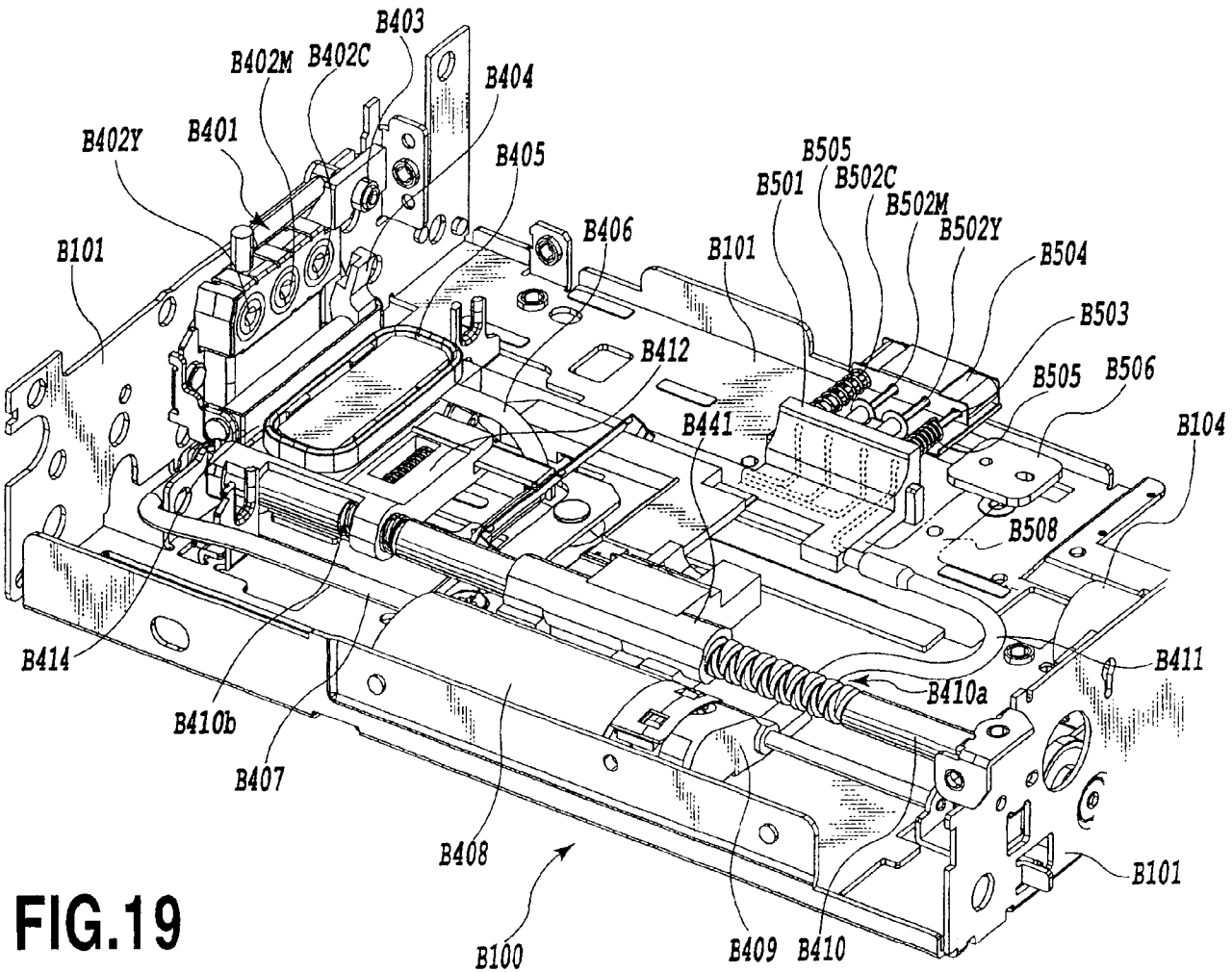
FIG. 19 is a perspective view of the printer main body with a part of a chassis thereof omitted.
Figure 20:
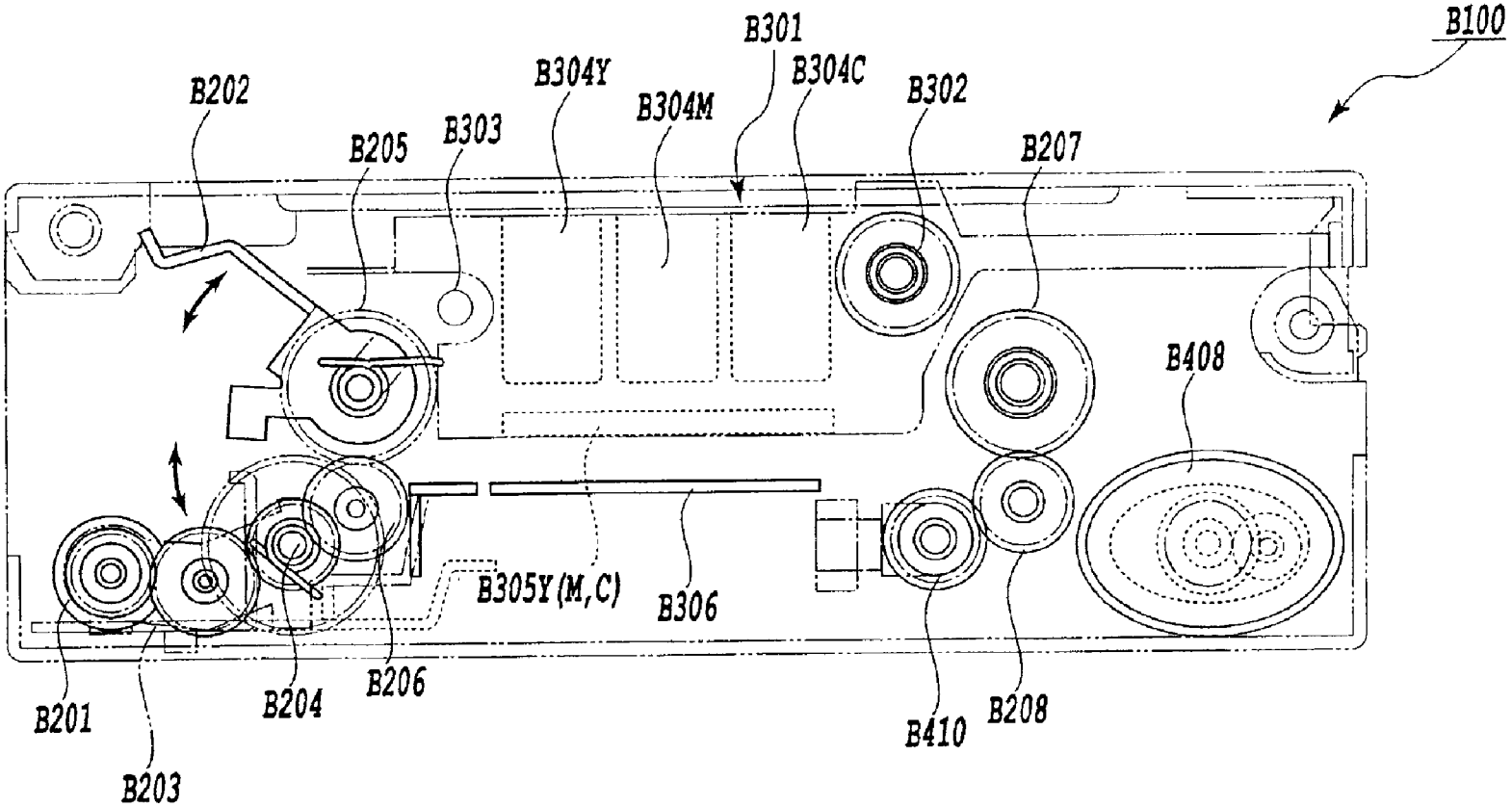
FIG. 20 is a sectional view of the printer main body taken from a side thereof.

FIG. 18 is a perspective view of the printer main body B100 taken from the side of a medium pack C100 attaching section of the same, and FIG. 19 is a perspective view of the main body taken from the side opposite to the attaching section. FIG. 19 omits a top surface of a chassis serving as a structural member, the carriage and a mechanism for moving the same, a roller for transporting the printing medium, and so on. FIG. 20 is a lateral sectional view of the main body B100 with the medium pack attaching section located on the left side.

As shown in those figures, the printer main body B100 has a thin configuration which is substantially rectangular and which is shorter in height than its lengthwise and breadthwise dimensions. A chassis B101 constitutes a structural member of the printer main body B100 and defines the outline of the rectangle. Specifically, the chassis B101 is assembled such that it covers substantially all of the six sides forming the rectangle except for the two sides shown in FIG. 18. The opening surrounded by sides of the rectangle in the directions of the breadth and height thereof shown in FIG. 18 is an opening for attaching the medium pack C100. The relatively large plane surrounded by lengthwise and breadthwise sides similarly shown in FIG. 18 is covered by the chassis B101 in a part thereof, and the uncovered part has a width substantially equal to the width of a carriage B301 mounted with the recording head and extends over a moving range of the carriage B301.

Elements that make up the printer main body B100 are fixed or rotatably supported by the chassis B101 to form mechanisms in the printer main body. Specifically, the printer main body B100 of the present embodiment generally has a paper-feed and transport mechanism, a carriage moving mechanism, an ink supply and recovery mechanism and a pack connection mechanism located in the rectangle formed by the chassis B101.

Referring to the paper-feed and transport mechanism, as apparent from a schematic general construction shown in FIG. 20, a pick-up roller B201 and a press plate B202 for pressing printing medium against the roller with an adequate pressure are disposed at the left end in the figure where the medium pack C100 is attached. The pick-up roller B201 is configured to be able to rotate in a predetermined angular range by being rotatably supported by roller arms B203 which are in turn rotatably supported by an ASF connecting shaft B204. Similarly, the press plate B202 is also rotatably configured, which allows the roller B201 and the press plate B202 to enter the attached medium pack C100 to thereby sandwich the printing media directly (strictly speaking, the press sheet C152 intervenes between the press plate and the media). As will be described later, the pick-up roller B201 is rotated by a driving force of an LF motor (not shown) transmitted through a PF roller B205 to be described later, the roller arms B203 and a gear train provided on the ASF connecting shaft B204, while the printing media are pressed by the press plate B202 against the roller with an adequate pressing force to pick up the printing media one by one and feed the printing medium into the printer main body B100.

As shown in FIG. 18, the pick-up roller B201 has a longitudinal length that is smaller than the width of the printing media in the medium pack C100 (see FIG. 7), and it is provided in the vicinity of an end of the opening for attaching the medium pack C100. The width of the press plate B202 is smaller than the width of the pick-up roller B201 although not shown in FIG. 18, and it therefore presses the printing media against only a part of the pick-up roller B201. Thus, the paper feed mechanism of this printer engages with only a part of a printing medium to be fed to feed the same.

As further paper-feed and transport mechanisms, as shown in FIG. 20, a combination of a PF roller B205 and a pinch roller B206 and a combination of a PF roller B207 and a pinch roller B208 are provided in respective positions sandwiching a moving range of the carriage B301 (the moving direction of which is in the direction perpendicular to the plane of the figure) downstream of the pick-up roller B201 and so on (on the right of the same in the figure) in the paper feed direction. The PF rollers B205 and B207 are driven for rotation by an LF motor which is provided in a position that is in a substantially diagonal relationship with the part of the printer main body where the paper feed mechanism including the pick-up roller is provided and a gear train which is provided on a lateral surface of the chassis at the end of the chassis that is opposite to the end where the paper feed mechanism is provided with respect to the opening, for transmitting the driving force of the LF motor. Thus, in association with a scan of the recording head mounted on the carriage B301, a printing medium is transported a predetermined amount by the combination of the PF roller B205 and the pinch roller B206 and the combination of the PF roller B207 and the pinch roller B208 respectively provided at upstream and downstream sides of the moving range of the carriage B301 in the transporting direction of the printing medium. When this operation is repeated to complete printing, the paper is ejected out of the printer main body B100 or out of the apparatus main body A001 of the camera. In the printing medium transport passage, as shown in FIGS. 18 and 20, a platen B306 is disposed under the moving range of the carriage B301. As a result, a printing medium under transportation is slidingly supported by the platen B306 on its surface opposite to a surface to be printed, and this ensures the flatness of the printing medium.

While the PF roller B205 on the upstream side and the above-mentioned press plate B202 are supported by the same shaft, the press plate B202 is rotated using a frictional force of an arm spring as will be described later in order to adjust the pressing force adequately. The roller arm B203 supporting the pick-up roller B201 is similarly rotated using a frictional force of a roller spring (not shown) according to the rotation of an ASF connecting shaft (not shown) supporting the same, which makes it possible to apply an adequate pressing force to the printing medium or paper similarly to the press plate while the paper is fed.

The carriage moving mechanism is a mechanism for driving a lead screw B302 and the like shown in FIG. 18 to move the carriage B301.

The lead screw B302 is provided such that it extends along the entire breadthwise sides of the rectangle constituting the printer main body or in the longitudinal direction of the main body, while a guide shaft B303 for the carriage B301 (see FIG. 20) is similarly provided in parallel with the lead screw B302. A carriage motor (or CR motor which is not shown) for generating a driving force for rotating the lead screw B302 is provided on the downstream side of the printing medium transportation that is the right side of FIG. 20.

The carriage B301 can be moved along the guide shaft B303 when a screw pin (not shown) provided thereon engages with a spiral groove formed on the circumference of the lead screw B302 and the lead screw B302 is rotated by the driving force of the carriage motor.

The carriage B301 is provided with ink chambers B304Y, B304M and B304C as the sub-tanks for respective types of ink, i.e., yellow (Y), magenta (M) and cyan (C) used for printing. As described above, each of the ink chambers has a capacity with which a very small amount of ink only sufficient to print one printing medium can be contained. It is therefore necessary to replenish the inks from the ink packs of the medium pack C100 at predetermined intervals. Recording heads B305Y, B305M and B305C associated with the respective types of ink are provided under those ink chambers. The recording heads are arranged in a scanning direction thereof, that is, the direction perpendicular to the plane of FIG. 20, and a plurality of ink ejecting ports (hereinafter also called nozzles) are disposed on each of the recording heads in a direction substantially orthogonal to the scanning direction. In each of the recording heads, a liquid passage is formed in communication with each of the nozzles, and an electrothermal transducer and electrode wiring and the like for supplying an electrical signal to the same are provided corresponding to the liquid passage. As a result, the recording head can generate bubbles in ink in the liquid passages utilizing thermal energy generated by the electrothermal transducer and to eject the ink from the respective nozzles using the pressure of the bubbles. As the ink is thus ejected, a capillary force primarily causes ink to be supplied to each liquid passage from the ink chamber through a common liquid chamber with which the liquid passages are communicated commonly in the respective recording head.

The carriage B301 having the above-described construction is moved in accordance with various modes of the present printer. Specifically, an operation in each mode is performed when the lead screw B302 rotates clockwise or counterclockwise or in both directions by a predetermined amount on a basis of the home position of the carriage. For example, during a printing operation, when the lead screw B302 rotates clockwise and counterclockwise, the carriage B301 reciprocates in a printing area having a predetermined range, which makes it possible to scan the recording heads B305Y, B305M and B305C mounted on the carriage B301 across the printing medium. During a wiping movement that is a movement of a recording head accompanied by the action of wiping the surface of the recording head where the nozzles are disposed with a predetermined member, a wiper (not shown) is engaged with the surface of the recording head where the nozzles are disposed to perform wiping while the carriage B301 reciprocates within a predetermined range in the vicinity of its home position. Further, during the above pit-in operation for replenishing each ink chamber of a recording head with ink, the carriage B301 moves to a joint member B401 disposed in the vicinity of the home position as shown in FIG. 19 as a result of a predetermined rotation of the lead screw B302. Consequently, ink replenishing needles (not shown) for respective inks provided on the carriage are inserted into joints B402Y, B402M and B402C for the respective inks at the joint member B401 and, similarly, an air suction hole (not shown) provided on the carriage B301 is connected to an air suction cap B403 provided on the joint member B401 as a result of the series of carriage movements. Thus, ink is supplied to each of the ink chambers B304Y, B304M and B304C in the carriage B301 by an operation of a pump (not shown). In the position where the joint member B401 is connected, the surface of each recording head where the nozzles are disposed is in a position in a face-to-face relationship with the cap B405 shown in FIG. 19, and the cap B405 can be elevated to cover the surface. Such capping makes it possible to suppress evaporation of an ink solvent and the like through the nozzles when the printer does not perform the printing operation. In the capping state, a suction recovery process can be performed using the pump to discharge ink whose viscosity may have increased from a liquid passage through the respective nozzle. Further, by moving the carriage B301 to the position of the cap B405 at predetermined timing as a result of a predetermined rotation of the lead screw B302, the preliminary ejection operation by ejecting ink from each of the recording heads into the cap in this position can be performed.

As shown in FIG. 18, one end of a flexible substrate B307 is secured to a part of the carriage B301. This makes it possible to exchange print signals and so on between a control portion configured in the form of a substrate in the present printer and the respective recording heads. In the present embodiment, the flexible substrate B307 is formed with a hole in the form of a partial cut-out in the middle of a part of the substrate that is attached to the carriage B301, and an encoder sensor constituted by a light-emitting element and a light-receiving element is provided on the back side of the fixing part of the carriage. A scale having detection marks at equal intervals, which is to be used for the encoder, extends on the backside of a panel which constitutes the top of the chassis B101 when the printer main body B100 is in the attitude shown in FIG. 18. As a result, the encoder sensor can optically detect the detection marks on the scale through the hole as the carriage B301 moves. Ink is ejected from each of the recording heads at timing that is based on encoder signals obtained through the detection as the recording heads are scanned, which makes it possible to form ink dots in predetermined positions on a printing medium sequentially.

The ink supply and recovery mechanism is a mechanism for performing ink replenishment of each of the ink chambers of the carriage B301 through the joint member B401 and for suction recovery, the mechanism primarily relating to a pump for generating a negative pressure for conveying ink for such purposes.

As shown in FIGS. 19 and 20, a pump B408 is provided substantially in the middle of the end section of the printer main body B100 opposite to the medium pack C100 attaching section. As shown in FIG. 20, a piston sliding in the pump B408 has an elliptical cross sectional shape. Accordingly, a cylinder to serve as a case member for the same also has an elliptical cross sectional shape.

A lead screw B410 separate from the lead screw B302 for the carriage is provided such that it extends in parallel with the longitudinal direction of the pump B408 and in a range substantially covering the entire printer main body B100 in the longitudinal direction thereof. The lead screw B410 is formed with two spiral grooves B410*a* which cross each other for causing the cylinder of the pump B408 and the wiper to operate and for causing an ASF trigger to operate to feed the printing medium in the medium pack and one spiral groove B410*b* for causing the cap B405 and the joint member B401 to operate.

As a member making up the pump B408, there is provided a pump driving arm B409 connected with the piston through a piston shaft. The pump driving arm B409 has a portion extending in parallel with the lead screw B410, and a part of this portion is engaged with the spiral grooves B410*a* on the lead screw B410 to allow the pump driving arm and hence the piston to move to cause a pumping operation. This movement is guided by a guide shaft B413 engaged with a part of the pump driving arm B409.

The pumping operation of the pump B410 causes the operation of replenishing each ink chamber of the carriage B301 with ink by sucking air from each ink chamber to generate a negative pressure therein and the operation of sucking air from the cap B405 capping a recording head to generate a negative pressure therein and sucking waste ink consequently. The waste ink discharged as a result of the suction flows through pipes in the piston shaft and the pump driving arm B409 to a waste ink communication tube B411 and a needle B503 held by an ink needle holder B501, and it is finally introduced to the ink absorption bodies provided in the attached medium pack C100. The movement of the pump driving arm B409 in engagement with the spiral grooves B410*a* also enables the operation of the wiper and the operation of the ASF trigger for feeding the printing medium from the medium pack C100.

A part of a switching slider B412 is engaged with the other spiral groove B410*b* on the lead screw B410, which allows the cap B405 to be moved up and down through a cap lever arm B414.

A pack connecting mechanism is a mechanism other than the mechanism relating to paper feed, and it relates to the connection of the medium pack. Specifically, it primarily relates to supply of ink from the medium pack C100 and introduction of ink discharged from the printer main body into the medium pack C100.

As shown in FIG. 18, at the opening of the printer main body B100 for attaching the medium pack C100, there is provided elements to be engaged with elements of the medium pack C100 when it is attached.

In addition to the pick-up roller B201 and the press plate B202 (not shown in FIG. 18) for feeding printing medium as described above, there is provided the ink supply needles B502C, B502M and B502Y for introducing inks from the ink packs for the respective ink colors in the medium pack C100 to the respective ink chambers on the carriage B301. Adjacent to the supply needles, there is provided the needle B503 for waste ink for introducing waste ink discharged into the cap as a result of the suction recovery process and the preliminary ejection process of the recording heads to the ink absorption bodies in the medium pack C100. As previously described, those needles penetrate and engage with the respective rubber plugs 134 in the ports P1 through P4 of the joint C132 in the medium pack C100 when the medium pack is attached.

As shown in FIG. 19, the ink supply needles B502C, B502M and B502Y communicate with the respective joints B402C, B402M and B402Y of the joint member B401 through passages constituted by grooves formed in the needle holder B501 for holding the needles and in a member integral with the same. Similarly, the needle B503 for waste ink communicates with a predetermined passage in the pump driving arm B409 of the pump B408 through a passage constituted by a groove formed in the holder B501 and the waste ink communication tube B411.

Each of the needles is covered by a needle cap B504 when the medium pack is not attached. Specifically, the cap B504 is urged ahead each needle by a compression spring B505 provided at the needle when the pack is not attached, and the tip of each needle is thus covered by the cap B505 when the pack is not attached. When the pack is attached, as a result of the pack attaching operation, the cap B504 is moved toward this side of each needle against the urging force of the compression spring B505, which causes the tip of the needle to be exposed and inserted into the joint in the pack.

Further, a connector B507 is disposed in the above opening. The connector B507 is connected with the connector C161 of the EEPROM provided in the medium pack C100 to allow the control portion of the printer main body to write and read the EEPROM.

As shown in FIG. 19, the ink absorption body B506 is provided between the needles and the connector (FIG. 18 shows a state in which the absorption body is removed). The ink absorption body B506 is connected to a part of an ink absorption body B508 which is spread over the substantially entire bottom surface of the platen B306 (see FIG. 20). When the medium pack C100 is attached, the ink absorption body B506 enters the opening C101L of the medium pack to contact the ink absorption bodies therein. This makes it possible to absorb a part of ink ejected from the recording heads during printing with the absorption body B508 and to introduce the absorbed ink to the ink absorption bodies in the medium pack C100 through the absorption body B506. In the present embodiment, ink discharged as a result of the suction recovery process or preliminary ejection process in the printer main body B100 is received by the cap B405 and introduced to the ink absorption bodies in the medium pack through the needles B503 for waste ink as described above. Further, in the present embodiment, an image or the like is printed without leaving any margin on each side of the rectangular printing medium during printing. Therefore, ink is substantially ejected also to the outside of the printing medium beyond those sides, and the ink is received by the ink absorption body B508. As the contained amount increases, the absorbed ink moves to the ink absorption body B506 to be finally introduced to the ink absorption bodies in the medium pack.

The ink absorption body B506 provided at the section connected with the medium pack is constituted by a sintered porous body made of a material harder than the other ink absorption bodies. It is therefore possible to suppress wear of the ink absorption body B506 as a result of the operation of attaching the medium pack C100 and/or resultant contact between the ink absorption bodies.

A description will now be made on detailed constructions of the paper-feed and transport mechanism, the carriage movement mechanism, the ink supply and recovery mechanism, and the pack connection mechanism of the printer main body B100 which have been schematically described above.

3.1: Paper-feed and Transport Mechanism

The paper-feed and transport mechanism in the present embodiment will now be described in more detail with reference to FIGS. 18 to 28A–28C.

The paper-feed and transport mechanism in the present embodiment has a paper-feed system mechanism for introducing printing media from the medium pack C100 into the printer main body B100 one by one and a transport system mechanism for transporting the printing medium introduced by the paper-feed system mechanism to a paper ejecting port defined by the printer main body B100 and outer casing materials through a recording area.

Transport System Mechanism

The transport system mechanism will be described. The transport system mechanism includes a driving force transmission mechanism for the combination of the PF roller B205 and the pinch roller B206 provided on the upstream side in the transporting direction of the printing medium as described above and the combination of the PF roller B207 and the pinch roller B208 provided downstream of the same.

The PF rollers B205 and B207 are rotatably supported by bearing portions protruding from the chassis B101 at rotating shaft portions B211 and B212 provided on end sides thereof. The pinch rollers B206 and B208 are rotatably supported by predetermined bearing members and are normally urged by springs which are not shown such that they can be pressed against the PF rollers B205 and B207. A construction is employed in which the bearing portions of the rotating shaft portions B211 and B212 are provided inwardly of both of the left and right lateral surfaces of the chassis B101 to minimize outward protrusion of the rotating shaft portions B211 and B212 from the chassis. A structure is employed here in which protrusion of the rotating shaft portions B211 and B212 from a right side plate B101*a* of the chassis B101 is avoided, and the structure makes it possible to avoid any interference with the rotating shaft portions even when a plate-like outer casing material is fixed on the outer surface of the right side plate B101*a*, which contributes to reduction of the size of the apparatus as a whole.

Figure 26:
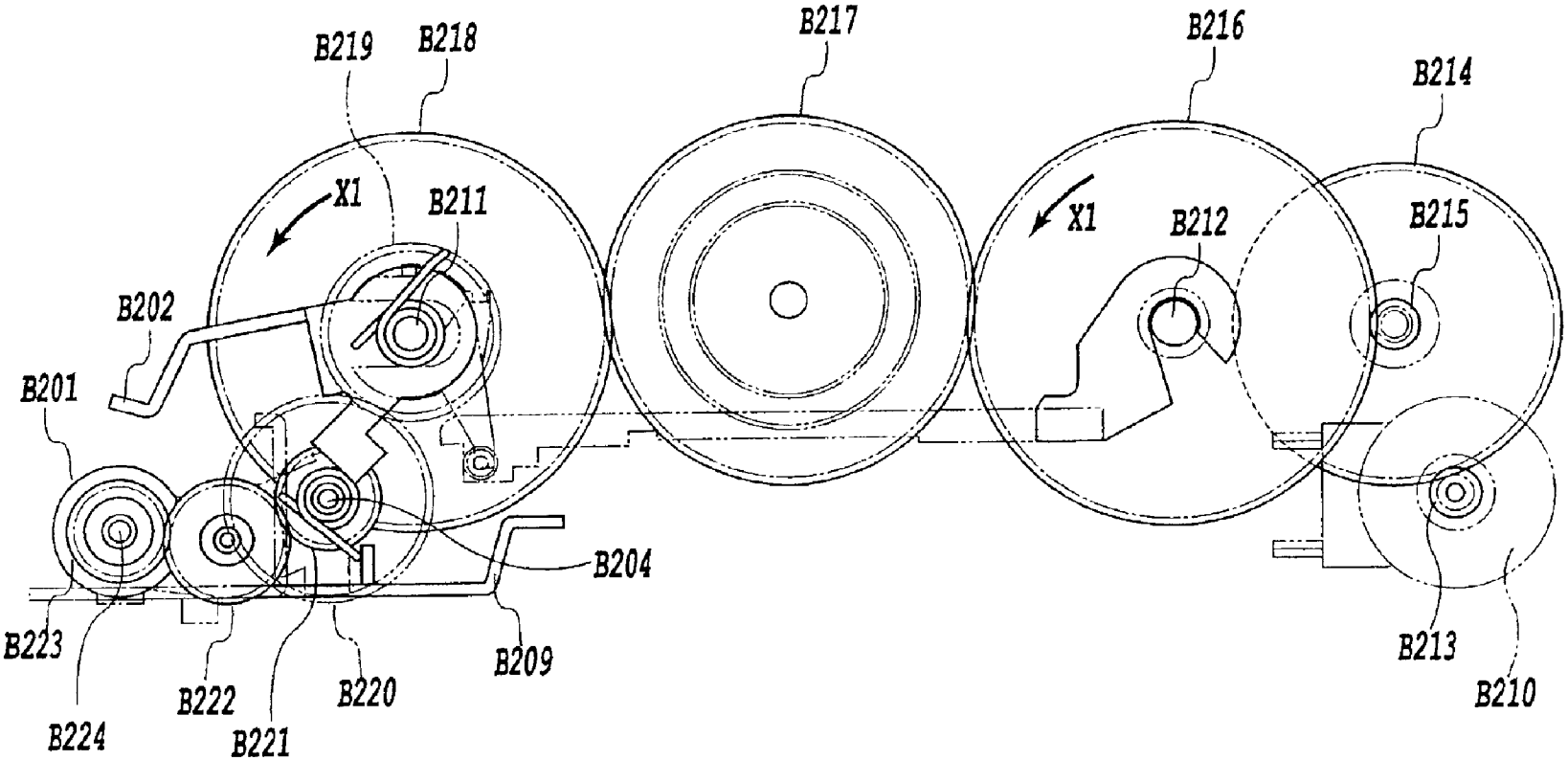
FIG. 26 is an illustration of the mechanism for feeding paper showing standby positions of the pick-up roller and the press plate.
Figure 27:
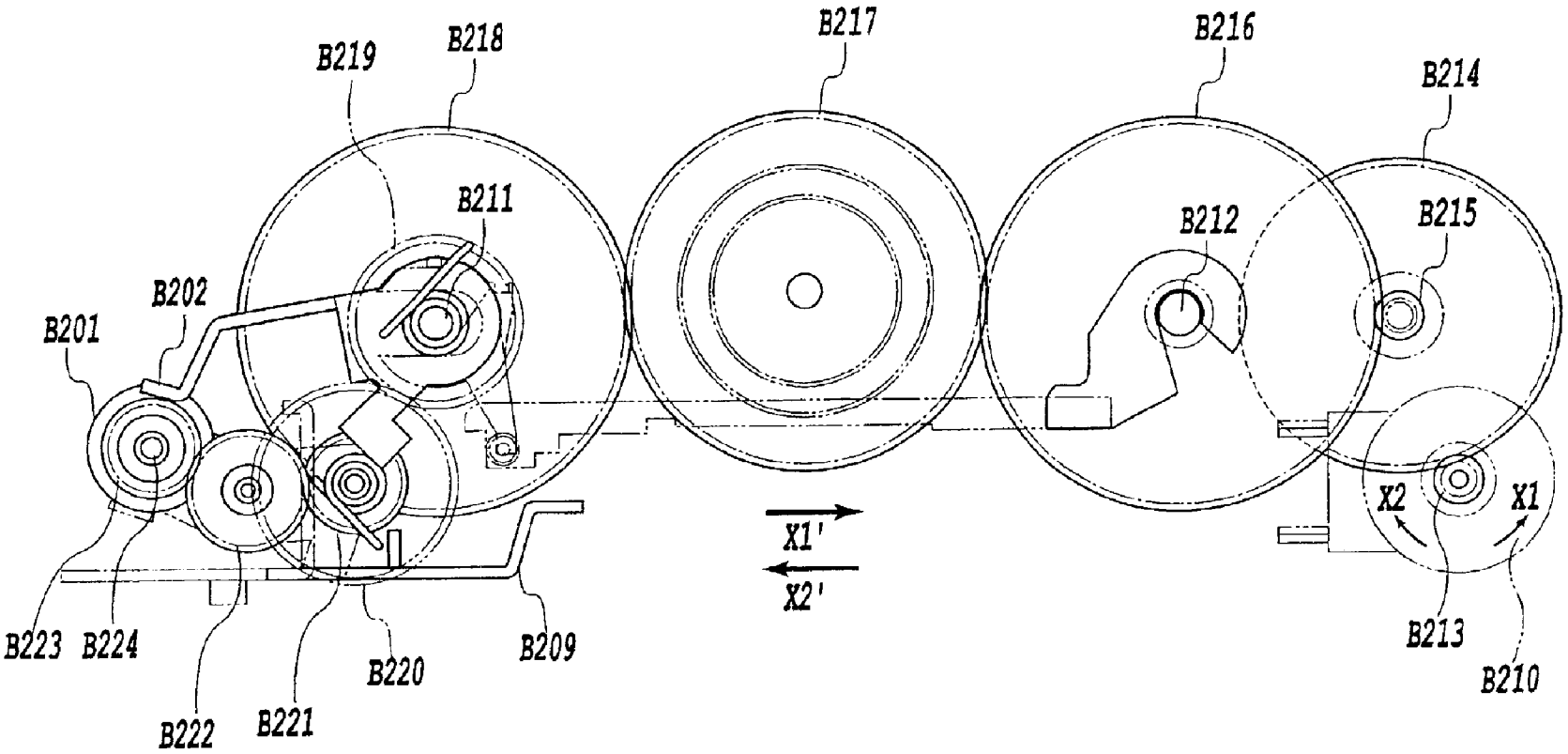
FIG. 27 is an illustration of the mechanism for feeding paper showing a state in which printing media are sandwiched between the pick-up roller and the press plate.
Figure 28A:
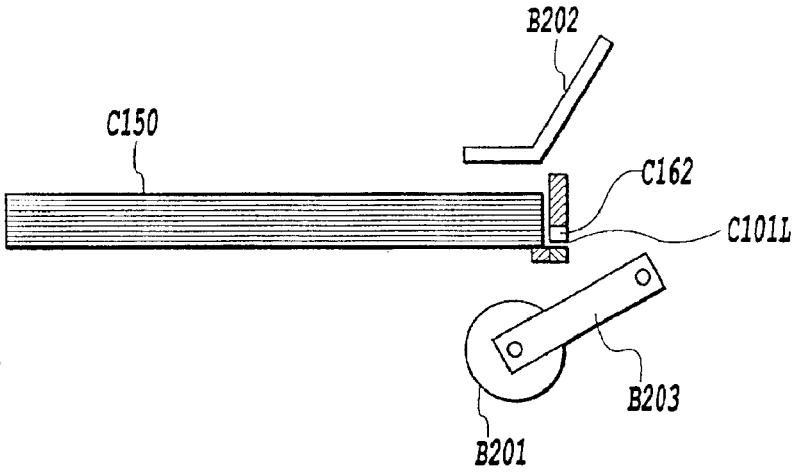
FIGS. 28A, 28B and 28C are illustrations of the mechanism for feeding paper showing an operation of feeding printing media piled up in the pack one by one with the pick-up roller and the press plate.
Figure 28B:
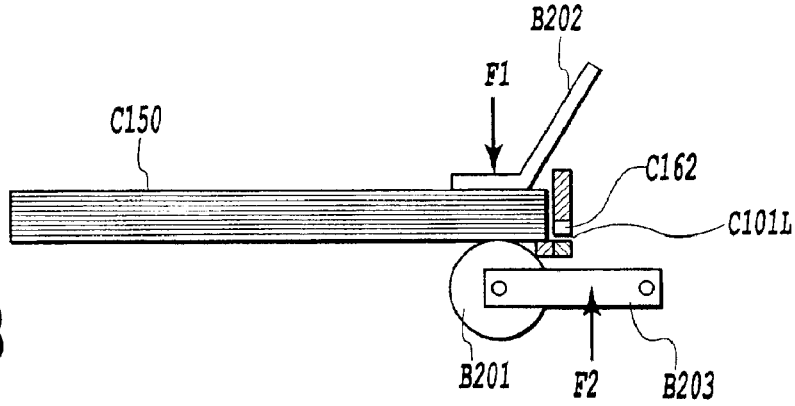
Figure 28C:
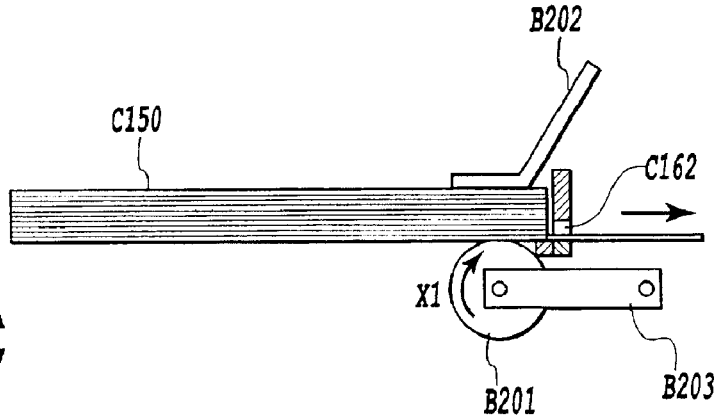

The PF rollers B205 and B207 are constituted by high friction members. The PF rollers are formed in a cylindrical configuration, and the pinch rollers B206 and B208 are formed with disc-shaped abutting portions on both ends thereof. A driving force from a single driving source (LF motor) is transmitted to the PF rollers B205 and B207 by a driving force transmission mechanism as shown in FIGS. 25 to 27.

Figure 25:
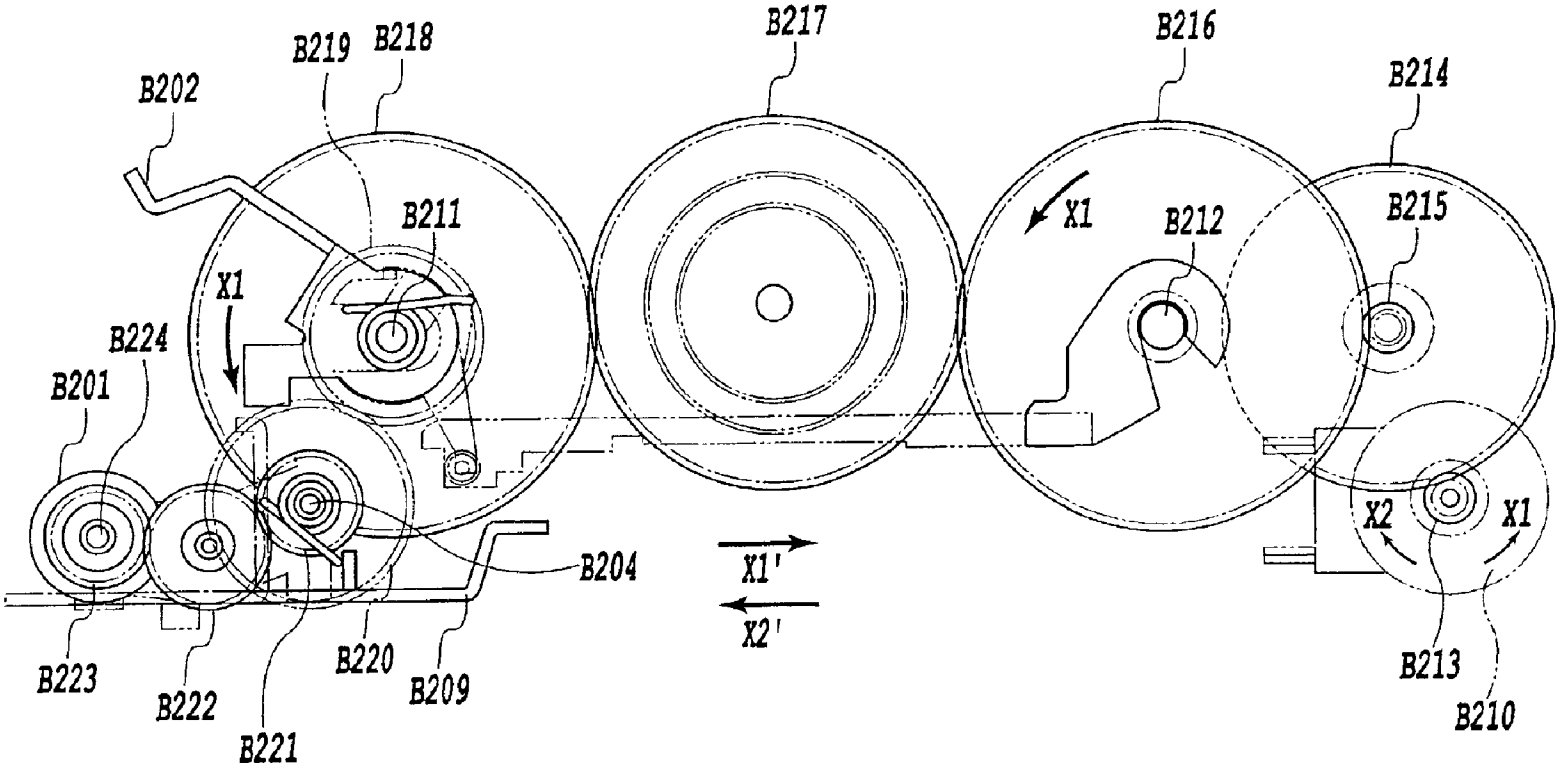
FIG. 25 is an illustration of the mechanism for feeding paper showing initial positions of a pick-up roller and a press plate.

As shown in FIG. 25, the driving force transmission mechanism is constituted by a gear train which sequentially transmits a rotary driving force from the LF motor B210 provided on the left side plate B101*b* of the chassis B101 in the vicinity of the backside (paper ejecting side) of the chassis to the paper introducing side of the chassis B101. The gear train constituting the driving force transmission mechanism is comprised of a transport system gear train and a paper feed system gear train to be described later. The transport system gear train is constituted by a gear train comprising six gears in total including a motor gear B213 provided on the rotating shaft of the motor and a PF roller gear B218 secured to the rotating shaft B211 of the upstream PF roller B205.

The gears B213 through B218 constituting the transport system gear train are attached to the outer surface of the left side plate B101*b* through rotating shafts. The rotating shafts supporting the gears B214 through B218 are provided substantially in a row along a straight line in parallel with the transporting direction of printing medium. This minimizes the space for attaching the gears in the vertical direction and contributes to reduction of the thickness of the chassis B101 (the height of the same in the vertical direction in FIG. 22). Referring to the figure, the gears B214 and B215 are intermediate gears secured to the same shaft; denoted B216 is a carry-out gear secured to the rotating shaft B212 of the downstream PF roller B207 disposed at the downstream side in the transporting direction of the printing medium; denoted B217 is an intermediate gear; and denoted B218 is a paper feed gear secured to the rotating shaft B211 of the upstream PF roller B205.

With the transport system mechanism having the above-described construction, when the LF motor B210 rotates clockwise, the driving force is sequentially transmitted from the motor gear B213 to the gears B214, B215, B216, B217 and B218 provided substantially in a row, and the downstream PF roller B207 and the upstream PF roller B205 rotate in a forward rotating direction x1 according to the rotation of the carry-out gear B216 and the paper feed gear B218, respectively. The rotating operation of the PF rollers B205 and B207 takes place intermittently corresponding to the movement of the carriage to intermittently transport one printing medium fed by the paper feed system to be described later in the normal transporting direction x1.

Paper Feed System Mechanism As shown in FIGS. 21 to 28A–28C, the paper feed system mechanism is provided in the vicinity of the opening located on the upstream side of the chassis B101 in the transporting direction. As previously described, each of the press plate B202 and the pick-up roller B201 swings to sandwich the medium pack C100 attached to the printer main body B100. The printing media are pulled out one by one as a result of the rotation of the pick-up roller B201. That is, the paper feed system mechanism is comprised of the press plate B202, a swinging mechanism for the same, the pick-up roller B201 and a swinging mechanism and a rotating mechanism for the same.

Figure 23:
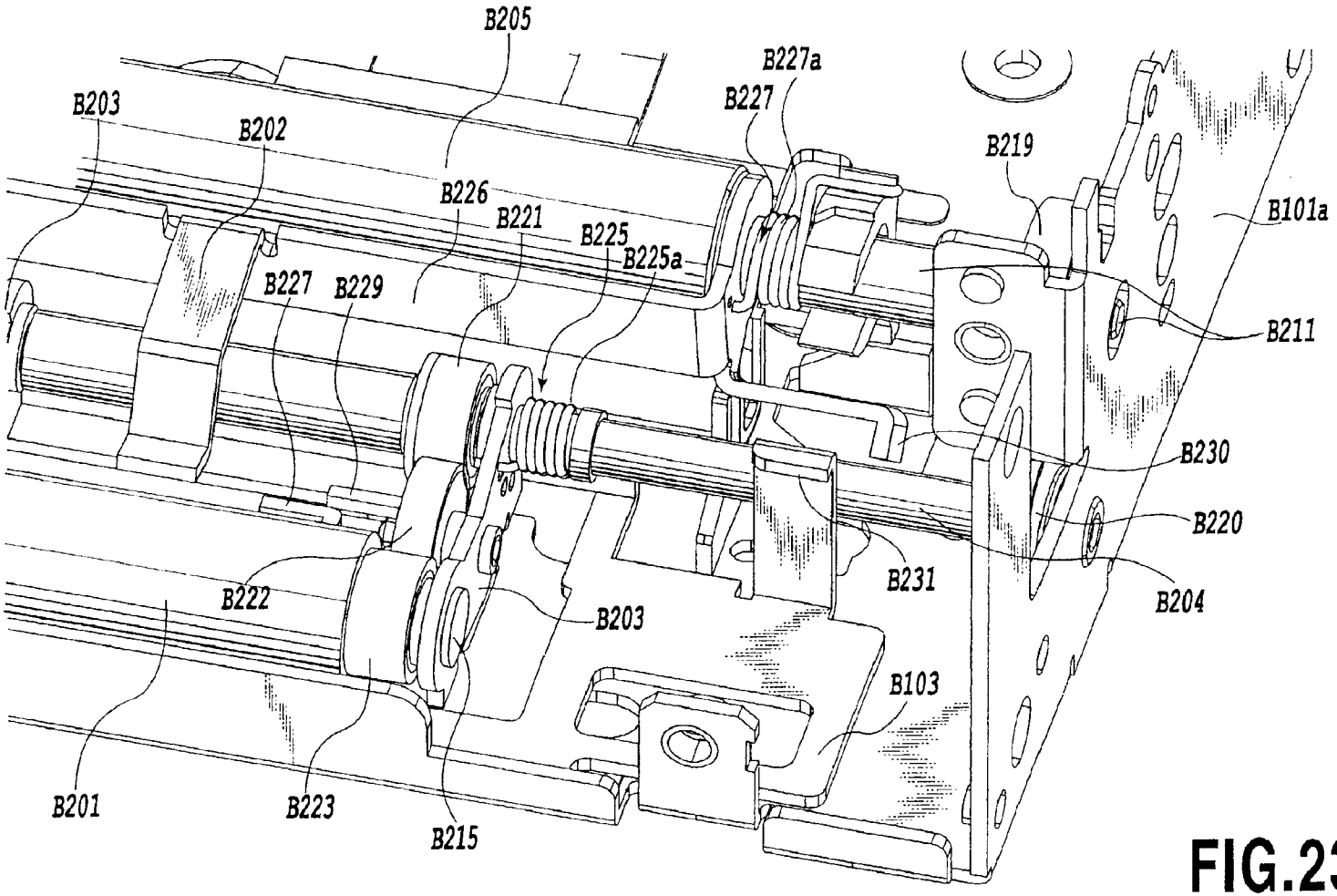
FIG. 23 is an illustration of the mechanism for feeding paper showing, in particular, an operating position of an ASF trigger.
Figure 24:
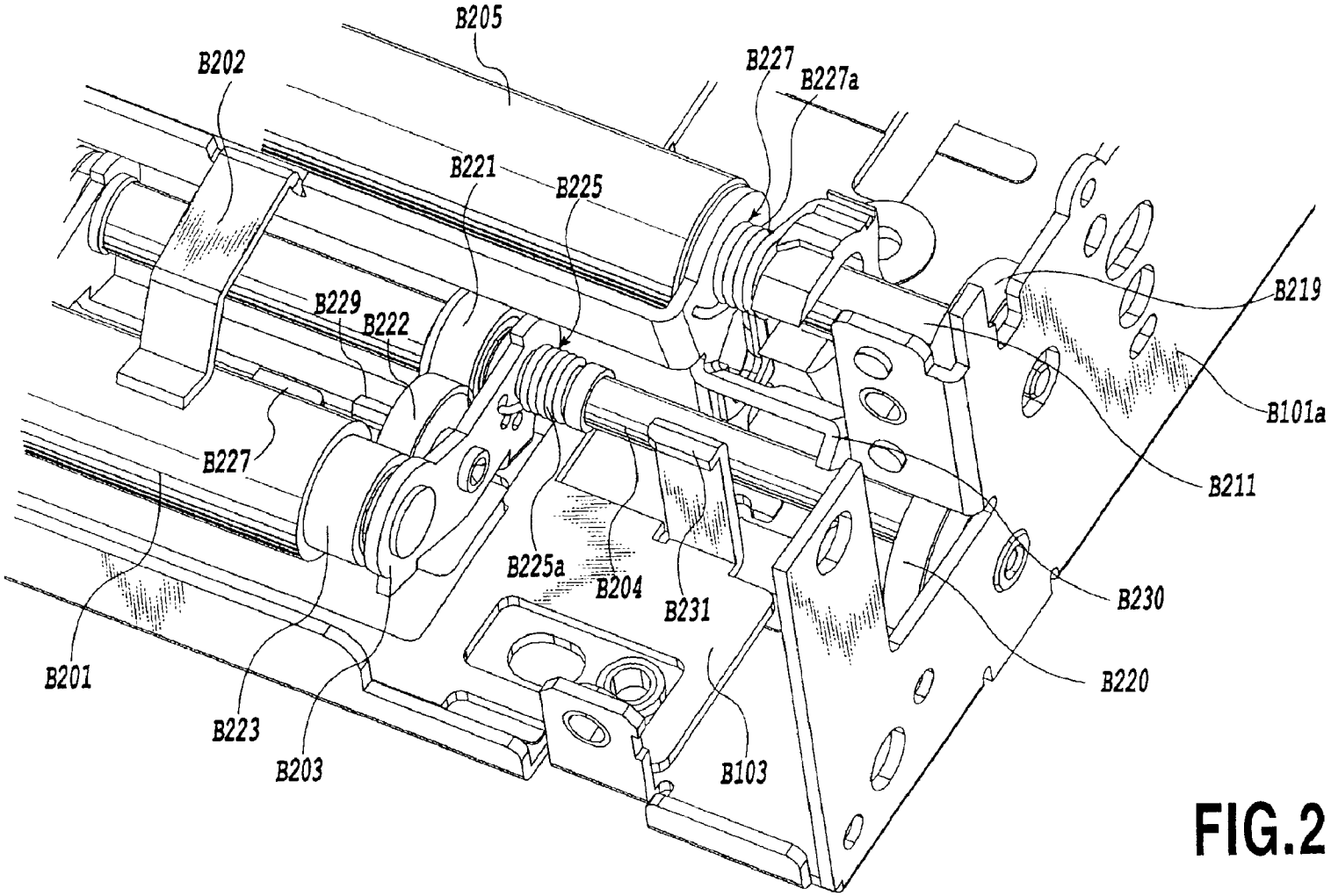
FIG. 24 is an illustration of the mechanism for feeding paper showing, in particular, another operating position of the ASF trigger.

The pick-up roller B201 is secured to the ASF connecting shaft B204 that is rotatably supported by a bearing arranged on the chassis B101. As shown in FIG. 23, the ASF connecting shaft B204 is supported in a position that is upstream of the rotating shaft B211 of the upstream PF roller B205 and that is diagonally below the same.

The rotating mechanism for the pick-up roller B201 has the following construction. Ends of a pair of left and right roller arms B203 facing each other at a predetermined interval are rotatably inserted in and supported by the ASF connecting shaft B204, and the pick-up roller B201 constituted by a high friction member in a cylindrical shape is supported at the other ends of the roller arms B203 such that it can be rotated by a rotating shaft B224.

The torque of the paper feed gear B218 or the torque of the LF motor B210 is transmitted to the pick-up roller B201 through the paper feed system gear train interlocked with the paper feed gear B218 of the transport system gear train. The paper feed system gear train is comprised of five gears in total including a PF roller gear B219 secured to the rotating shaft B211 in FIG. 25 and a pick-up roller gear B223 secured to the rotating shaft B215 of the pick-up roller B201, i.e., gears B219, B220, B221, B222 and B223. Denoted B220 is an ASF large-diameter gear secured to the ASF connecting shaft B204 and engaged with the PF roller gear B219. Denoted B221 is an ASF small-diameter gear secured to the ASF connecting shaft B204. Denoted B222 is an intermediate gear engaged with the ASF small-diameter gear B221 and the pick-up roller gear B223.

The rotating mechanism having the above-described construction operates in accordance with the rotation of the LF motor B210. Specifically, when the rotating shaft B211 is rotated by the transport system gear train as a result of the rotation of the LF motor B210, the PF roller gear B219 rotates integrally therewith. The rotation in turn causes the pick-up roller gear B223 to rotate through the ASF large-diameter gear B220, the ASF small-diameter gear B221 and the intermediate gear B222. The resultant rotation causes the rotating shaft B224 to rotate, and the pick-up roller B201 rotates with the rotating shaft B224.

The swinging mechanism for the pick-up roller B201 has the following construction.

The swinging mechanism for the pick-up roller B201 in the present embodiment is configured with a small size at a low cost by making combined use of the above rotating mechanism. Therefore, the following description will omit the construction of the rotating mechanism itself and will refer to another mechanism added thereto and a construction for associating the additional mechanism with the rotating mechanism.

First, a member constituting the additional mechanism is a coupling spring B225 for rotatably coupling the ASF connecting shaft B204 and the roller arms B203. The coupling spring B225 is constituted by a coiled spring wound around the circumference of the ASF connecting shaft B204, and one end of the same is held by one of the roller arms B203 (the arm on the right side of FIG. 22). A portion B225*a* of the coupling spring B225 wound around the ASF connecting shaft B204 is comprised of a plurality of coils in a spiral configuration having a diameter smaller than the outer diameter of the ASF connecting shaft B204 in a state in which the ASF connecting shaft B204 is not inserted. Therefore, the wound portion B225*a* normally contacts the ASF connecting shaft B204 with a pressure, and the winding direction is the direction of increasing the diameter of each of the coils of the wound portion B225*a* when the ASF connecting shaft B204 is rotated in the forward rotating direction (the direction x1) with the roller arms B203 fixed, i.e., the direction of relaxing the ASF connecting shaft B204.

With the coupling spring B204, the roller arms B203 and the ASF connecting shaft B204 rotatably inserted therein can be coupled with respect to the rotating direction with predetermined torque acting thereon. Specifically, since a frictional force is generated between the ASF connecting shaft B204 and the wound portion B225*a* of the coupling spring B225 in contact therewith with a pressure, when no load is applied to the roller arms B203, the frictional force causes the coupling spring B225 to rotate with the ASF connecting shaft B204, which causes the roller arm B203 to which one end of the spring is held to rotate in the same direction.

When a force (load) is applied to the roller arms B203 in the direction of preventing the rotation of the same, that is, the direction of increasing the diameter of the wound portion B225*a* of the coupling spring B225 as described above, the frictional force between the wound portion B225*a* and the ASF connecting shaft B204 decreases. When the load applied to the roller arms B203 exceeds the frictional force, the ASF connecting shaft B204 slidingly rotates relative to the wound portion B225*a* of the coupling spring B225. Therefore, in a state in which the swinging of the roller arms B203 is stopped while the ASF connecting shaft B204 is rotating, a rotational force (torque) in accordance with a slide frictional force generated between the wound portion 225*a* and the ASF connecting shaft B204 is always applied, the force having a substantially constant value.

Thus, the pick-up roller B201 in the present embodiment rotates about the rotating shaft B224, and the roller arms B203 make a swinging motion about the ASF connecting shaft B204, the LF motor B210 acting as a driving source for both of those operations. The range of the swinging operation is set between an initial position (see FIG. 25) in which the roller is spaced from the lowermost printing medium contained in the medium pack C100 attached to the printer main body B100 and a position for the paper feed operation in which the roller is pressed against the lowermost printing medium.

The swinging mechanism for driving the press plate B202 has the following construction.

The press plate B202 is comprised of a press plate supporting arm B266 rotatably supported by the rotating shaft B211 of the upstream PF roller B205 and a coupling spring B227 which allows rotatable coupling of the press plate supporting arm B226 and the rotating shaft B211.

The press plate supporting arm B226 is in the form of a frame that is bent and formed in the U-shape, and shaft-mount sections formed on both ends thereof are rotatably inserted in and supported by the rotating shaft B211 on both sides of the PF roller B205. The press plate supporting arm B226 is integrally formed with the press plate protruding upstream in the paper transporting direction, and the plate faces a central part of the pick-up roller B201. The coupling spring B227 is constituted by a coiled spring wound around the circumference of the rotating shaft B211, and one end of the same is held by one of the shaft-mount sections (the section on the right side of FIG. 23) of the press plate supporting arm B266. The coupling spring B227 is formed with a wound portion B227*a* which is wound around the rotating shaft B211. The wound portion B227*a* is comprised of a plurality of coils in a spiral configuration having a diameter smaller than the outer diameter of the rotating shaft B211 in a state in which the rotating shaft B211 is not inserted. Therefore, the wound portion B227*a* wound around the rotating shaft B211 normally contacts the rotating shaft B211 with a pressure, and the winding direction is set at the direction of increasing the diameter of each of the coils of the wound portion B227*a* when the rotating shaft B211 is rotated in the forward direction (the direction x1) with the press plate supporting arm B226 fixed, i.e., the direction of relaxing the rotating shaft B211.

With the swinging mechanism having the above-described construction, the rotating shaft B211 rotatably inserted in the press plate supporting arm B226 and the press plate B202 can be coupled with respect to the rotating direction with predetermined torque acting thereon. Specifically, since a frictional force is generated between the rotating shaft B211 and the wound portion B227*a* of the coupling spring B227 in contact therewith with a pressure, when no load is applied to the press plate supporting arm B226, the frictional force causes the coupling spring B227 to rotate with the rotating shaft B211, which causes the press plate supporting arm B226 to which one end of the spring is held to rotate in the same direction.

When a force (load) is applied to the press plate B202 in the direction of preventing the rotation of the same, that is, the direction of increasing the diameter of the wound portion B227*a* of the coupling spring B227 as described above, the frictional force between the wound portion B227*a* and the rotating shaft B211 decreases. When the load applied to the press plate supporting arm B226 exceeds the frictional force, the rotating shaft B211 slidingly rotates relative to the rotating shaft B211 of the coupling spring B227. Therefore, in this state of sliding rotation, the rotational force (torque) applied to the load by the press plate supporting arm B226 is a rotational force (torque) in accordance with a slide frictional force generated between the wound portion B227*a* of the coupling spring B227 and the rotating shaft B211, and the force has a substantially constant value regardless of the position of the press plate supporting arm B226.

Thus, the press plate supporting arm B226 in the present embodiment swings about the rotating shaft B211, and the LF motor B210 acts as a driving source for this swinging operation as for the swinging operation of the pick-up roller B201. When a holding operation performed by a stopper mechanism to be described later is not considered, the range of the swinging motion of the press plate B202 is set between an initial position (see FIG. 25) in which the press plate is spaced from the press sheet C152 contained in the medium pack C100 attached to the printer main body B100 and the position for the paper feed operation in which the press plate is pressed against the lowermost printing medium (see FIG. 27).

In the present embodiment, in order to improve the response of the paper feed operation performed by the pick-up roller B201 and the press plate B202, i.e., to make it possible to start the paper feed operation quickly when it is to be started, a construction is employed in which the pick-up roller B201 is kept rotating even when paper feed is not performed and in which the press plate B202 and the pick-up roller B201 stand by in standby positions closer to the medium pack C100 than the initial position. The pick-up roller B201 and the medium pack C100 are held at the standby positions by the following holding mechanism.

The holding mechanism has a roller holding portion for holding the pick-up roller B201 and a press plate holding portion for holding the swinging of the press plate B202. The roller holding portion is comprised of a second holding claw B229 integrally protruding from the roller arm B203 and a first holding claw B228 provided on an ASF trigger B209 to be described later which can be engaged with the second holding claw B229. The press plate holding portion is comprised of a third holding claw B230 integrally protruding from the press plate supporting arm B226 and a fourth holding claw B231 formed on the ASF trigger B209 which can be engaged with the third holding claw B230. The first and fourth holding claws integrally protrude from the ASF trigger B209 slidably provided on the bottom of the chassis B101. The ASF trigger B209 is formed with two slots B209*a* into which guide pins B101P protruding from the chassis B101 are inserted, and the ASF trigger B209 can move in both of directions a and b within the range of the slots B209*a* (see FIG. 21). The ASF trigger B209 is normally urged in the direction b by an urging force of an urging spring B103*b* and, in its initial position reached by the maximum movement in the direction b (see FIG. 22), the first holding claw B228 and the third holding claw B230 protruding from the ASF trigger B209 are in positions in which they can be engaged with the second holding claw B229 and the fourth holding claw B231, respectively.

When the first holding claw B228 and the second holding claw B229 are in the held state, the roller arms B203 are held in a holding position (see FIG. 26) between the initial position and the paper feed position and are prevented from moving further toward the paper feed position. When the third holding claw B230 and the fourth holding claw B231 are in the held state, the press plate B202 is held in a holding position between the initial position and the paper feed position and is prevented from moving further toward the paper feed position.

Operations of the paper-feed and transport mechanism in the present embodiment having the above-described construction will now be described.

Figure 21:
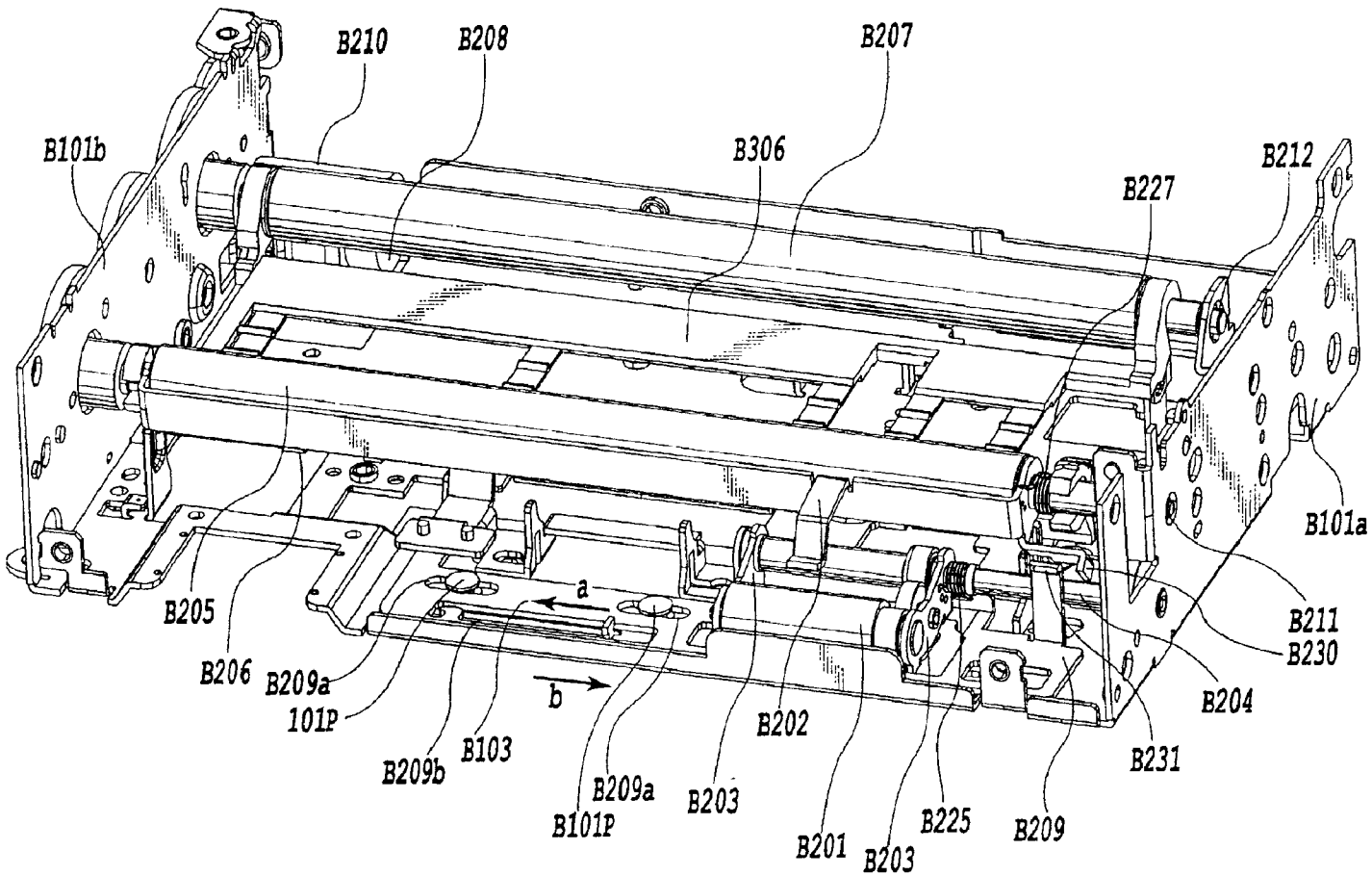
FIG. 21 is a perspective view of the printer main body and, in particular, a state of a mechanism for feeding paper at a portion to be connected with the medium pack after the pack is attached.
Figure 22:
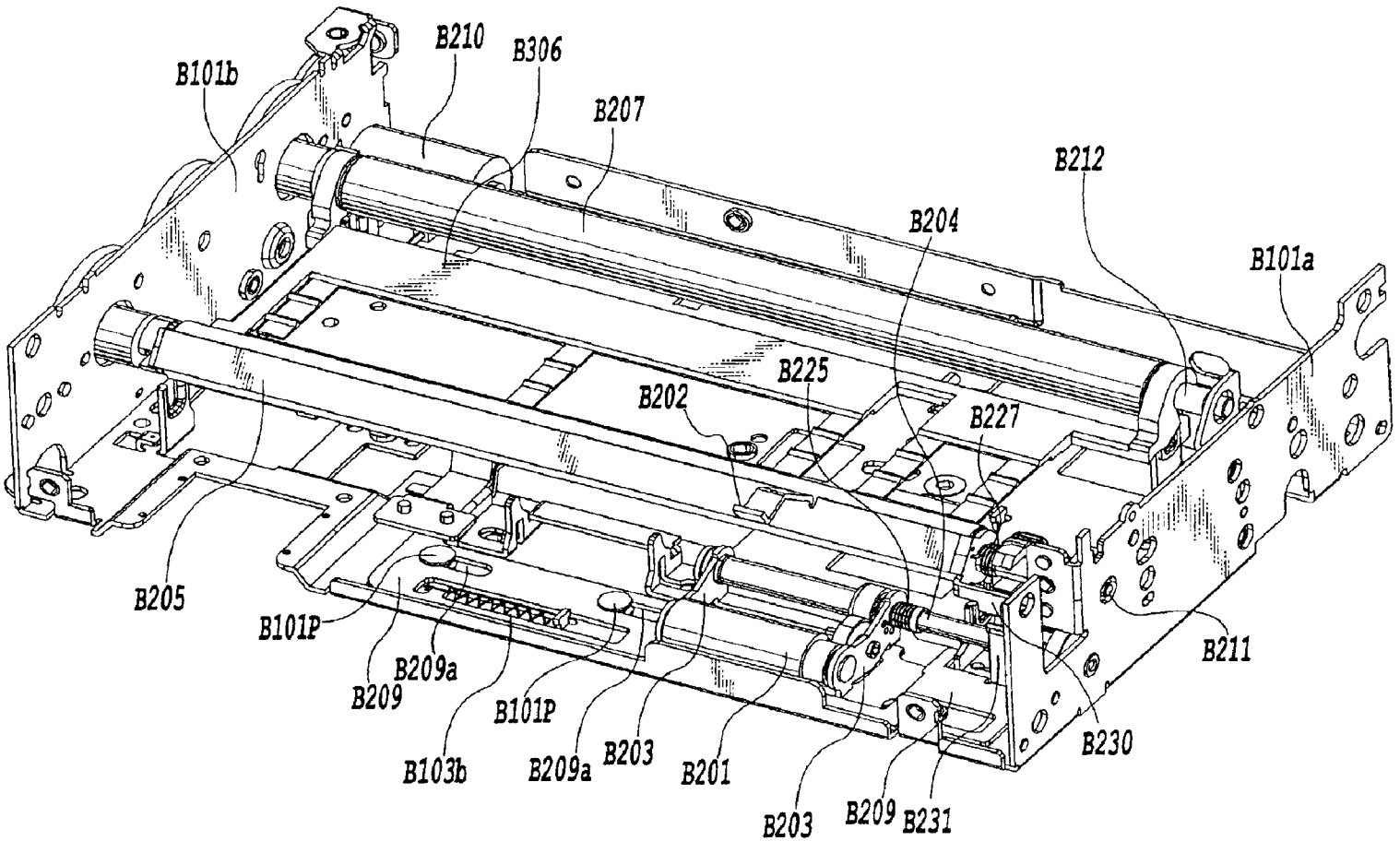
FIG. 22 is a perspective view of a state of the mechanism for feeding paper before the pack is attached.

When the medium pack C100 is attached to the printer main body B100, the shutter portion is engaged with the printer main body B100 to be put in an open state, and the lowermost printing medium among the printing media contained in the medium pack C100 is thus exposed. In the initial phase when no recording operation is performed with the medium pack C100 thus attached, the ASF trigger B209 has been urged by the urging force of the urging spring B209*b* in the direction b and is held in the rightmost position. In the initial phase, the press plate B202 is kept furthest from the uppermost printing medium or the press sheet C102 in the medium pack (see FIG. 25), and the pick-up roller B201 is kept furthest from the lowermost printing medium in the medium pack (see FIG. 25). Then, the switching lead screw B410 provided in the supply and recovering system mechanism rotates, and a pump slider B441 to be described later moves a predetermined distance in the direction a according to the rotation, the pump slider B441 contacting the ASF trigger B209 consequently. When the pump slider B441 thereafter continues moving in the direction a, the ASF trigger B209 is pushed by the pump slider B441 to move in the direction a against the urging force of the urging spring B209*b* as shown in FIG. 21.

Since the LF motor B210 is concurrently driven counterclockwise, the rotating shaft B211 rotates in the direction x1 (the direction in which the printing medium is carried) with the upstream PF roller B205, and the ASF connecting shaft B204 is also rotated through the PF roller gear B219 and the ASF large-diameter gear B220. As a result, the press plate B202 swings along with the rotating shaft B211 due to the intervention of the coupling spring B227, and the roller arms B203 also swing along with the ASF connecting shaft B204 due to the intervention of the coupling spring B225. However, since the ASF trigger B209 is in the initial position immediately after the driving of the LF motor B210 is started, the first holding claw B228 and the third holding claw B230 are respectively held by the second holding claw B229 and the fourth holding claw B231 in this state, and the press plate B202 and the pick-up roller B201 are held in the standby position and the initial position, respectively (see FIGS. 26 and 28A). In such a state in which the holding claws are held by each other, a reduction occurs in both of the frictional force between the wound portion B227*a* of the coupling spring B227 and the rotating shaft B211 and the frictional force between the wound portion B225*a* of the coupling spring B225 and the ASF connecting shaft B204, which causes each of the rotating shaft B211 and the ASF connecting shaft B204 to slidingly rotate. Therefore, the pick-up roller B201 is rotated along with the rotating shaft B224 by the paper feed system gear train.

When the ASF trigger B209 moves in the direction a as a result of the movement of the pump slider B441, the third holding claw B230 and the fourth holding claw B231 are disengaged, and the press plate supporting arm B226 swingingly moves around the rotating shaft B211 because of the slide frictional force between the coupling spring B227 and the rotating shaft B211. Thus, the press plate B202 is inserted into the opening for the pressing portion formed on the medium pack C100 to press the uppermost printing medium contained therein via the press sheet C102. As a result, the lowermost printing medium is pressed against the inner bottom of the medium pack C100 with an adequate pressing force and is thus prevented from rising (see FIG. 28B).

When the ASF trigger B209 moves further in the direction a, the first holding claw B228 and the second holding claw B229 are also disengaged, and the roller arms B203 swingingly move around the ASF connecting shaft B204. As a result, the pick-up roller B201 contacts the bottom surface of the lowermost printing medium in the medium pack C100 through the opening of the medium pack C100. At this time, a pressing force F1 applied to the printing media by the press plate B202 is set greater than a pressing force F2 applied by the pick-up roller B201 (see FIG. 28B), and this eliminates the problem in that the printing media are pushed up when the pick-up roller B201 contacts the printing media. In the present embodiment, the force applied to the printing media by the press plate B202 or pick-up roller B201 is generated by the frictional force generated between the coupling spring B225 and the ASF connecting shaft B204 and the frictional force generated between the coupling spring B227 and the rotating shaft B211. Therefore, a stable pressure can be always applied to the printing medium regardless of the quantity or thickness of the printing media contained in the medium pack C100, which makes it possible to feed the printing media reliably, one by one.

The position of the leading end of a printing medium fed from the medium pack C100 can be detected with a paper end detection sensor (PE sensor) which is not shown, and the rotation of the LF motor B210 is stopped when the leading end protrudes downstream in the transporting direction X1' (see FIG. 27) from the position of the pick-up roller B201 by a predetermined amount. When the LF motor B210 is thereafter rotated clockwise and, in conjunction with this, both of the press plate B202 and the pick-up roller B201 return to the initial positions in which they are spaced from the medium pack C100. The returning to the initial positions can be performed by causing a reverse rotation of the LF motor B210 as indicated by the arrow x2 until the press plate supporting arm B226 and the roller arms B203 are held by predetermined stoppers for setting the initial positions, and the rotation of the LF motor B210 is stopped when they return to the initial positions.

As a result of the reverse rotation of the LF motor B210, the printing medium fed from the medium pack C100 is transported in reverse (transported in the direction x2'). The feeding amount of the printing media during paper feeding is preset such that a printing medium exists between the PF roller B205 and the pinch roller B206 even when reverse transportation occurs.

The reason is that when the feeding amount is small, the printing medium comes out from the gap between the PF roller B205 and the pinch roller B206 as a result of the reverse operation to disable a subsequent transport operation.

When the pump motor B104 further rotates to move the pump slider B441 up to the edge of the switching lead screw B410, since the switching lead screw B410 has cross-type lead grooves, the pump slider B441 changes the moving direction to move to its initial position. As a result, the ASF trigger B209 is moved by the urging force of the urging spring B209*b* in the direction b shown in FIG. 21 to return to the initial position where the engagement can be established between the holding claws B228 and B229 and between the holding claws B230 and B231. Thereafter, a recording operation is performed in accordance with the scanning of the carriage B301. At this time, since the roller arms B203 and the press plate supporting arm B226 are both prevented from swinging by the engagement between the first holding claw B228 and the second holding claw B229 and the engagement between the third holding claw B230 and the fourth holding claw B231, the paper feed operation is not performed by the pick-up roller B201.

In the above description, the press plate B202 and the pick-up roller B201 are held in the standby positions with the holding mechanism, and the press plate B202 and the pick-up roller B201 are pressed against the medium pack C100 in that order when the ASF trigger B209 is driven. However, it is also possible to press the pick-up roller B201 and the press plate B202 against the recording media simultaneously or to set the order of pressing in reverse. Instead of holding the pick-up roller B201 and the press plate B202 in intermediate positions such as the standby positions described above, the pick-up roller B201 may be moved from a predetermined initial position to the pressing position without stopping it at the standby position in accordance with a feed start command or the like, and the invention is not limited to the above embodiment.

3.2: Carriage Movement Mechanism

Since the carriage B301 in the present embodiment carries the ink chambers capable of containing only a small amount of ink sufficient for about one sheet of paper, there is a need for replenishing ink from the medium pack C100 frequently, and the capability of performing the replenishing operation adequately is an important factor in performing a recording operation.

A coupling mechanism as shown in FIGS. 29 to 35C is used as a structure to allow ink to be reliably supplied and received without leakage during an ink replenishing operation.

Figure 36:
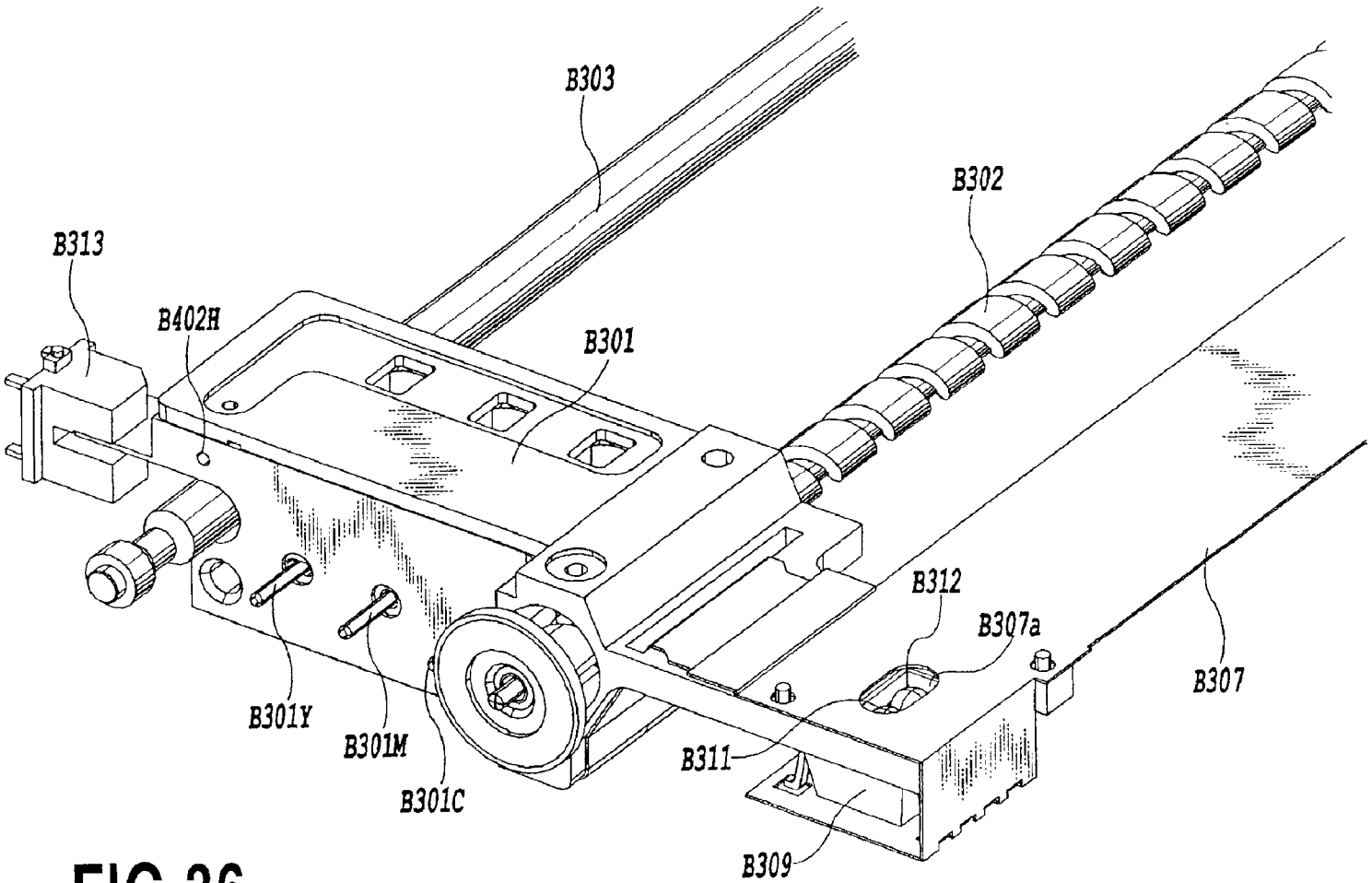
FIG. 36 is a perspective view of the printer main body showing, in particular, a structure associated with an encoder sensor integrally attached to the carriage.
Figure 37:
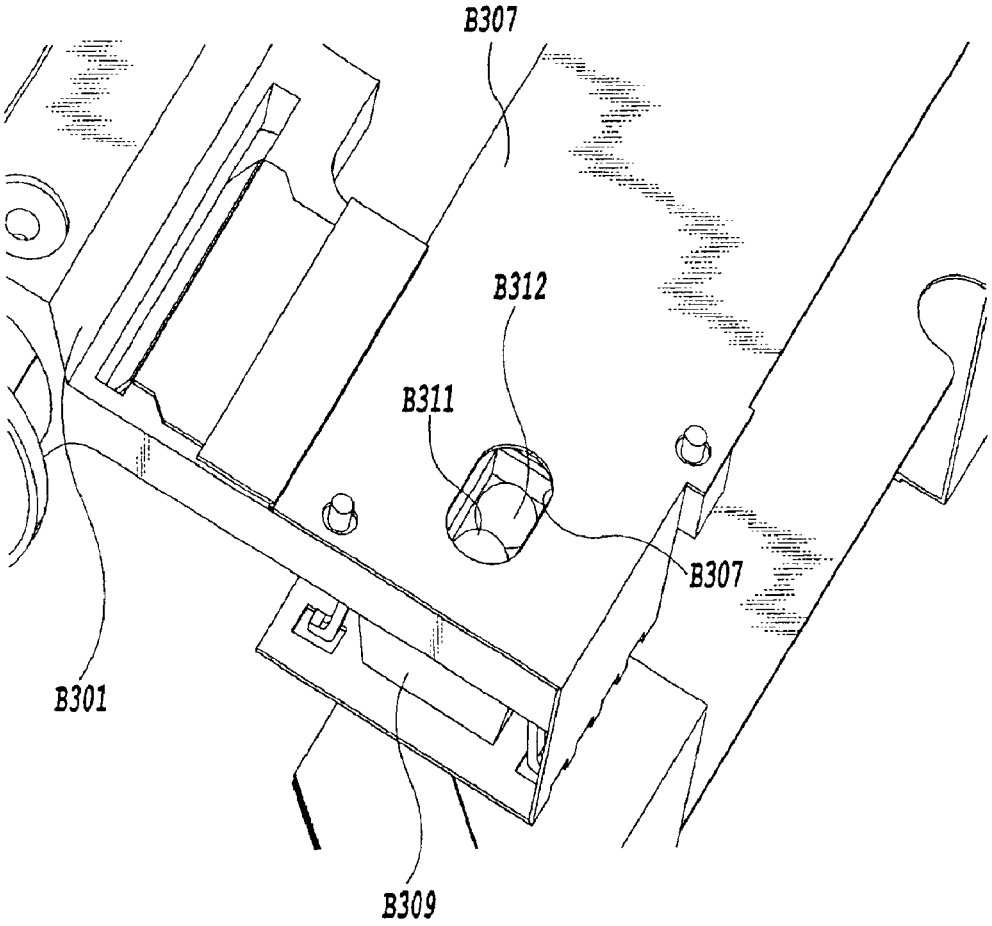
FIG. 37 illustrates a light-emitting element and a light-receiving element of the encoder sensor.
Figure 38:
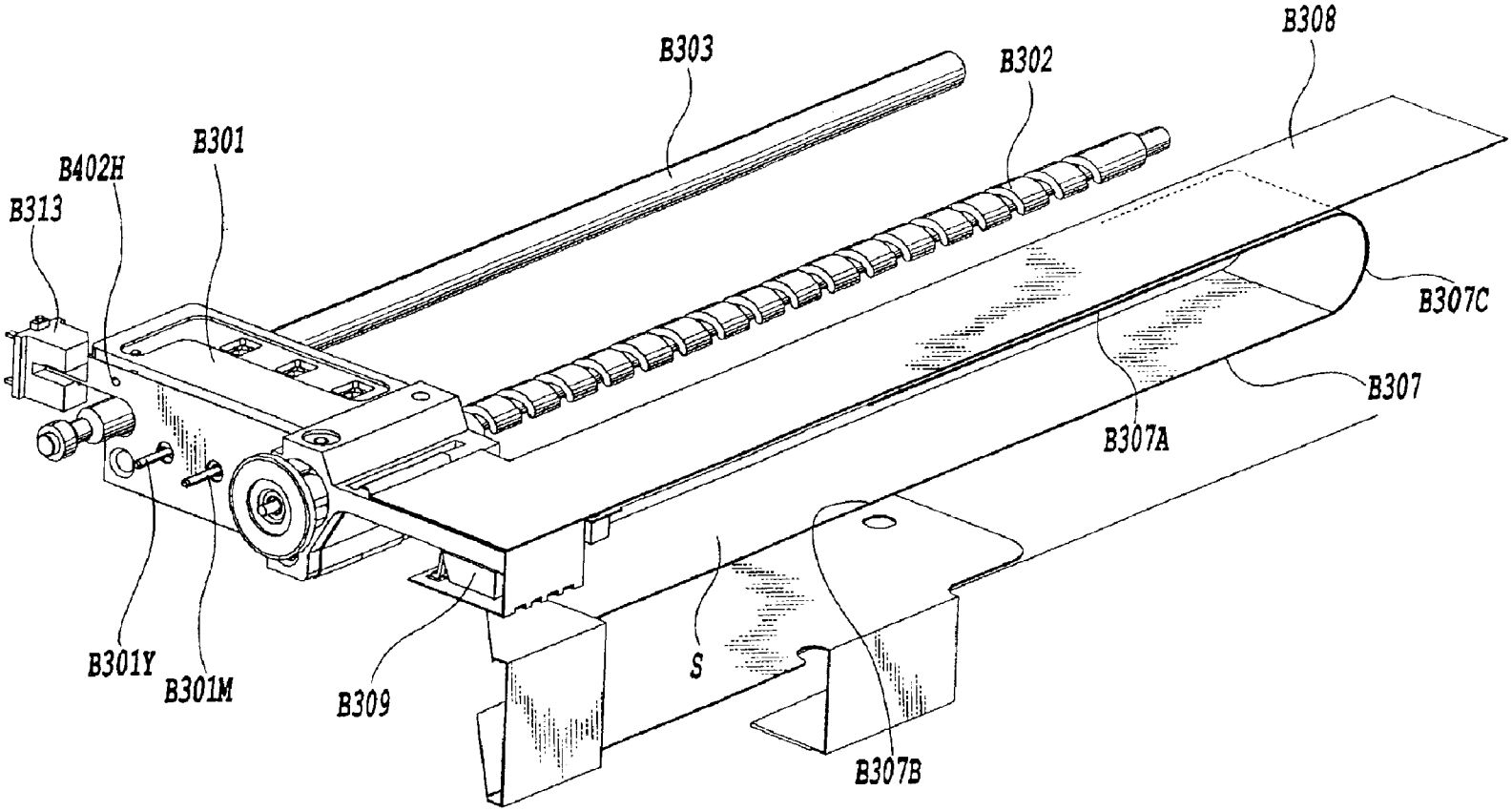
FIG. 38 illustrates a relationship between a flexible substrate connected to the carriage and the encoder and an encoder scale.

The illustrated coupling mechanism includes the joint member B401 provided in the vicinity of a home position of the carriage B301, the hollow ink replenishing needles B301Y, B301M and B301C (see FIGS. 30, 31 and 36) protruding from sides of the respective ink chambers B304Y, B304M and B304C, and an air suction hole B301H (see FIGS. 36 and 38). On a side of the joint member B401, the joints B402Y, B402M and B402C into which the ink replenishing needles B301Y, B301M and B301C of the carriage B301 can be inserted while maintaining a sealed state are formed in association with the respective ink replenishing needles B301Y, B301M and B301C. The joints B402Y, B402M and B402C form one end of the communication passages in communication with the ink packs C130 in the medium pack C100 attached to the printer main body B100. A replenishing operation can be performed by inserting the ink replenishing needles B301Y, B301M and B301C into the joints, operating a recovery system mechanism to be described later to elevate the cap B405 to cover the ejecting surfaces of the recording heads 305Y, 305M and 305C with the air suction hole B301H kept in the sealed state, and thereafter driving the pump motor B104 in the absorbing direction to generate a negative pressure in the air suction hole B301H, thereby putting the interior of the ink chambers of the carriage B301 under the negative pressure through the porous film.

A description will now be made with reference to FIGS. 29 to 35C on the operation of connecting the ink replenishing needles B301 with the joint member B401 and the operation of sealing the air suction cap B403 and the air suction hole 301H.

Figure 29:
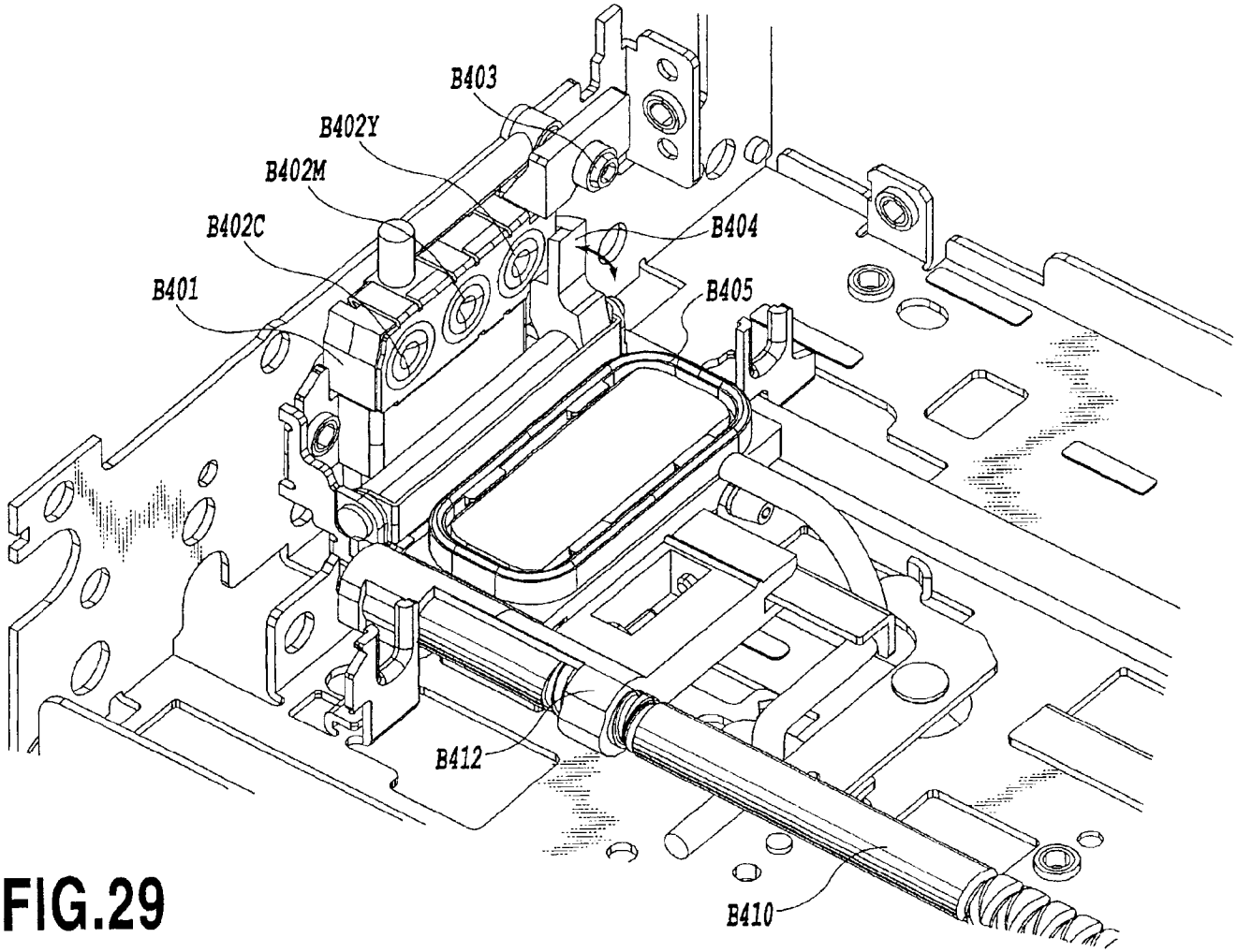
FIG. 29 is an illustration of the printer main body showing, in particular, a joint member which is connected with a carriage to replenish ink chambers on the carriage with ink.
Figure 30:
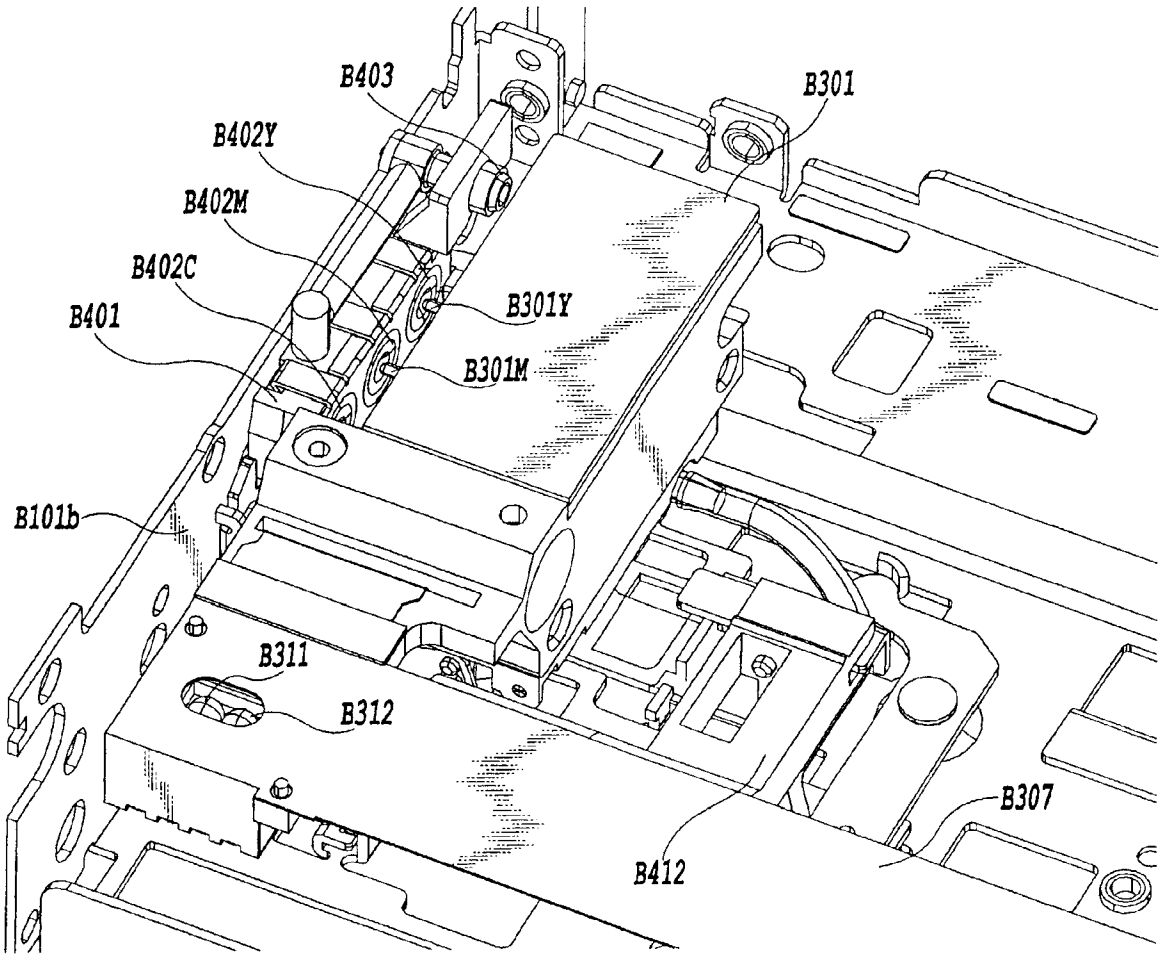
FIG. 30 is a perspective view showing a state before ink supplying needles of the carriage are inserted into the joint member.
Figure 31:
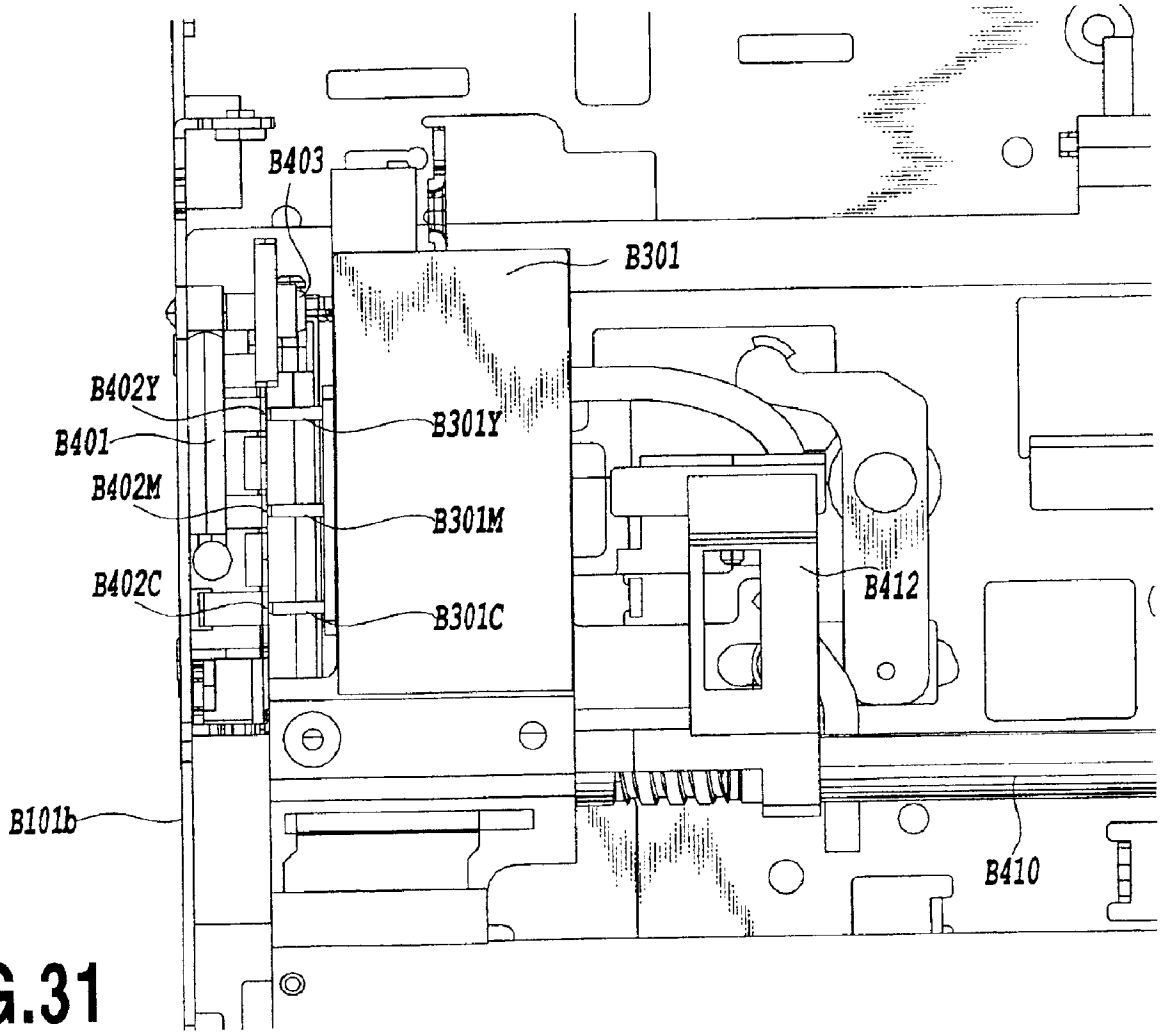
FIG. 31 is a plan view in the sate shown in FIG. 30.
Figure 32:
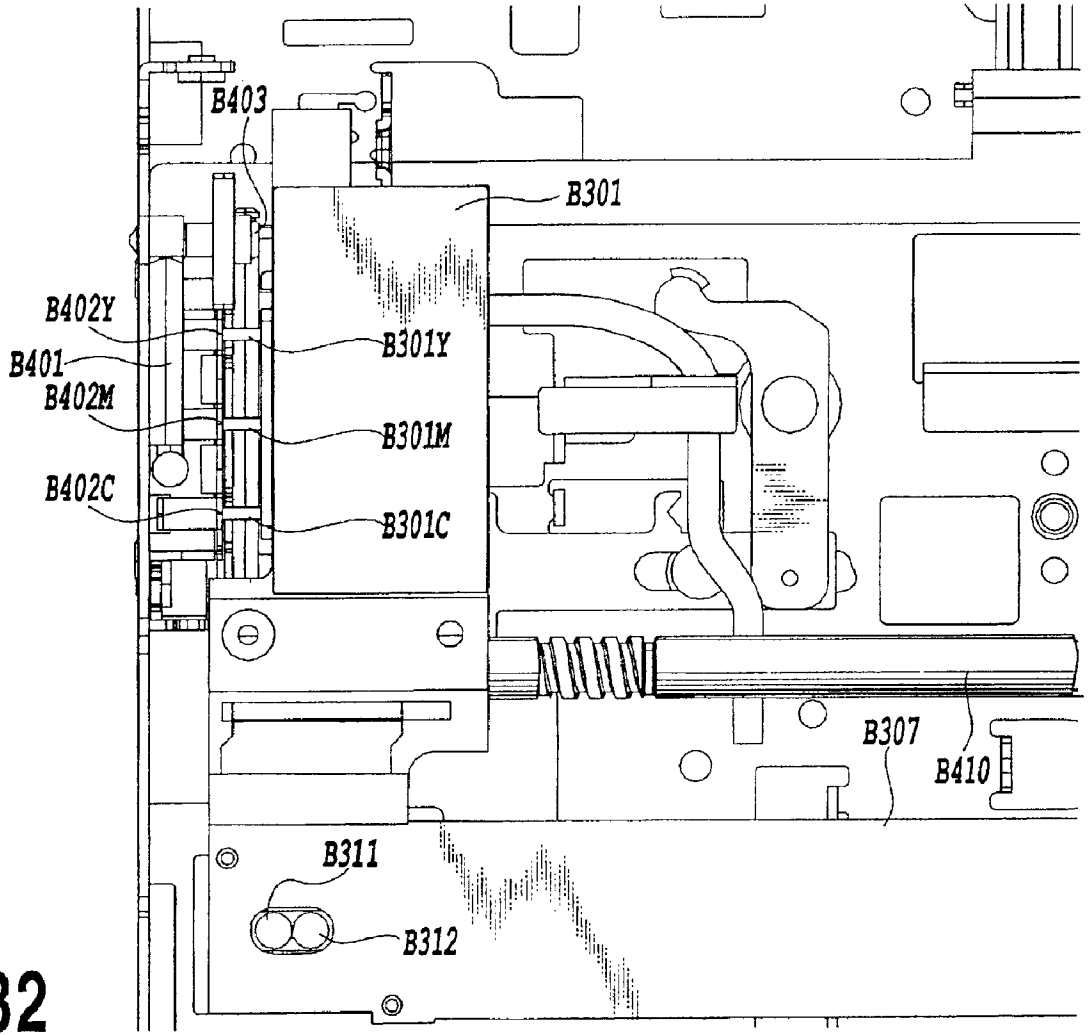
FIG. 32 illustrates a state in which the carriage has further moved from the states shown in FIGS. 30 and 31 to insert the ink supplying needles of the carriage.
Figure 33:
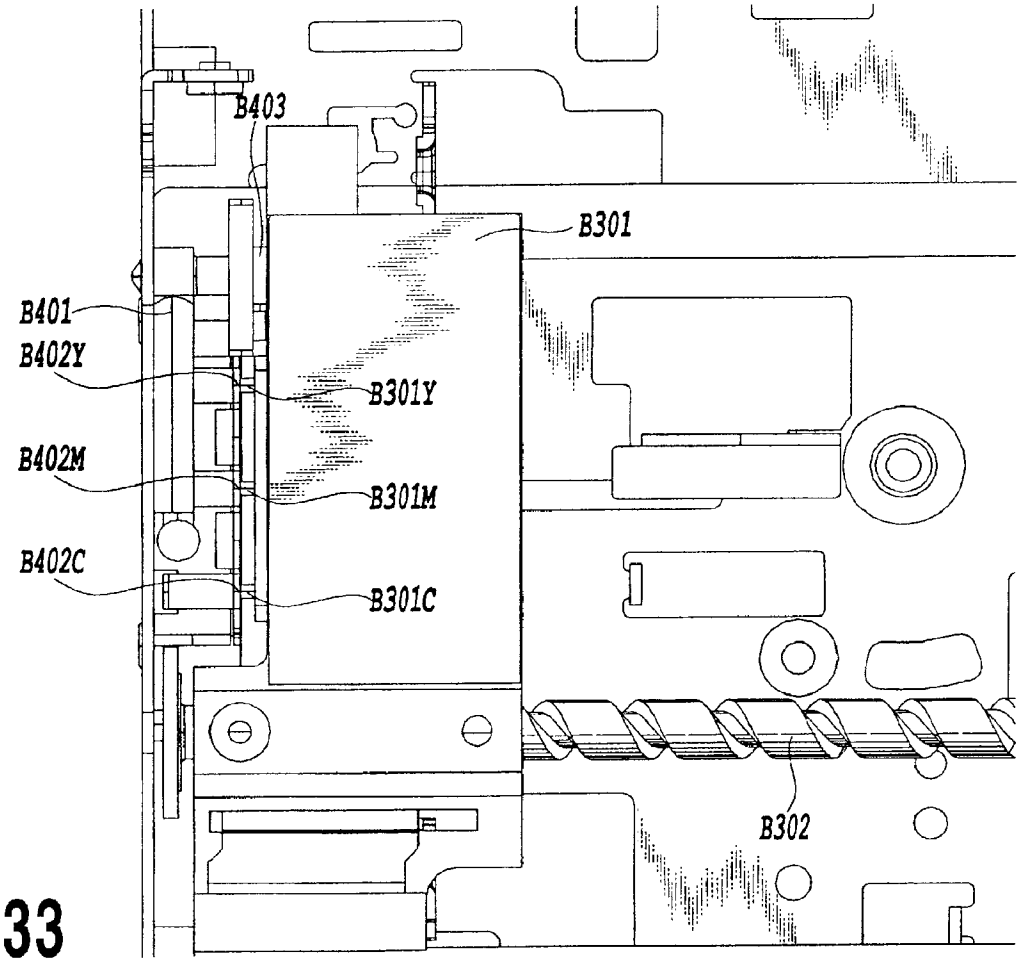
FIG. 33 illustrates a state in which the carriage has further moved from the state shown in FIG. 32 to put an air suction hole in contact with an air suction cap of the joint member.
Figure 34:
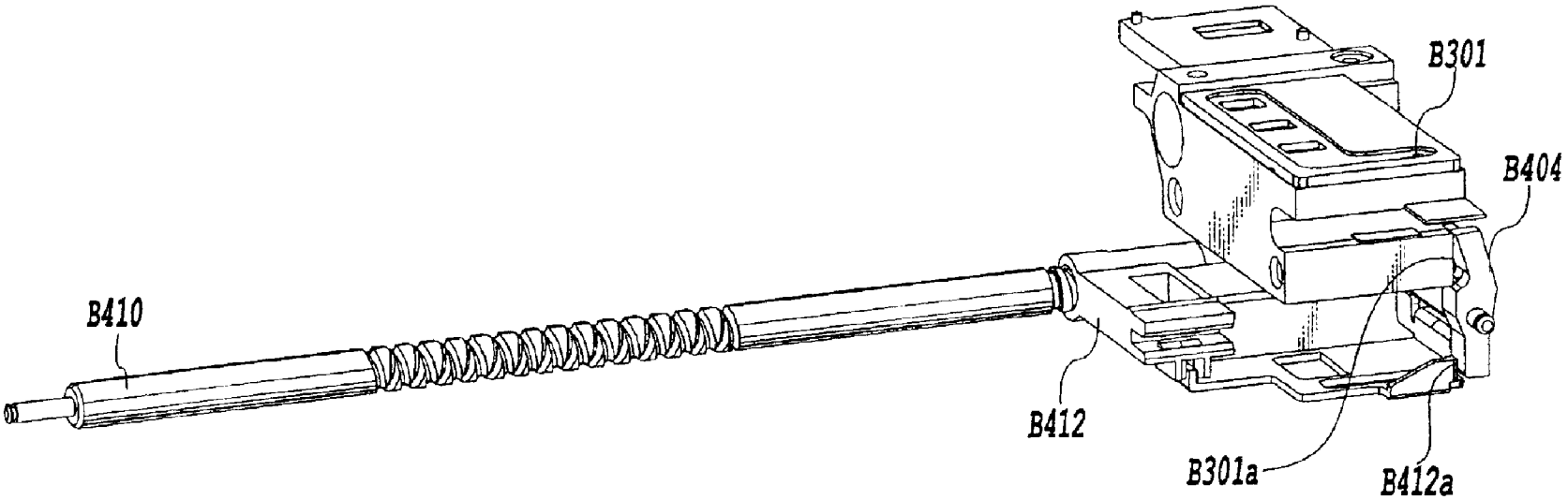
FIG. 34 illustrates a construction for disconnecting the carriage after the carriage and the joint member are connected.

FIG. 29 shows a state before the carriage B301 returns to the home position. In this state, the switching slider B412 is located furthest from the joints B402Y, B402M and B402C, and a removing lever B404 is in a rotatable state at this time. When the carriage B301 moves toward the home position in this state, as shown in FIGS. 30 and 31, the three ink replenishing needles B301Y, B301M and B301C first reach the respective joints B402Y, B402M and B402C, and the ink replenishing needles B301Y, B301M and B301C are thereafter inserted into the joints B402Y, B402M and B402C (see FIG. 32) by moving in the same direction further (leftward in the figure). In such a phase when the insertion of the ink replenishing needles B301Y, B301M and B301C has just been started, the surface formed with the air suction hole B301H has not contacted the air suction cap B403 yet, and a gap therefore exists. When the ink replenishing needles B301Y, B301M and B301C are thereafter inserted into the joints B402Y, B402M and B402C further, the surface formed with the air suction hole B301H comes into contact with the air suction cap B403, and a further movement of the carriage B301 causes the air suction cap B403 to tightly contact with the region surrounding the air suction hole B301H while being flexed, whereby the air suction hole B402H and the air suction cap B403 are connected in an air-tight state.

Thus, in the present embodiment, the three ink replenishing needles B301Y, B301M and B301C and the joints B402Y, B402M and B402C are connected first, and the air suction hole B402H and the air suction cap B403 are thereafter connected. Since there is a time difference between the connecting operations, the load required for the connection can be distributed-between the operations unlike that for connecting operations performed simultaneously, which makes it possible to perform both connecting operations sufficiently without providing the CR motor B310 with great driving torque. In addition, in the present embodiment, since a greater load is required to connect the ink replenishing needles B301Y, B301M and B301C and the joints B402Y, B402M and B402C, the ink replenishing needles B301Y, B301M and B301C and the joints B402Y, B402M and B402C are first connected in a state in which a sufficient force of inertia of the carriage B301 can be obtained, and the connection between the air suction hole B402H and the air suction cap B403 that can be completed with relatively small torque is thereafter performed. However, load distribution can be advantageously achieved unlike simultaneous connecting operations also by connecting the air suction cap B403 and the air suction hole B402H first and by connecting the ink replenishing needles B301Y, B301M and B301C and the joints B402Y, B402M and B402C thereafter.

In the present embodiment, the air suction cap B403 is constituted by a member having elasticity such as rubber, and it also functions as a cushioning member for receiving the force of inertia of the carriage B301 during a movement by taking advantage of the elastic force, which makes it possible to prevent damage on the carriage B301.

When the ink replenishing needles B301Y, B301M and B301C are removed from the joints B402Y, B402M and B402C after the ink chambers carried by the carriage B301 are completely replenished with inks, there is resistance which applies a great load to the CR motor B310. In order to reduce the load associated with the starting of the CR motor B310, the present embodiment is configured so as to utilize the driving force of the pump motor B104.

Figure 35A:
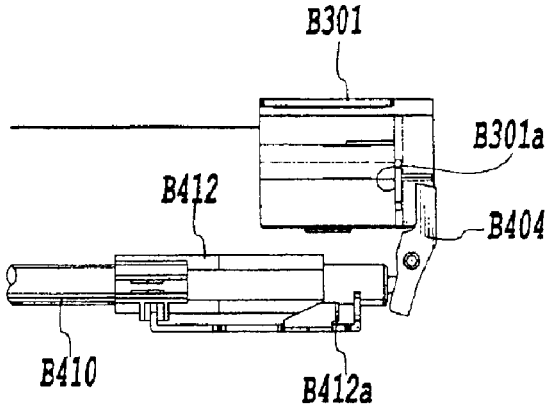
FIGS. 35A, 35B and 35C are illustrations for explaining the construction for disconnecting the carriage showing, in particular, an operation of a removing lever.
Figure 35B:
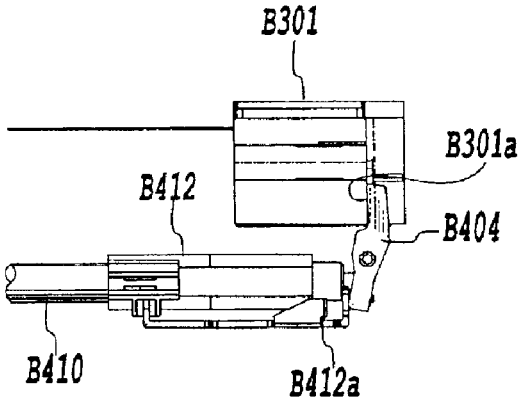
Figure 35C:
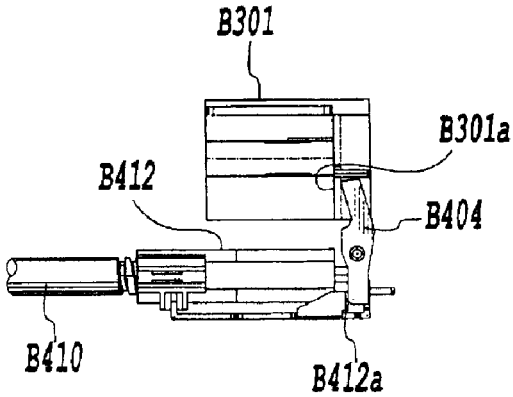

Specifically, when the carriage B301 is started, the pump motor B104 for driving a recovery system to be described later drives the switching slider B412 for a movement toward the home position of the carriage B301 (rightward in FIGS. 35A to 35C). A lower end of the removing lever B404 which is mounted through a shaft substantially in the middle thereof (see FIGS. 34 and 35A to 35C) is located in the moving path of the switching slider B412. When a contact portion B412*a* of the switching slider B412 contacts the lower end, the removing lever B404 rotates counterclockwise in the figures about the shaft-mount portion in the middle thereof, and an upper end of the lever moves leftward in FIGS. 35A to 35C. As a result, the upper end of the removing lever B404 contacts an end face of the carriage B301 (see FIG. 35B). When the removing lever B404 further rotates counterclockwise as a result of a further movement of the switching slider B412 to the right side of the figure, the upper end of the lever B404 presses the carriage B301 such that it causes the ink replenishing needles B301Y, B301M and B301C to move in the direction of removing them from the joints B402Y, B402M and B402C (to the left side). The pressing force is added to the driving force applied from the CR motor B310 to the carriage B301. This allows the carriage B301 to be started smoothly and allows the ink replenishing needles B301Y, B301M and B301C to be reliably removed from the joints B402Y, B402M and B402C. Therefore, the present embodiment eliminates the need for increasing the size of the CR motor B310 and therefore makes it possible to avoid any increase in the cost and installation space of the same.

In the present embodiment, a combination of an encoder sensor connected to a flexible substrate and a scale is used as a detection unit for detecting the moving position of the carriage B301.

FIG. 36 specifically shows the unit for detecting the position of the carriage B301.

An encoder sensor B309 has a light-emitting portion B312 and a light-receiving portion B311 provided side by side with respective light-emitting surface and light-receiving surface facing upward, and it is secured to a side of the carriage B301. One end of a flexible substrate B307 is secured to a top surface of the encoder sensor B309 and is electrically connected to the light-emitting portion B312 and the light-receiving portion B311. The substrate is formed with a hole B307*a* in a position thereon facing the light-emitting surface and light-receiving surface of the encoder sensor B309. Light emitted by the light-emitting portion B312 of the encoder sensor B309 is directed to a scale B308 provided above the same through the hole B307*a*, and light reflected by the scale B308 is received by the light-receiving portion B311 through the hole B307*a*. Since light-reflecting portions and non-reflecting portions are intermittently formed on the scale B308, signals in the form of pulses are intermittently transmitted from the encoder sensor B309 moving with the carriage B301. Therefore, the moving position of the carriage B301 can be detected by counting the signals in the form of pulses at a control system. A count starting position for the carriage B301 may be set in various ways. In this case, a CR sensor B313 is provided as shown in FIGS. 36 and 38; the home position of the carriage B301 is detected by the CR sensor B313; and the home position is used as a count starting position for one scan of the carriage B301.

The flexible substrate B307 is formed such that it is flexed in a U-shaped configuration as shown in FIG. 38 as the carriage B301 moves, and the present embodiment is similar to a normal printer in this point. In a normal printer, however, a space S between an upper portion B307A and a lower portion B307B of a flexible substrate B307 flexed in a U-shaped configuration has been regarded as a space in which no member can be provided because a bent portion 307C of the flexible substrate B307 moves in the space S along with the carriage B301. That is, the space S between the upper portion B307A and the lower portion B307B of the flexible substrate B307 has not been used at all for a member other than the flexible substrate B307. On the contrary, in the present embodiment, since there is provided the encoder sensor B309 which moves with the carriage B301 and the bent portion B307C of the flexible substrate B307, there is no interference with the bent portion B307C of the flexible substrate B307. Since the present embodiment thus makes it possible to utilize a space that has been regarded unusable effectively to install the encoder sensor B309 which is relatively large, the installation space can be significantly smaller than that of a normal recording apparatus.

In addition, in the present embodiment, in order to configure the printer main body B100 with a low profile, the top surface of the carriage B301 is set slightly lower than the top surface of the chassis B101, which provides a configuration in which even when a plate-like outer casing material is secured on the top surface of the chassis B101, it forms substantially no gap with the carriage B301. Thus, it is very much advantageous in achieving such a low profile to employ a configuration and structure in which the encoder sensor B309 does not protrude above the carriage B301.

3.3: Ink Supply and Recovery Mechanism

In cylinder pump B408, which is a main component of such a pump unit, in the present embodiment, as shown in FIG. 20, a piston B421 slidably moving in the cylinder B431 of the pump has an elliptical cross section. Accordingly, the cross section of the cylinder B431, which is also used as an external case of the cylinder pump B408, is also nearly elliptical.

Because the cross section of the piston of the pump is elliptical, when the pump is disposed in the printer, its height can be suppressed, which contributes to a reduced height of the entire printer. For example, as compared with the case of using a piston with a circular cross section of the same height in the disposed state, the elliptical cross section can provide a greater cross sectional area of the cylinder, which provides a shorter stroke, thereby providing a smaller size in the pump height and longitudinal direction. As described above, when the installation space of the pump in the printer has a room to some extent in the longitudinal direction of the ellipse, or when suppression of the printer height is preferential from the design, as in the present embodiment, it is effective that the cross sectional shape of the piston is made elliptical, and accordingly the cross sectional shape of the cylinder is made elliptical.

In particular, as in the present embodiment, in the case of the printer integral with a camera, it is effective because the printer height is limited. Specifically, as shown in FIG. 20, the printer section B100, from the requirement of integrally assembling with a camera, has a substantially rectangular cross section. On the other hand, the cylinder pump B408 and its drive mechanism and the like are substantially required to be disposed in the lower half of the printer section B100, that is, in the lower side of the transportation path of the printing medium. Therefore, the elliptical cross sectional shape in the present embodiment is preferable because the height of the cylinder pump B408 is a height to be under the side of the transportation path and the cross sectional area inside the cylinder is ensured to obtain an effective suction force with a limited stroke.

Further, when considering gas-tightness of the piston to the cylinder, the elliptical shape is advantageous for applying a uniform pressure to the inner surface of the cylinder as compared to, for example, one which includes a straight part in the cross sectional shape.

As can be seen from the above description, the cross sectional shape of the piston is not necessarily required to be elliptical. A flattened shape with a suppressed height of one side can provide the above desired function. Preferably it is one which does not include a straight part in the shape in view of sealing with the cylinder.

Figure 39:
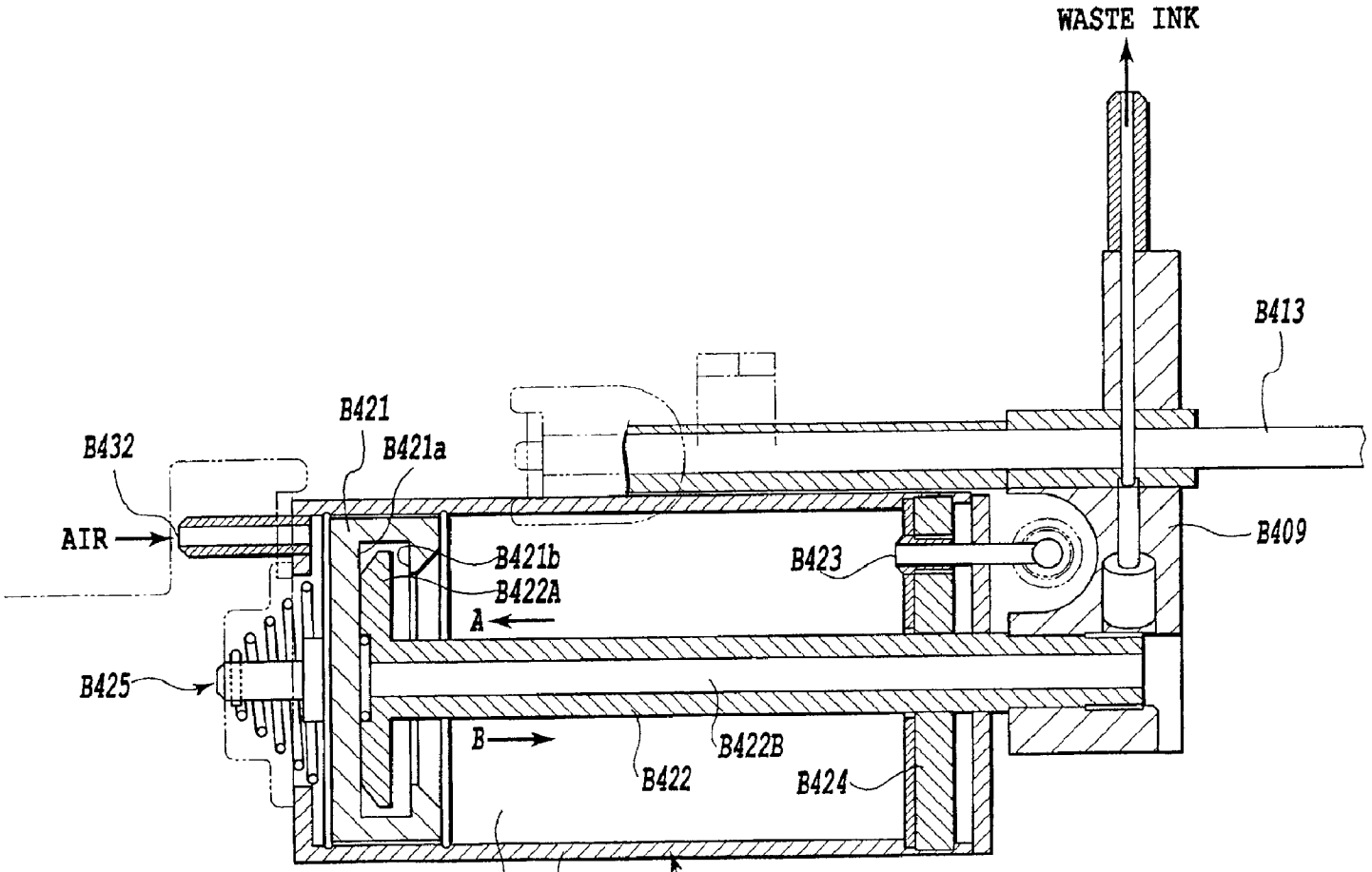
FIG. 39 is a vertical sectional view showing a structure of a pump used in the printer main body of the embodiment.

The cylinder pump B408, as will be described later, according to a predetermined rotation of the lead screw B410, is a generation source of pressure for ink supply to respective ink chambers B304Y, B304M and B304C on the carriage B301 and ink suction through the suction cap B405. FIG. 39 is a diagram showing internal structure of the cylinder pump B408 for this purpose.

As shown in FIG. 39, the cylinder pump B408, as main elements, comprises a cylinder main body B431, a piston B421 and a piston shaft B422. The cylinder main body B431, as described above, also comprises a case as an outer shape of the cylinder pump B408, which is fixed to the printer. On the other hand, the piston shaft B422 is connected with a pump driving arm B409 whereby the piston B421 can move in the cylinder B431 according to the rotation of the lead screw B410.

The piston B421 is engaged with the inner wall of the cylinder main body B431 through an O-ring provided at its end. This makes the parts (air suction chamber and ink suction chamber) partitioned by the piston B421 of the cylinder inside B431*a* non-communicational with each other and slidable with the inner wall.

The piston shaft B422 has a valve B422A formed at its one end, and has a hollow part B422B extending in the axial direction. The valve B422A, according to the movement of the piston shaft B422, can move freely in the inner space formed inside the piston B421. According to this movement, when the sealing part formed of a flexible material such as rubber closely contacts with the inner upper surface B421*a* of the inner space so as to surround the opening of the hollow part B422B above the valve B422A, the hollow part B422B of the piston shaft B422 and the cylinder inside B431*a* (ink suction chamber) can be made non-communicational with each other and air-tight. On the other hand, when the valve B422A contacts against the inner lower surface B421*b* of the inner space, the hollow part B422B of the piston shaft B422 and the cylinder inside (ink suction chamber) 531*a* are communicational through a groove (not shown) formed on the lower surface of the valve B422A.

At the upper end (left side in the figure) of the cylinder B431, an air introduction opening B432 is formed. The air introduction opening B432 communicates with the air suction cap B403 of the joint member B401 shown in FIG. 19, whereby at the time when ink is supplied from the medium pack C100 to respective ink chamber of the carriage B301, air suction can be performed. Further, at the upper end of the cylinder main body B431, a pressure adjusting valve mechanism B425 is provided. The pressure adjusting valve enables adjustment of a pressing force by its spring. When the negative pressure of the cylinder interior (air suction chamber) B431*a* between the cylinder main body B431 and the piston B421 becomes a magnitude corresponding to the adjusted pressing force (when the pressure decreases to the corresponding value), the valve opens and, as a result, the negative pressure is adjusted to a constant value. By this operation, the above air suction can be performed at a consistent negative pressure.

On the other hand, at the lower end (right side in figure) of the cylinder B431, a sealing member B424 is provided. The sealing member B424 enables making the cylinder interior B431*a* into an air-tight state to the outside and is slidable with the piston shaft B422B while keeping the same air-tightness. The sealing member B424 is provided with an ink introduction opening B423, which communicates with the cap B405 shown in FIG. 19. This makes it possible to introduce waste ink sucked through the cap B405 to the interior of the cylinder (ink suction chamber) B431*a*. In this communication passage, a check valve (not shown) is provided, whereby ink from the suction cap B405 is passed and, to the contrary, ink flow discharged from the cylinder interior (ink suction chamber) B431*a* can be blocked.

With the above construction, when ink is supplied from the respective ink pack in the medium pack C100 to respective ink reserving section of the sub-tank B400 on the carriage B301, by predetermined rotation of the lead screw B410, the piston B421 moves downward (in the direction of arrow B in FIG. 39), so as to generate a negative pressure in the cylinder interior B431*a* (air suction chamber). By this negative pressure, air is sucked from the respective ink reserving section of the sub-tank B400 on the carriage B301 communicating with the cylinder inside (air suction chamber) B431*a* through the suction joint B302 and the like, thereby making the inside of the respective ink reserving section negative pressure and introducing ink from the respective ink pack to the respective ink reserving section. At this time, only air passes through the above porous film B402, and ink passage is blocked. When the introduced ink reaches the porous film, further suction is not performed due to a pressure balance or the like.

During the downward movement of the piston B421 in the cylinder main body B431, waste ink sucked through the suction cap B405 in the previous process to the cylinder interior (ink suction chamber) B431*a* once flows to the upper side of the valve B422A through a groove formed on the lower surface of the valve B422A, and then discharged through the hollow part B422B of the piston shaft B422. The discharged waste ink is passed through the inside passage and the like of the pump driving arm B409, and finally to the waste ink absorption body C107 in the medium pack C100.

On the other hand, in the suction recovery operation, by predetermined rotation of the lead screw B410, the piston B421 moves up in the direction of arrow A in FIG. 39 in the cylinder. By this operation, a negative pressure is generated in the cylinder interior (ink suction chamber) B431*a*, so that the inside of the suction cap B405 connecting with it and covering the face on which the nozzles or ink ejection openings are arranged of the recording head can be made negative pressure. By this negative pressure, ink discharged through the nozzles can be conducted to the cylinder interior (ink suction chamber) B431*a*. At this time, as described above, the valve B422A of the piston shaft B422 closely contacts with the upper surface of the inner space of the piston, and the cylinder interior B431*a* and the hollow part B422B of the piston shaft B422 are in the air-tight state with each other, thus maintaining air-tightness.

During the upward movement of the piston B421, simultaneously, air above the piston (air in the air suction chamber) is discharged towards the suction joint B302 through the air introduction opening. At this time, since the suction joint B302 is released from connection with the carriage B301, a case is prevented that the discharged air reaches the respective ink reserving section of the sub-tank B400 on the carriage and pressures the recording head from the inside.

With the above described construction of the cylinder pump B408, unlike the conventional pump, since the hollow part B422B of the piston shaft B422 is used as an ink discharge passage, it is not necessary to provide a switching valve in the cylinder as seen in the conventional pump used in suction recovery processing. Therefore, a piston stroke for position adjustment of the valve with the piston is needless to be considered, and as a result thereof, the piston stroke can be reduced. Further, since the pressure adjusting mechanism is provided outside the cylinder, in the production of the pump, the assembly or incorporation process can be easily performed.

The lead screw B410, as described above, has a function of power transmission of various operations and setting of timing, including ink supply operation from the medium pack C100 to the ink reserving section on the carriage B301 or suction recovery operation through the suction cap B405. The lead screw B410, as shown in FIG. 19, has two spiral grooves B410*a* and a single spiral groove B410*b* formed with a predetermined distance from the former grooves. The spiral grooves B410*a* are engaged with part of the pump slider B441 to move the pump driving arm B409. On the other hand, the spiral groove B410*b* is engaged with part of the switching slider B412, thereby moving the switching slider B412.

Operations performed by the movement of the pump slider B441, as described above, are ink supply to the ink reserving section, suction recovery and wiping. On the other hand, operations performed by the movement of the switching slider B412 are capping operation of the suction cap B405 to the recording head and releasing operation of the joint member B401 and the carriage B301.

Figure 40B:
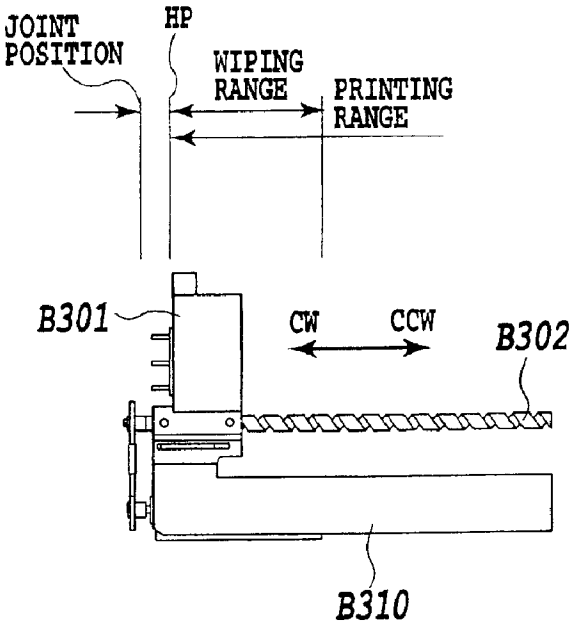
FIGS. 40A and 40B are illustrations for explaining an operation of each of two lead screws used in the printer main body of the embodiment.
Figure 40A:
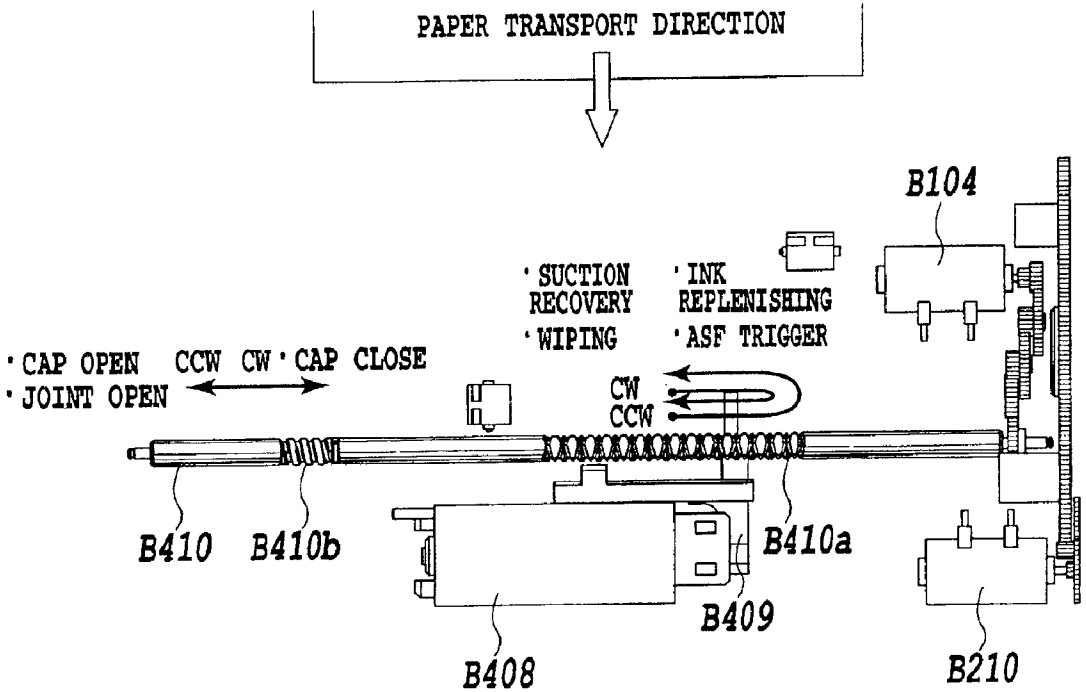

FIG. 40A is a diagram for explaining the relationship between the lead screw B410 and a driving force transmission mechanism of pump motor B104 for generating a driving force for rotating the same and the above various operations by the lead screw B410. In this figure, the conveying motor B210 for supply of printing medium and transmission mechanism thereof are also shown. FIG. 40B is a diagram for explaining the movement of the carriage B301 driven by the carriage motor (CR motor) B310 through the lead screw B410. On the present printer main body, the CR motor B310 shown in FIG. 40B is arranged on the left side of the pump B408 in FIG. 40A, and the structure shown in FIG. 40B is arranged above the structure shown in FIG. 40A (see FIG. 20).

In the following, with reference to the operation positions of the driving arm B409 and operation position of the switching slider B412 shown in FIG. 40A and FIGS. 41 to 43, 44A to 44C and 45A to 45C, power transmission and setting of timing of various operations by the lead screw B410 will be described.

Figure 41:
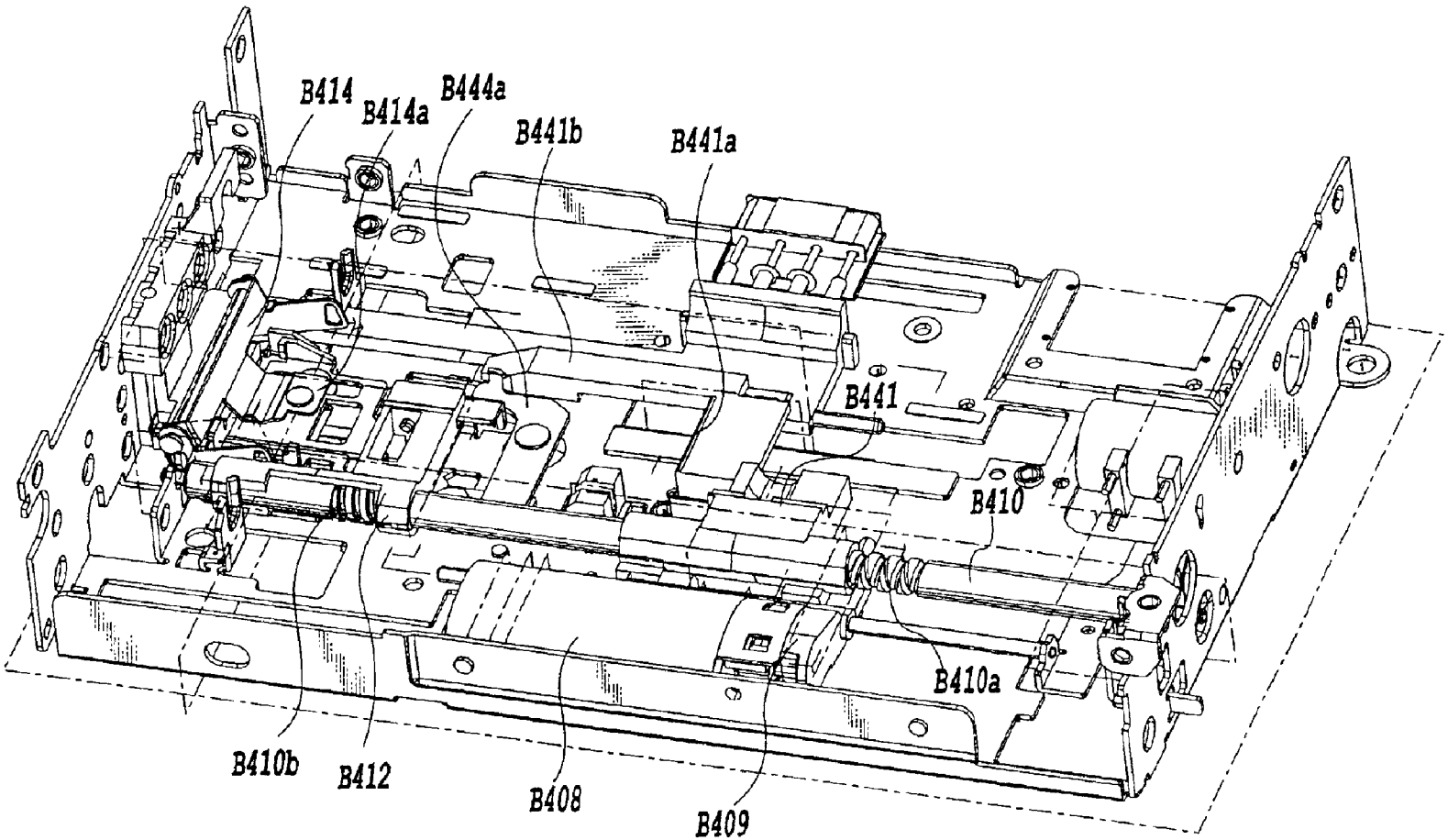
FIG. 41 is a perspective view of the printer main body for explaining various operations in accordance with positions of a pump driving arm and a switching slider which are moved by one of the two lead screws that is driven by a pump motor.
Figure 42:
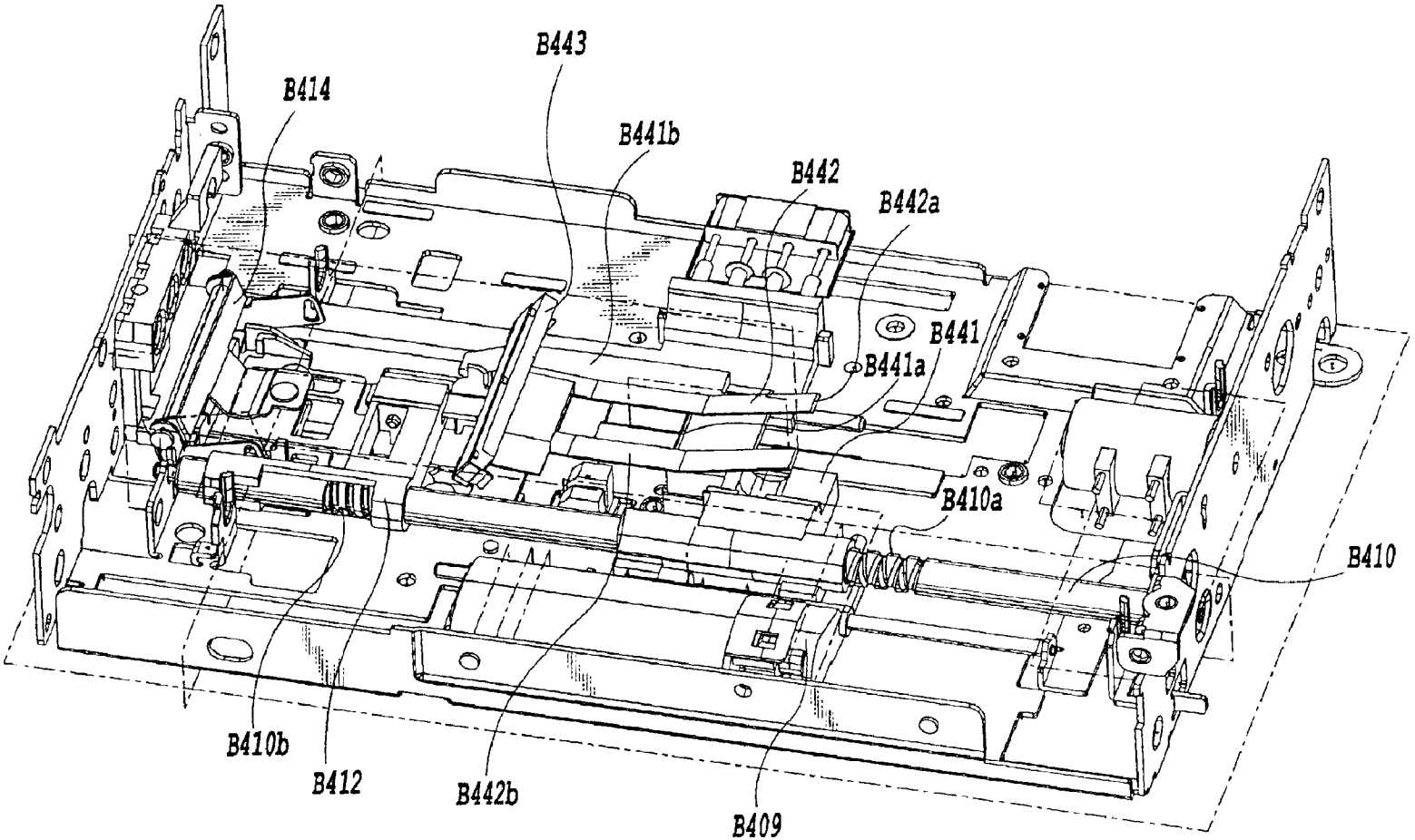
FIG. 42 is an illustration of the same state as shown in FIG. 41 with additional elements added.
Figure 44A:
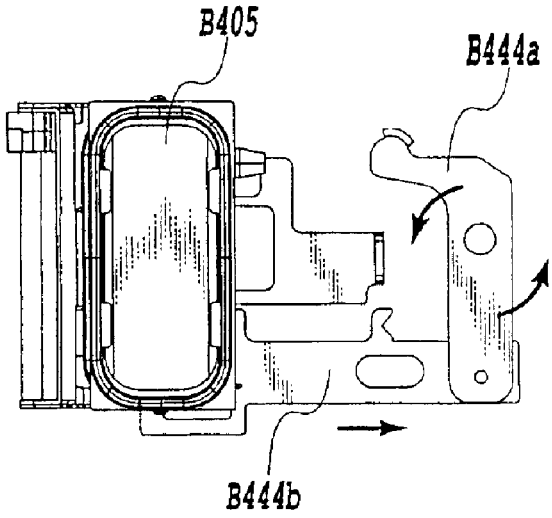
FIGS. 44A, 44B and 44C are illustrations for explaining a state of an atmosphere communication valve of the cap in each of the states shown in FIGS. 41, 42 and 43.
Figure 44B:
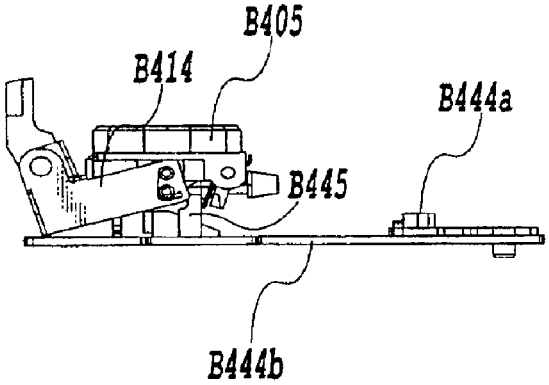
Figure 44C:
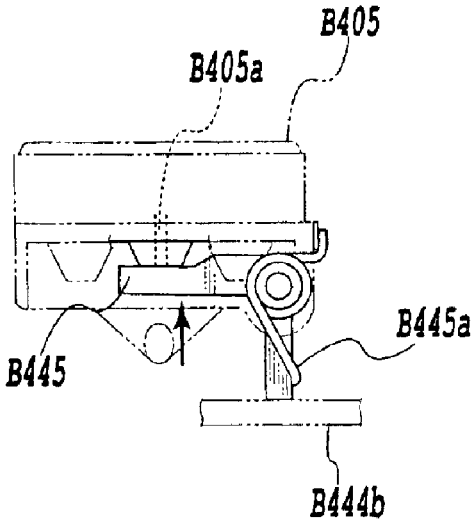
Figure 45A:
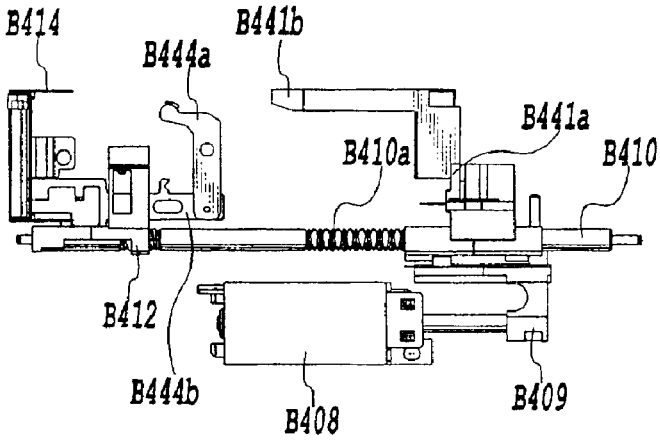
FIGS. 45A, 45B and 45C are illustrations for explaining a state of a mechanism for operating the atmosphere communication valve of the cap in each of the states shown in FIGS. 41, 42 and 43.
Figure 45B:
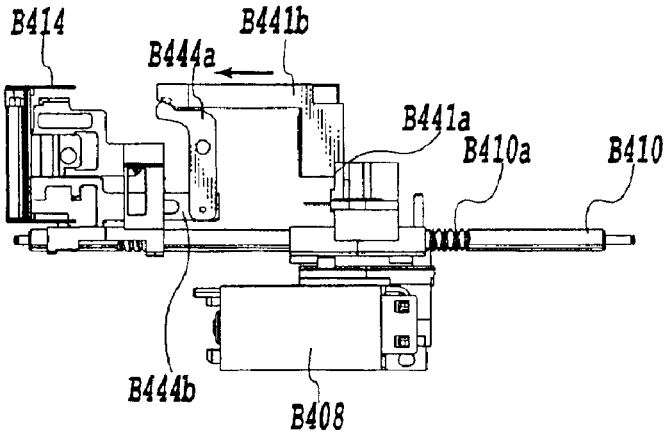
Figure 45C:
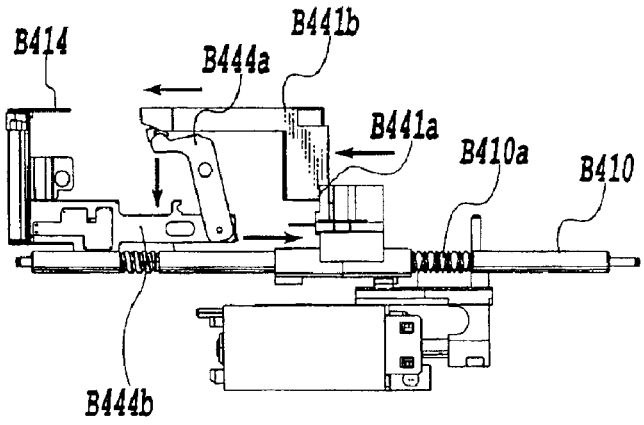

FIG. 41 shows the positions of the pump slider B441 and the switching slider B412 when the wiper and the suction cap B405 are at the ascended positions. At this time, the pump slider B441 is positioned at the left end relative to the spiral groove B410*a* of the lead screw B410, and by movement to this left end, a wiper pressure part B441*a* of the pump slider B441 is moved. The wiper pressure part B441*a*, by its movement, as shown in FIG. 42, pushes up part of a plate spring-formed receiving part B442*b* of a wiper base B442 which supports its end part B442*a* by a predetermined member. By this operation, the wiper B443 rises. At the same time, a releasing valve arm B441*b* connecting at the tip of a wiper pressure part 441*a* pushes a releasing lever B444*a*, as shown in FIG. 45C, to drive the releasing lever B444*a* and a releasing valve plate B444*b* cooperating with this lever, and to move atmosphere communication valves B445 (FIGS. 44B and 44C) to atmosphere communication positions. Further, by the movement to the left end, the above-described suction recovery processing can also be performed.

At this moment, the other switching slider B412 is at the right end relative to the spiral groove B410*b* of the lead screw B410, whereby the cap lever arm B414 is at the position where the suction cap B405 (not shown) is moved up (cap close; capping state). That is, the switching slider B412 is partly connected to the cap lever arm B414, by the movement to the right of the switching slider B412, the cap lever arm B414 is rotated, and the part B414*a* thereof can be moved up the position where the suction cap B405 is moved up.

Figure 43:
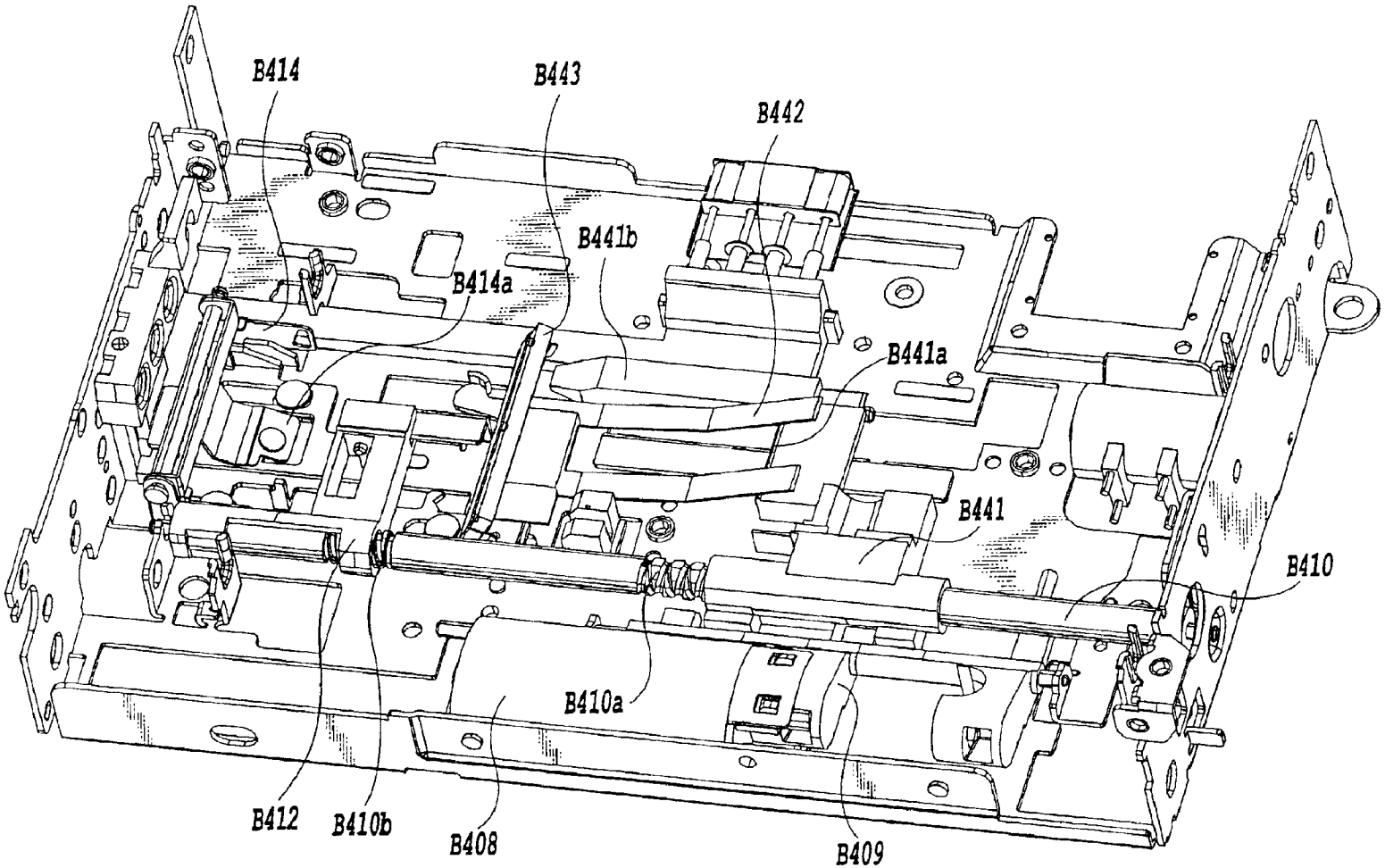
FIG. 43 is a perspective view of the printer main body for explaining various operations in accordance with other positions of the pump driving arm and the switching slider.

FIG. 43 is a diagram showing the state of other positions relative to the respective spiral grooves of the pump slider B441 and the switching slider B412 shown in FIGS. 41 and 42. The figures show the state when the pump slider B441 is at the right end relative to the spiral groove B410*a* and the switching slider B412 is in the middle of the spiral groove B410*b*.

At this time, the wiper pressure part B441*a* is at the retreated position from the pushed-up position of the wiper base B442, whereby the wiper B443 is at the retreated position from the movement range of the carriage B301. Further, when the joint member B401 is in the state connected with respective needles on the carriage, by the movement to the right end, ink supply to the ink reserving sections by the above pit-in can be performed. Further, at this time, the releasing valve arm B441*b* of the pump slider B441 is in the state shown in FIG. 45A, and the atmosphere communication valve B445 of the suction cap B405 is in a valve-close state as shown in FIG. 44C.

On the other hand, by moving the switching slider B412 to the left, the cap lever arm B414 is rotated, whereby its part B414*a* is pressed down and the suction cap B405 can be made open state.

As described above, the state described with reference to FIGS. 41 to 43, 44A to 44C and 45A to 45C is a basic example of the positions of the pump driving arm and the switching slider according to the rotation of the lead screw B410. That is, by the clockwise rotation or counterclockwise rotation of the lead screw B410, the spiral grooves B410*a* and the spiral groove B410*b*, and by appropriately determining the formation ranges or lengths thereof and the densities of the spiral grooves, various processings using the pump motor B104 are made possible. For example, in the above description, though upward movement of the suction cap B405 and rising of the wiper C106 are performed simultaneously, only the wiper rising can be performed.

3.4: Pack Connection Mechanism

The ink supply needles B502C, B502M and B502Y and the needle B503 for waste ink of the pack connection mechanism are integrally held by the ink needle holder B501. As a result, the needles are integrally connected to the ink pack joint C132 when the medium pack is attached. In this configuration, in particular, a force that acts when the joint C132 is slid to establish connection can be concentrated on the sliding operation. On the contrary, if the needle in each color is held separately, the force is dispersed, and this may result in a situation in which the sliding operation cannot be adequately performed.

4: Control System 4-1: Construction of Control System

Figure 46:
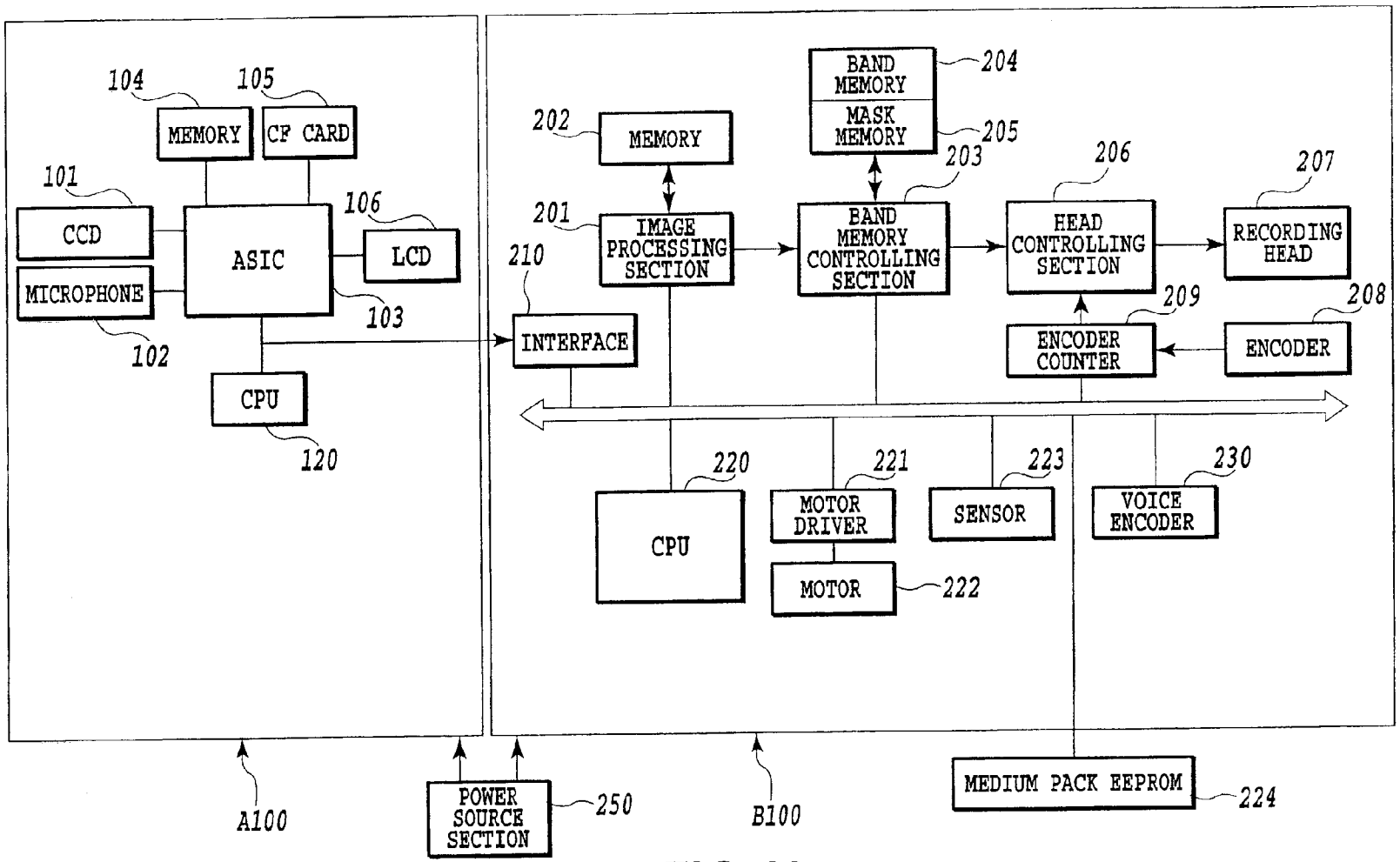
FIG. 46 is a schematic block diagram of a camera section and a printer section of the camera in FIG. 1.

FIG. 46 is a block diagram generally showing the camera section A100 and the printer section B100.

In the camera section A100, reference numeral 101 denotes a CCD as an image element; reference numeral 102 denotes a microphone for inputting voice; reference numeral 103 denotes an ASIC (Application Specific IC) for performing various processing; reference numeral 104 denotes a first memory for temporarily storing an image data and the like; reference numeral 105 denotes a CF (compact flash) card (corresponding to the CF card A107) for recording the photographed image; reference numeral 106 denotes an LCD (corresponding to the liquid crystal display section A105) which displays the photographed image or a replayed image; and reference numeral 120 denotes a first CPU for controlling the camera section A100.

In the printer section B100, reference numeral 210 denotes an interface between the camera section A100 and the printer section B100; reference numeral 201 denotes an image processing section (including a binary processing section for binarizing an image); reference numeral 202 denotes a second memory to be used in performing the image processing; reference numeral 203 denotes a band memory controlling section; reference numeral 204 denotes a band memory; reference numeral 205 denotes a mask memory; reference numeral 206 denotes a head controlling section; reference numeral 207 denotes a recording head (corresponding to the recording head B305); reference numeral 208 denotes an encoder (corresponding to the encoder detecting element B309); reference numeral 209 denotes an encoder counter; reference numeral 220 denotes a second CPU for controlling the printer section B100; reference numeral 221 denotes motor drivers; reference numeral 222 denotes motors (corresponding to the pump motor, LF motor and carriage motor); reference numeral 223 denotes sensors (including the CR sensor B313); reference numeral 224 denotes the EEPROM contained in the medium pack C100; reference numeral 230 denotes a voice encoder section and reference numeral 250 denotes a power source section for supplying electric power to the entire device (corresponding to the battery A108).

Figure 47:
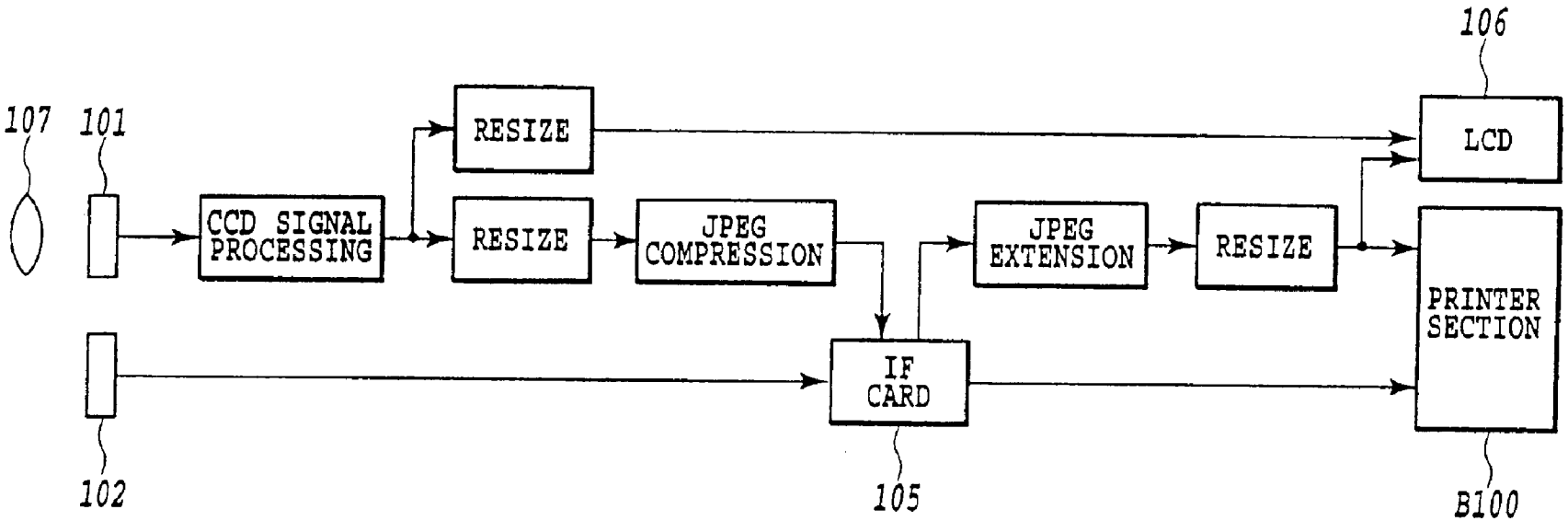
FIG. 47 is an illustration of signal processing in the camera section in FIG. 46.

FIG. 47 is a schematic diagram showing a signal processing in the camera section A100. In a photographing mode, an image photographed by the CCD 101 through a lens 107 is signal-processed (CCD signal processing) by ASIC 103 and then is converted to YUV intensity with two-color-different signal. Further, the photographed image is resized to a predetermined resolution and recorded on a CF card 105 using a compression method by JPEG, for example. Also, a voice is inputted through a microphone 102 and stored in the CF card 105 through the ASIC 103. A recording of the voice can be performed in such a manner as recording at the same time of photographing, or after photographing, so-called after-recording. In a replay mode, the JPEG image is read out from the CF card 105, extended by the JPEG through the ASIC 103 and further resized to be a resolution for displaying, thereby being displayed on the LCD 106.

Figure 48:
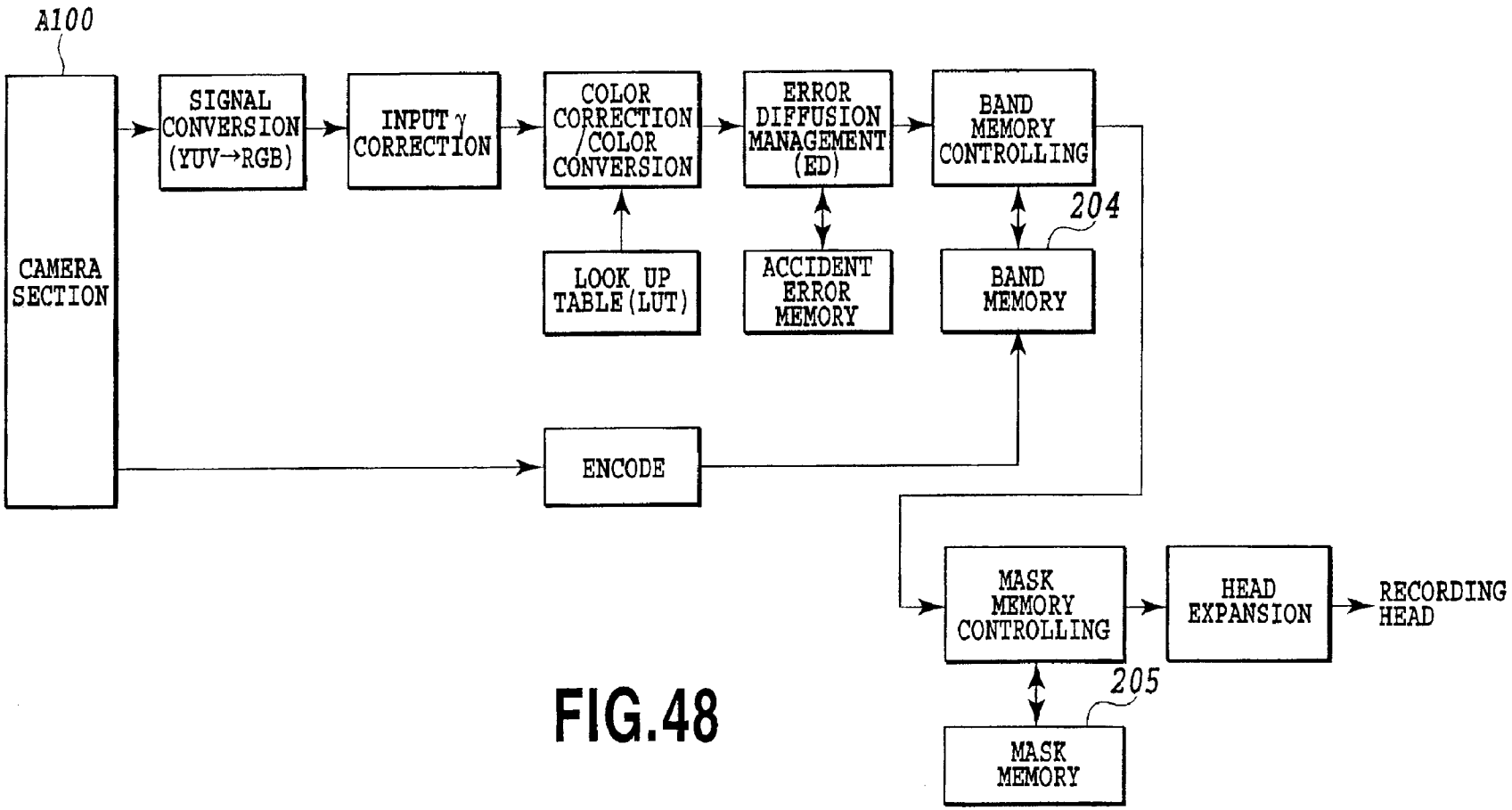
FIG. 48 is an illustration of signal processing in the printer section in FIG. 46.

FIG. 48 is a schematic diagram showing a signal processing performed in the printer section B100.

An image replayed on the camera section A100, that is the image being read out from the CF card 105, is extended by the JPEG through ASIC 103 as shown in FIG. 47 to resize a resolution to a suitable size for printing. Then, the resized image data (YUV signal), through an interface section 210, is transferred to the printer section B100. As shown in FIG. 48, the printer section B100 performs an image processing of an image data transferred from the camera section A100 by an image processing section 201, thereby performing a conversion of the image data to a RGB signal, an input γ correction in accordance with the features of a camera, a color correction and a color conversion using a look up table (LUT), and a conversion to a binarized signal for printing. When performing the binarizing processing, in order to perform an error diffusion (ED), a second memory 202 is utilized as an error memory. In the case of the present embodiment, though a binarizing processing section in the image processing section 201 performs the error diffusion processing, another processing may be performed such as a binarizing processing using a dither pattern. The binarized printing data is stored temporarily in the band memory 204 by a band memory controlling section 203. An encoder pulse from the encoder 208 enters into the encoder counter 209 of the printer section B100 every time the carriage B301 carrying the recording head 207 and the encoder 208 moves a certain distance. Then, in sync with this encoder pulse, printing data is read out from the band memory 204 and the mask memory 205, and, based on thus obtained printing data, the head controlling section 206 controls the recording head 207 to perform a recording.

A band memory shown in FIG. 48 is explained as below.

A plurality of nozzles in the recording head 207, for example, is formed in array so as to achieve a density of 1200 dpi (dots/inch). For recording the image by using such recording head 207, upon performing one scanning by the carriage, it is preferred to previously prepare a recording data (a recording data corresponding to one scanning) corresponding to the number of nozzles in the sub-scanning direction (hereinafter, also referred to as a "column (Y direction)") and a recording data corresponding to the recording area in the scanning direction (hereinafter, also referred to as a "row (X direction)", respectively. The recording data is created in the image processing section 201 and then is temporary stored in the band memory 204 by the band memory controlling section 203. After the recording data corresponding to one scan is stored in the band memory 204, the carriage is scanned in the main scanning direction. In so doing, an encoder pulse inputted by the encoder 208 is counted by the encoder counter 209 and, in accordance with this encoder pulse, a recording data is read out from the band memory 204. Then, on the basis of the image data, ink droplets are ejected from the recording head 207. In the case that a bidirectional recording system wherein an image is recorded upon outward scanning and homeward scanning (outward recording and homeward recording) of the recording head 207 is employed, the image data is read out from the band memory 204 depending on the scanning direction of the recording head 207. For example, an address of the image data read out from the band memory 204 is increased sequentially when the outward recording is performed, while an address read out from the band memory 204 is decreased sequentially when the homeward scanning is performed.

In a practical sense, a writing of an image data (C, M and Y) created by the image processing section 201 into the band memory 204 and a subsequent preparation of the image data corresponding to one band enable a scanning of the recording head 207. Then, the image data is read out from the band memory 204 subsequent to a scan of the recording head 207, so that the recording head 207 records the image on the basis of the image data. While in the recording operation, an image data to be recorded next is created at the image processing section 201 and thus created image data is written into an area of the band memory 204 corresponding to a recording position.

As has been stated above, the band memory controlling is carried out in such manner that a writing operation in which recording data (C, M, Y) created by the image processing section 201 is written into the band memory 204 and a reading operation for transferring the recording data (C, M, Y) to the head controlling section 206 in accordance with a scanning movement of the carriage are changed over.

A mask memory controlling in FIG. 48 is explained as below.

This mask memory controlling is required when a multi-pass recording system is employed. In using the multi-pass recording system, the recording image corresponding to one line which has a width corresponding to a length of the nozzle array of the recording head 207 is divided to a plurality of scanning operations of the recording head 207 to record. That is, the conveying amount of the printing medium to be intermittently carried to the sub-scanning direction is made to be 1/N of a length of the nozzle array. For example, when N=2, a recording image corresponding to one line is divided into two scans to record (two-pass recording), and when N=4, a recording image corresponding to one line is divided into four scans to record (four-pass recording). In similar fashion, when N=8, it becomes eight-pass recording, and when N=16, it becomes sixteen-pass recording. Therefore, the recording image corresponding to one line will be completed by a plurality of scans of the recording head 207.

Practically, a mask data for assigning the image data to a plurality of scans of the recording head 207 is stored in the mask memory 205, and then based on a conjunction (AND) data between the mask data and the image data, the recording head 207 ejects inks to record the image.

Also, in FIG. 48, voice data stored in the CF card 105, like the image data, is transferred to the printer section B100 through an interface 210 by the ASIC 102. The voice data transferred to the printer section B100 is encoded at the voice encoder 230 and then recorded with the image to be printed as code data. When there is no necessity to input voice data into a printing image, or when printing an image without a voice data, of course, the encoded voice data is not printed but only the image is printed.

In the present embodiment, the present invention has been explained as a printer-built-in camera integral with a camera section A100 and printer section B100. However, it would be possible to make each of the camera section A100 and the printer section B100 a separate device and to form in a similar manner as a structure in which those devices are connected to each other by the interface 210 to realize a similar function.

4-2: Summary of Operations

Operations of the above embodiment performed by the control system shown in FIGS. 46 to 48 will now be described with reference to FIGS. 49 and 50.

Figure 49:
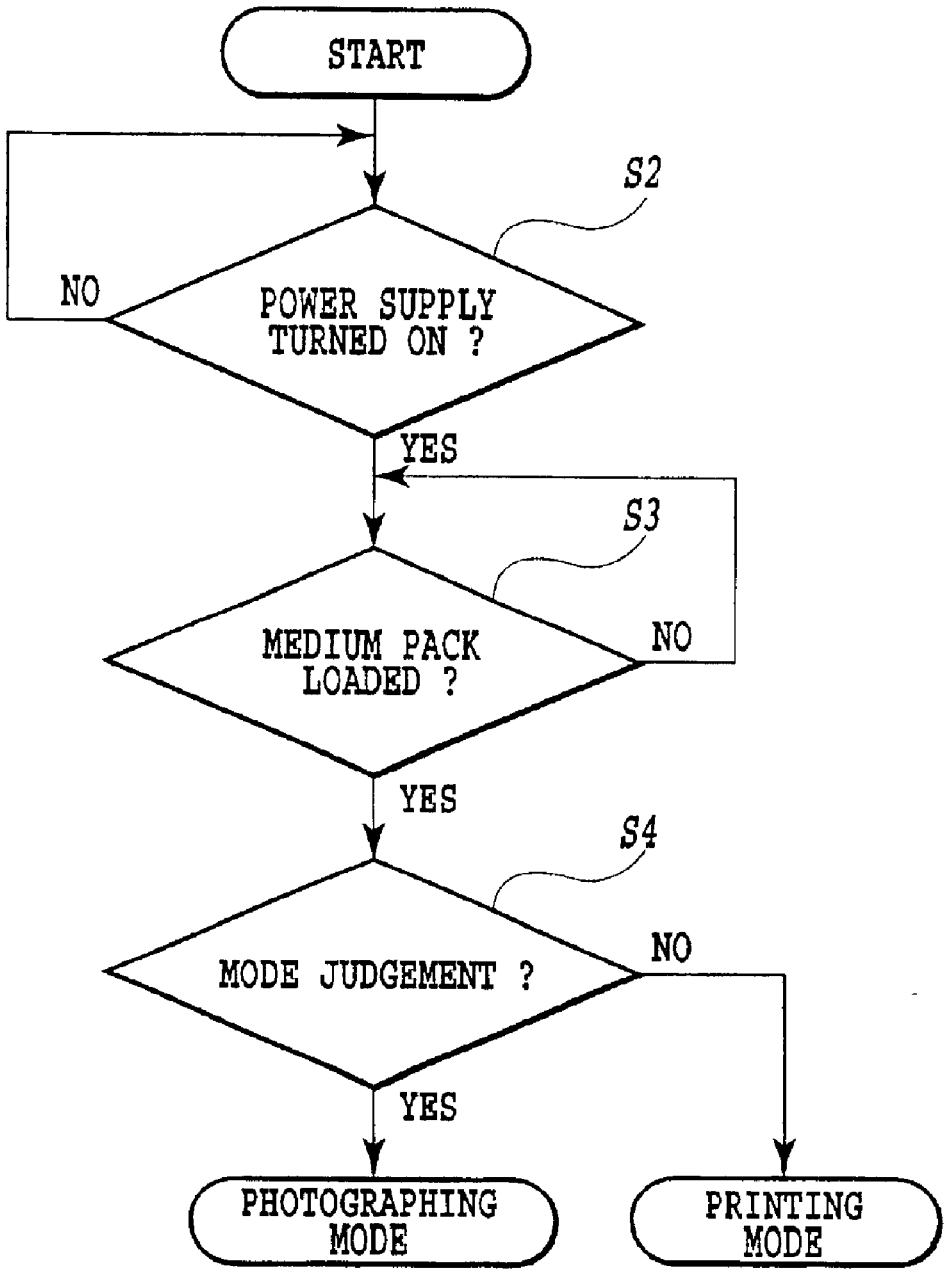
FIG. 49 is a flow chart showing an example of a processing procedure when a power supply is turned on in the construction in FIG. 46.

FIG. 49 shows an example of a processing procedure performed when the power supply is turned on. At step S2, it is judged whether the power supply of the apparatus has been turned on by an operation of the operator on the power supply switch. If yes, the process proceeds to step S3 and, if not, the standby state continues.

At step S3, it is judged whether the medium pack C100 has been loaded in the inserting portion A002 by the operator. If yes, the process proceeds to step S4 and, if not, the standby state continues until it is loaded. At this time, a display process may be performed to prompt the loading of the medium pack.

When the medium pack C100 is attached, the needles B502C, B502M, B502Y and B503 of the apparatus main body enter the rubber plugs C134 of the pack as a result of the attaching operation, thereby forming ink passages to the apparatus main body and a waste ink passage to the pack. The ink absorption body B506 made of a relatively hard porous material at the apparatus main body contacts the absorption bodies C141 made of a relatively soft porous material at the pack while compressing and deforming the same. When unused pack is attached, the joint C132 moves as a result of the attaching operation to cause the needles 133 to be stuck into the ink packs C130, which allows ink supply for the first time.

As a result of the attaching operation, the guide pins GP1 and GP2 of the apparatus main body enter the guide holes C163A and C163B on the pack, which expands the width of the opening C101L to allow one printing medium to pass. Further, this makes it possible to sandwich the printing media contained in the pack with the pick-up roller B201 and the press plate B202.

Electrical connections associated with the EEPROM 224 and so on are established as a result of the attaching operation. For example, when ink leaks from the opening C101J for collecting waste ink, the electrical connections enable a process of detecting or reporting the ink leakage by detecting electrical abnormality at the apparatus main body. Such detection may be performed at appropriate timing through a process of interrupting a program of the control system, and the occurrence of ink leakage may be displayed on the LCD 106. Alternatively, an electrical circuit may be separately configured to turn on a lamp when shorting occurs regardless of the program of the control system.

At step S4, mode judgment is performed to judge which of the photographing mode and the printing mode is set. If the photographing mode is set, operations as a digital camera are performed. Specifically, setting operations of various conditions required for the exposing operation such as determination of an exposure control value, determination of range finding information, and determination whether to turn on a flash or stroboscopic tube, and a series of exposing operations including driving of the lens for focusing, shutter speed control, control of the numerical aperture of the lens stop, and if necessary, turning on of the flash tube. While the procedure can branch to the photographing mode and the printing mode after the insertion of the medium pack is detected, a process may be added to proceed to the photographing mode forcibly in consideration to cases in which the apparatus of the embodiment is used as a camera only on the assumption that printing will not be performed.

When the printing mode is set, a process as described below is performed. One can assume here that the printing mode is set when a user selects an image photographed in the photographing mode or an image stored in the CF card 105 and operates the print button to print the same.

Figure 50:
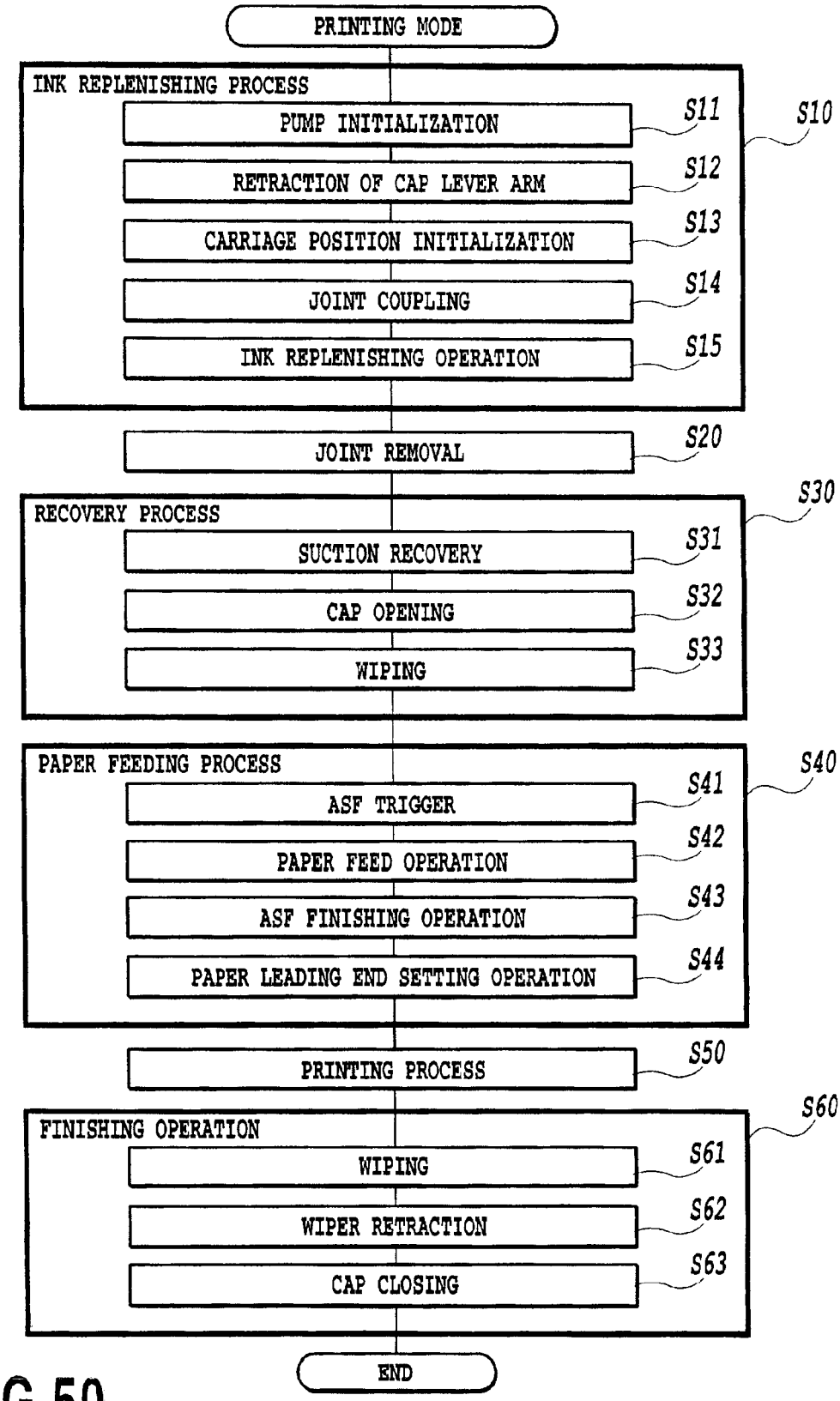
FIG. 50 is a flow chart showing an example of a processing procedure in a printing mode in the construction in FIG. 46.

FIG. 50 shows an example of a processing procedure in the printing mode.

When the procedure is activated, an ink replenishing process is performed at step S10. The ink replenishing process includes an operation of setting the piston in a predetermined position in the cylinder of the pump B408 to exert a suction force to the ink chambers B304 (pump initializing; step S11), an operation of retracting the cap lever arm B414 and the removing lever B404 before coupling the needles and air suction ports of the recording heads and the joints (B402Y, B402M and B402C) and the air suction cap B403 of the apparatus, respectively (retraction of the cap arm lever; step S12), an operation of setting the carriage B301 in a predetermined position spaced from the coupling position (carriage position initialization; step S13), an operation of coupling the needles and air suction ports of the recording heads and the joints and air suction cap of the apparatus with the carriage B301 kept at a sufficient and stable speed (joint coupling; step S14), and an operation of introducing ink sufficient for one printing medium by operating the pump B408 to exert a suction force in the ink chambers B304 (ink replenishing operation; step S15). Referring to the coupling of the joints, the needles of the recording heads are first coupled with the joints.

When the ink replenishing operation is completed, a process is performed to withdraw the carriage B301 from the position for coupling the joints (joint removal; step S20). This process is performed by driving the carriage motor to move the carriage B301 from the coupling position to the home position and, at this time, the withdrawal is made smooth by the driving force of the pump B408 that is transmitted through the cap arm lever to cause the removing lever B404 to urge the carriage B408 toward the home position.

Next, a recovery process is performed at step S30. The recovery process includes an operation of connecting the cap B405 with the surfaces of the heads formed with the ejecting ports (cap closing) and forcibly discharging ink by operating the pump to sucking the interior of the cap (suction recovery; step S31), an operation of moving the cap B405 away from the surfaces formed with the ejecting ports (cap opening; step S32) and an operation of projecting the wiper and moving the carriage to wipe the surfaces formed with the ejecting holes with the wiper (wiping; step S33).

A paper feed process is performed at step S40. The paper feed process includes an operation of releasing the ASF trigger B209 to sandwich the printing media contained in the pack with the pick-up roller B201 and the press plate 202 (step S41), an operation of feeding a printing medium to the apparatus main-body by the rotation of the paper feed roller (step S42), an operation of causing the pick-up roller B201 and the press plate 202 to move again to the positions to standby for sandwiching with the ASF trigger B209 as the paper feeding is started (step S43) and a setting operation for setting the leading end of the printing medium in the printing position (step S44).

After the above-described processes are completed, a printing process is performed based on image data (step S50). Specifically, an operation of forming a specified image is performed while performing the scanning of the recording heads and the transportation of the printing medium alternately, and the printing medium is thereafter ejected out of the apparatus.

After the printing process, a finishing operation is performed at step S60. The finishing process includes an operation of projecting the wiper and moving the carriage B301 to wipe the surfaces formed with the ejecting holes with the wiper (wiping; step S61), an operation of retracting the wiper thereafter (step S62) and an operation of connecting the cap B405 with the surfaces of the heads formed with the ejecting holes (cap closing; step S63).

As described above, the container of consumable supplies for a printer is equipped with a plurality of introducing portions for introducing ink discharged from the printer, and it is therefore possible to adequately introduce and receive ink discharged from various parts of the printer in accordance with the discharged amount and the mode of discharge.

The container of consumable supplies for a printer is equipped with the introducing portion for introducing ink discharged from the printer and a storage unit such as an EEPROM located in the vicinity of the introducing portion; it is therefore possible to detect leakage of ink utilizing the fact that ink which has leaked from the introducing portion enters an electrical connecting portion between the storage unit and the printer.

In the container of consumable supplies for a printer, the introducing portion for introducing ink discharged from the printer and a receiving portion for allowing connection of a printing medium feeding unit of the printer are spaced from each other. This makes it possible to prevent a printing medium from being smeared with ink which has leaked from the introducing portions.

The container of consumable supplies for a printer is equipped with an absorption body capable of absorbing ink introduced through the plurality of introducing portions, and an infiltration passage of the ink is detoured between parts of the absorption body associated with the plurality of introducing portions. This makes it possible to hold waste ink discharged from recording heads and absorbed by the absorption body as a result of a recovery operation such that it is unlikely to leak out.

The container of consumable supplies for a printer is equipped with a sheet-like member for supplying printing medium smoothly, and this makes it possible to supply the printing medium to the printer reliably.

The container of consumable supplies for a printer is equipped with the receiving portion for allowing connection of the printing medium feeding unit of the printer and a receiving portion for allowing connecting of a printing medium urging unit of the printer, and the receiving portions are put in a face-to-face relationship with the printing media in the container interposed between them. Thus, the printing medium is reliably supplied to the printer using the printing medium feeding unit and the printing medium urging unit.

The container of consumable supplies for a printer is equipped with an ink containing portion for containing ink and an ink communication member which is stuck into the ink containing portion to establish ink communication, which allows the ink containing portion to seal and contain ink independently of the outside before the container is attached to the printer. As a result, leakage of ink is prevented during distribution of the container, and the ink containing portion which is in the form of a bag or the like for sealing and containing ink independently can be easily manufactured and assembled.

The container of consumable supplies for a printer is equipped with a receiving portion for allowing connection of the printing medium feeding unit of the printer, a plurality of ink supply connecting portions capable of supplying inks in a plurality of colors contained in containers, and an introducing portion for introducing ink discharged from the printer which are arranged in the same order. This makes it possible to prevent a printing medium from being smeared with ink which has leaked from the introducing portion. Further, the plurality of the ink supply connecting portions and the introducing portion for introducing ink discharged from the printer are integrated to facilitate mounting.

The container of consumable supplies for a printer is equipped with a printing medium supply port for supplying printing media contained in a container to the printer one by one, and the gap at the printing medium supply port is adjusted to a prescribed size when the container is attached to the printer. This makes it possible to limit the gap at the printing medium supply port to optimum dimensions when the container is attached to the printer without any particular improvement in the dimensional accuracy of the gap at the printing medium supply port at the time of manufacture of the container.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A container of consumable supplies for a printer, said container being attachable to a printer for printing on a printing medium by using an inkjet head for ejecting ink, said container having an ink containing portion for hermetically containing ink to be supplied to said inkjet head and said container comprising:

a holder for retaining said ink containing portion;

an ink supply connecting portion connected to an ink receiving portion of said printer as a result of an attaching operation of attaching an integral coupling member to the ink receiving portion, for allowing the ink contained in said ink containing portion to be supplied to the ink receiving portion of said printer;

a hollow needle provided with said ink supply connecting portion and configured to pierce said ink containing portion to establish ink communication between said ink containing portion and said ink supply connecting portion; and a latch member for maintaining a joined condition between said holder and said ink supply connecting portion upon piercing said ink containing portion with said hollow needle, wherein said ink supply connecting portion and said hollow needle are provided on said integral coupling member for coupling with the ink receiving portion, said coupling member is moved as a result of the attaching operation, and said hollow needle being pierced into said ink containing portion as a result of the movement.

2. A container as claimed in claim 1, wherein said ink containing portion is in the form of a bag formed by folding a sheet body and by sealing three sides thereof and wherein said hollow needle pierces said folded portion that is not sealed, and further comprises a member for supporting said folded portion that is not sealed, for preventing the folded portion from being flattened and maintaining said folded portion in a curved state.

3. A container as claimed in claim 1, wherein said container further contains at least one of a printing medium to be printed by said inkjet head and a waste ink absorption body for collecting waste ink discharged from said inkjet head.

4. A container as claimed in claim 1, wherein each of said holder and said coupling member has a member for preventing them from being coupled before said container is attached to said printer and said latch member prevents them from being decoupled and disengaged from each other after the attachment.

5. A container attachable to an ink jet printing apparatus and containing ink to be supplied to the ink jet printing apparatus, said container comprising:

an ink pack for containing ink;

an ink pack joint coupled with an ink receiving portion of the ink jet printing apparatus to supply ink contained in said ink pack when said container is installed in the ink jet printing apparatus;

a hollow needle provided with said ink pack joint and configured to pierce said ink pack to establish ink communication between said ink pack and said ink pack joint; and a latch member for maintaining a joined condition between said ink pack and said ink pack joint upon piercing said ink pack with said hollow needle, wherein said ink pack joint and said hollow needle are provided on an integral coupling member for coupling with the ink receiving portion, said coupling member is moved as a result of said container being installed in the ink jet printing apparatus, and said hollow needle being pierced into said ink pack as a result of the movement.

* * * * *

UNITED STATES PATENT AND TRADEMARK OFFICE

CERTIFICATE OF CORRECTION

PATENT NO. : 6,929,356 B2
APPLICATION NO. : 10/100143
DATED : August 16, 2005
INVENTOR(S) : Hirano et al.

It is certified that error appears in the above-identified patent and that said Letters Patent is hereby corrected as shown below:

COLUMN 3
Line 45, "-for" should read --for--.

COLUMN 6
Line 36, "sate" should read --state--.

COLUMN 9
Line 54, "sides the" should read --sides of the--.

COLUMN 24
Line 30, "is" should read --are--.
Line 35, "is" should read --are--.

COLUMN 27
Line 3, "Mechanism As" should read --Mechanism--, and "As" should start a new paragraph.

COLUMN 28
Line 58, "arm B266" should read --arm B226--.

COLUMN 29
Line 7, "arm B266." should read --arm B226.--.

COLUMN 33
Line 63, "distributed-between" should read --distributed between--.

COLUMN 41
Line 60, "direction)"," should read --direction)"),--.
Line 62, "temporary" should read --temporarily--.

UNITED STATES PATENT AND TRADEMARK OFFICE

CERTIFICATE OF CORRECTION

PATENT NO. : 6,929,356 B2
APPLICATION NO. : 10/100143
DATED : August 16, 2005
INVENTOR(S) : Hirano et al.

It is certified that error appears in the above-identified patent and that said Letters Patent is hereby corrected as shown below:

COLUMN 43
Line 60, "performed. Specifically" should read --performed, specifically--.

Signed and Sealed this

Twelfth Day of December, 2006

JON W. DUDAS
*Director of the United States Patent and Trademark Office*